US006525255B1

(12) United States Patent
Funaki

(10) Patent No.: US 6,525,255 B1
(45) Date of Patent: Feb. 25, 2003

(54) SOUND SIGNAL ANALYZING DEVICE

(75) Inventor: Tomoyuki Funaki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 08/974,339

(22) Filed: Nov. 19, 1997

(30) Foreign Application Priority Data

Nov. 20, 1996 (JP) ..... 8-324774
Nov. 20, 1996 (JP) ..... 8-324775

(51) Int. Cl.[7] ..... G10H 7/00
(52) U.S. Cl. ..... 84/616; 84/661
(58) Field of Search ..... 84/616, 654, 661; 81/616, 654, 661

(56) References Cited

U.S. PATENT DOCUMENTS 5,756,918 A * 5/1998 Funaki
5,799,276 A * 8/1998 Komissarchik et al.

FOREIGN PATENT DOCUMENTS

| | | |
|---|---|---|
| JP | 60-43697 | 8/1985 |
| JP | 1-219889 | 1/1989 |
| JP | 4-284496 | 10/1992 |

* cited by examiner

*Primary Examiner*—Jeffrey Donels
(74) *Attorney, Agent, or Firm*—Morrison & Foerster LLP

(57) ABSTRACT

An average is calculated of every predetermined number of sample amplitude values of a sound signal from an external sound source, and the respective averages are output as a time-series of average level information. On the basis of the average level information, each available section of the sound signal is detected where there appears to be a musical sound. On the basis of degrees of inclination in the average level information within the available section, stable sections are detected for detection of same-waveform sections. On the basis of the signals within the stable sections, a steady section is detected which corresponds to a note. A time-varying band-pass filtering operation is then performed on the sound signal, and detection is made of a plurality of periodic reference points of the sound signal. Subsequently, degrees of similarity in waveform are determined between every adjacent signal sections of the sound signal corresponding to the periodic reference points and those of the signal sections having a high similarity are linked together so as to detect same-waveform sections. These same-waveform sections are subdivided in consideration of level stability or the like, so as to detect a steady section representing a note. Thus, even when an input sound from a microphone or the like fluctuates slightly in pitch or level, each steady section of the sound other than the fluctuating section can be effectively analyzed.

48 Claims, 30 Drawing Sheets

| WAVEFORM VALUE | NUMBER OF SAMPLE POINTS (LENGTH OF SECTION) | TOTAL | AVERAGE |
|---|---|---|---|
| 0 | 1 | 0 | 0 |
| 15 | 2 | 15 | 8 |
| 69 | 3 | 84 | 28 |
| 150 | 4 | 234 | 59 |
| 200 | 5 | 434 | 89 |
| 80 | 6 | 514 | 86 |
| 50 | 7 | 564 | 81 |
| 10 | 8 | 574 | 72 |
| −9 | 9 | 583 | 65 |
| −26 | 10 | 609 | 61 |
| −67 | 11 | 676 | 61 |
| −90 | 12 | 766 | 64 |
| −189 | 13 | 955 | 73 |
| −214 | 14 | 1169 | 84 |
| −157 | 15 | 1326 | 88 |
| −110 | 15 | 1436 | 96 |
| −50 | 15 | 1471 | 98 |
| −30 | 15 | 1432 | 95 |
| −12 | 15 | 1294 | 86 |
| −6 | 15 | 1100 | 73 |
| ⋮ | ⋮ | ⋮ | ⋮ |

| SAMPLE POINT | WAVE 1Y | WAVE 2Z | DIFFERENCE | ABSOLUTE DIFFERENCE VALUE |
|---|---|---|---|---|
| 0 | 1000 | 982 | 18 | 18 |
| 1 | 995 | 1000 | −5 | 5 |
| 2 | 653 | 653 | 0 | 0 |
| 3 | 426 | 430 | −4 | 4 |
| 4 | 164 | 159 | 5 | 5 |
| 5 | 58 | 60 | −2 | 2 |
| 6 | −4 | 3 | −7 | 7 |
| 7 | −108 | −100 | −8 | 8 |
| 8 | −275 | −280 | 5 | 5 |
| 9 | −487 | −489 | 2 | 2 |
| 10 | −648 | −655 | 7 | 7 |
| 11 | −904 | −900 | −4 | 4 |
| 12 | −1000 | −1000 | 0 | 0 |
| 13 | −888 | −890 | 2 | 2 |
| 14 | −599 | −592 | −7 | 7 |
| 15 | −412 | −409 | −3 | 3 |
| 16 | −244 | −245 | 1 | 1 |
| 17 | −25 | −29 | 4 | 4 |
| 18 | 0 | 0 | 0 | 0 |
| 19 | 26 | 24 | 2 | 2 |
| 20 | 135 | 152 | −17 | 17 |
| 21 | 206 | 199 | 7 | 7 |
| 22 | 534 | 540 | −6 | 6 |
| 23 | 829 | 821 | 8 | 8 |
| | | | TOTAL OF ABSOLUTE DIFFERENCE VALUE | : 122 |

NOTE DISTANCE VARIATION CURVE & STABLE-PITCH SECTION

DYNAMIC BORDER CURVE & STABLE-PITCH SECTION

DETECTION OF STABLE-PITCH SECTION BASED ON INCLINATIONS OF NOTE DISTANCE VARIATION CURVE

DETECTION OF STABLE-PITCH SECTION BASED ON DYNAMIC BORDER

DETECTION OF REPRESENTATIVE FREQUENCY BASED ON STATIC BORDER

STEADY SECTION

[0] [1] [2] [3] [4] [5] [6] [7] [8] [9] [10] [11] [12]

FIG. 19A

PERIOD LENGTHS OF STEADY SECTION

| PERIOD LENGTH |
|---|
| 256 |
| 258 |
| 259 |
| 259 |
| 257 |
| 257 |
| 255 |
| 253 |
| 257 |
| 258 |
| 257 |
| 244 |

AVERAGE OF PERIOD LENGTHS : $\frac{3070}{12} = 255.833$

REPRESENTATIVE FREQUENCY : $\frac{44100}{255.833} = 172.38\text{Hz}$

FIG. 19B

| STEADY SECTION NO. | REPRESENTATIVE FREQUENCY | NOTE DISTANCE | WHOLE NUMBER | PITCH TRAIN |
|---|---|---|---|---|
| [0] | 172.38 | --- | --- | 0 |
| [1] | 190.34 | 1.7158 | 2 | 2 |
| [2] | 215.02 | 2.1557 | 2 | 4 |
| [3] | 226.02 | 0.8187 | 1 | 5 |
| [4] | 188.13 | −3.1766 | −3 | 2 |
| [5] | 200.58 | 1.1093 | 1 | 3 |
| ⋮ | ⋮ | ⋮ | ⋮ | ⋮ |

FIG. 19C

| POINT | | INCLINATION | | TOTAL INCLINATION | |
|---|---|---|---|---|---|
| a 1 | (100) | b 1 | 0. 0 3 : (a3−a1) | c 1 | 1. 8 3 : (b1+b2+b3+b4+b5) |
| a 2 | (200) | b 2 | 0. 1 5 : (a4−a2) | c 2 | 3. 6 0 : (b2+b3+b4+b5+b6) |
| a 3 | (300) | b 3 | 0. 2 5 : (a5−a3) | c 3 | 5. 3 5 : (b3+b4+b5+b6+b7) |
| a 4 | (400) | b 4 | 0. 5 0 : (a6−a4) | c 4 | 7. 1 0 : (b4+b5+b6+b7+b8) |
| a 5 | (500) | b 5 | 0. 9 0 : (a7−a5) | c 5 | 8. 3 0 : (b5+b6+b7+b8+b9) |
| a 6 | (600) | b 6 | 1. 8 0 : (a8−a6) | c 6 | 8. 6 0 : (b6+b7+b8+b9+b10) |
| a 7 | (700) | b 7 | 1. 9 0 : (a9−a7) | c 7 | 7. 5 0 : (b7+b8+b9+b10+b11) |
| a 8 | (800) | b 8 | 2. 0 0 : (a10−a8) | c 8 | −−− |
| a 9 | (900) | b 9 | 1. 7 0 : (a11−a9) | c 9 | −−− |
| a 10 | (1000) | b 10 | 1. 2 0 : (a12−a10) | c 10 | −−− |
| a 11 | (1100) | b 11 | 0. 7 0 : (a13−a11) | c 11 | −−− |
| | | | | | |

| SAMPLE POINT | WAVE 1Y | WAVE 2Z | DIFFERENCE | ABSOLUTE DIFFERENCE VALUE |
|---|---|---|---|---|
| 0 | 0 | 0 | 0 | 0 |
| 1 | 26 | 24 | 2 | 2 |
| 2 | 135 | 152 | −17 | 17 |
| 3 | 206 | 199 | 7 | 7 |
| 4 | 534 | 540 | −6 | 6 |
| 5 | 829 | 821 | 8 | 8 |
| 6 | 1000 | 982 | 18 | 18 |
| 7 | 995 | 1000 | −5 | 5 |
| 8 | 653 | 653 | 0 | 0 |
| 9 | 426 | 430 | −4 | 4 |
| 10 | 164 | 159 | 5 | 5 |
| 11 | 58 | 60 | −2 | 2 |
| 12 | −4 | 3 | −7 | 7 |
| 13 | −108 | −100 | −8 | 8 |
| 14 | −275 | −280 | 5 | 5 |
| 15 | −487 | −489 | 2 | 2 |
| 16 | −648 | −655 | 7 | 7 |
| 17 | −904 | −900 | −4 | 4 |
| 18 | −1000 | −1000 | 0 | 0 |
| 19 | −888 | −890 | 2 | 2 |
| 20 | −599 | −592 | −7 | 7 |
| 21 | −412 | −409 | −3 | 3 |
| 22 | −244 | −245 | 1 | 1 |
| 23 | −25 | −29 | 4 | 4 |
| | | | TOTAL ABSOLUTE DIFFERENCE VALUE : 122 | |
FIG. 40
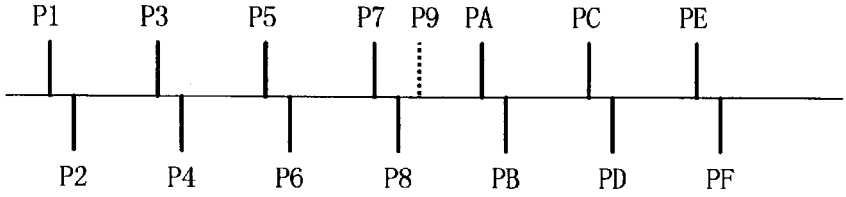
FIG. 41A
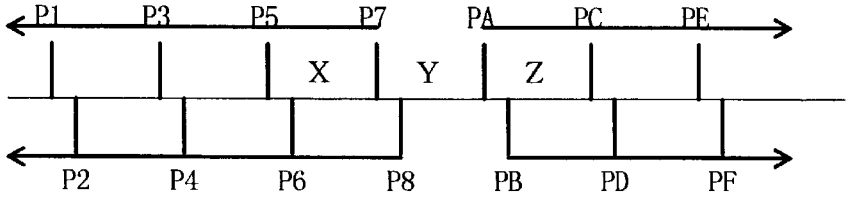
FIG. 41B (A) STEADY SECTION DETECTION ON PLUS & MINUS SIDES OF STEADY SECTION
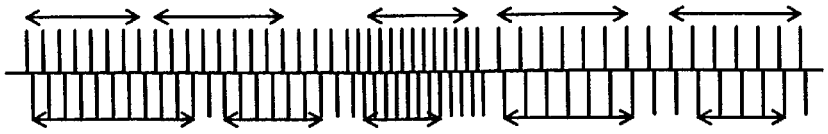
FIG. 44A
(B) PERPOSITION OF PLUS & MINUS SIDES OF STEADY SECTION
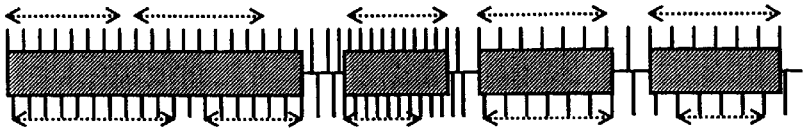
FIG. 44B
| FREQUENCY | NOTE DISTANCE |
|---|---|
| 257 | ---- |
| 258 | 0.067 |
| 258 | 0.000 |
| 259 | 0.067 |
| 257 | −0.135 |
| 256 | −0.068 |
| 258 | 0.135 |
| 259 | 0.067 |
| 258 | −0.067 |
| 266 | 0.530 |
| 276 | 0.641 |
| 288 | 0.739 |
| 290 | 0.120 |
| 293 | 0.179 |
| 292 | −0.059 |
| 293 | 0.059 |
| 292 | −0.059 |
| 291 | −0.056 |
| 293 | 0.119 |
| 295 | 0.119 |
| 294 | −0.059 |
| 295 | 0.059 |
| 295 | 0.000 |
| 296 | 0.059 |
SECTION
FIG. 45A
| SOUND PRESSURE LEVEL | AMPLIFICATION RATIO (log) | INITIAL DIVISION | FINAL DIVISION |
|---|---|---|---|
| 935 | ----- | | |
| 938 | 0.00139 | | |
| 939 | 0.00046 | | |
| 939 | 0.00000 | | |
| 935 | −0.00189 | | |
| 932 | −0.00140 | | |
| 930 | −0.00093 | | |
| 928 | −0.00093 | | |
| 920 | −0.00376 | | |
| 911 | −0.00427 | | |
| 902 | −0.00431 | | |
| 887 | −0.00728 | | |
| 882 | −0.00246 | | |
| 884 | 0.00098 | | |
| 899 | 0.00730 | X | X |
| 935 | 0.01705 | ○ | |
| 959 | 0.01101 | ○X | |
| 973 | 0.00629 | | |
| 986 | 0.00576 | | |
| 982 | −0.00177 | | |
| 981 | −0.00044 | | |
| 980 | −0.00044 | | |
| 983 | 0.00132 | | |
| 984 | 0.00144 | | |
FIG. 45B
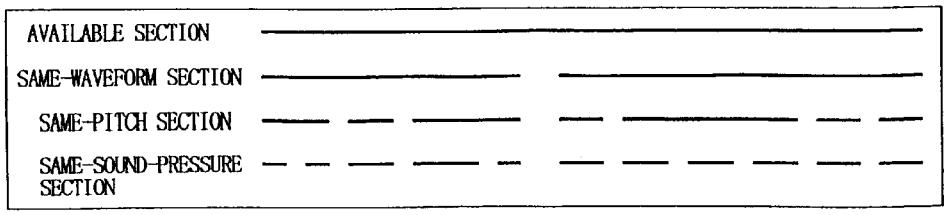
FIG. 46

STEADY SECTION

[0] [1] [2] [3] [4] [5] [6] [7] [8] [9] [10] [11] [12]

FIG. 47A

PERIOD LENGTH & DIFFERENCE RATE OF STEADY SECTION

| PERIOD LENGTH | DIFFERENCE RATE |
|---|---|
| 256 | 4 |
| 258 | 7 |
| 259 | 3 |
| 259 | 1 |
| 257 | 2 |
| 257 | 5 |
| 255 | 1 |
| 253 | 6 |
| 257 | 5 |
| 258 | 9 |
| 257 | 3 |
| 244 | 2 |

AVERAGE OF PERIOD LENGTHS : $\frac{3070}{12} = 255.833$

REPRESENTATIVE FREQUENCY : $\frac{44100}{255.833} = 172.38\text{Hz}$

FIG. 47B (C)

| STEADY SECTION NO. | REPRESENTATIVE FREQUENCY | NOTE DISTANCE | WHOLE NUMBER | PITCH TRAIN |
|---|---|---|---|---|
| [0] | 172.38 | --- | --- | 0 |
| [1] | 190.34 | 1.7158 | 2 | 2 |
| [2] | 215.02 | 2.1557 | 2 | 4 |
| [3] | 226.02 | 0.8187 | 1 | 5 |
| [4] | 188.13 | −3.1766 | −3 | 2 |
| [5] | 200.58 | 1.1093 | 1 | 3 |
| ⋮ | ⋮ | ⋮ | ⋮ | ⋮ |

FIG. 47C

| NOTE POSITION | (0) | (1) | (2) | (3) | (4) | (5) | (6) | (7) | (8) | (9) | (10) | (11) |
|---|---|---|---|---|---|---|---|---|---|---|---|---|
| NATURAL SCALE | ○ | × | ○ | ○ | × | ○ | × | ○ | ○ | × | ○ | × |
| HARMONIC SCALE | ○ | × | ○ | ○ | × | ○ | × | ○ | ○ | × | × | ○ |
| MELODIC SCALE | ○ | × | ○ | ○ | × | ○ | × | ○ | ↓ | ↑ | ↓ | ↑ |

(↑ : ASSIGNABLE WHEN ASCENDING ↓ : NON-ASSIGNABLE WHEN DESCENDING )

FIG. 48

CUMULATIVE TOTAL OF NOTE ASSIGNMENT DIFFERENCES

| NOTE POSITION | (0) | (1) | (2) | (3) | (4) | (5) | (6) | (7) | (8) | (9) | (10) | (11) |
|---|---|---|---|---|---|---|---|---|---|---|---|---|
| NATURAL | 2.233 | — | 1.976 | 1.688 | — | 2.233 | — | 1.976 | 2.973 | — | 1.688 | — |
| HARMONIC | 2.233 | — | 1.976 | 1.688 | — | 3.326 | — | 3.674 | 3.377 | — | — | 2.120 |
| MELODIC | 2.233 | — | 1.976 | 2.973 | — | 3.335 | — | 2.233 | 3.377 | 2.377 | 1.688 | 2.120 |

FIG. 49A

CUMULATIVE TOTAL OF NOTE ASSIGNMENT DIFFERENCES GREATER THAN 0.5

| NOTE POSITION | (0) | (1) | (2) | (3) | (4) | (5) | (6) | (7) | (8) | (9) | (10) | (11) |
|---|---|---|---|---|---|---|---|---|---|---|---|---|
| NATURAL | 1.663 | — | 1.535 | 0.891 | — | 1.663 | — | 1.535 | 2.553 | — | 0.891 | — |
| HARMONIC | 1.663 | — | 1.535 | 0.891 | — | 2.865 | — | 3.493 | 3.019 | — | — | 1.606 |
| MELODIC | 1.663 | — | 1.535 | 2.533 | — | 2.870 | — | 1.663 | 3.019 | 1.735 | 0.891 | 1.606 |

FIG. 49B

NUMBER OF NOTES

| NOTE POSITION | (0) | (1) | (2) | (3) | (4) | (5) | (6) | (7) | (8) | (9) | (10) | (11) |
|---|---|---|---|---|---|---|---|---|---|---|---|---|
| NATURAL | 2 | – | 2 | 1 | – | 2 | – | 2 | 3 | – | 1 | – |
| HARMONIC | 2 | – | 2 | 1 | – | 3 | – | 4 | 3 | – | – | 2 |
| MELODIC | 2 | – | 2 | 3 | – | 3 | – | 2 | 3 | 2 | 1 | 2 |

FIG. 49C

PITCH TRAIN

| STEADY SECTION NO. | [0] | [1] | [2] | [3] | [4] | [5] | --- |
|---|---|---|---|---|---|---|---|
| PITCH | 0 | 2 | 3 | 5 | 2 | 4 | --- |

FIG. 49D

NOTE DISTANCE BETWEEN LEADING TIME SECTION & EVERY SUCCEEDING TIME SECTION

| TIME VALUE SECTION NO. | REPRESENTATIVE FREQUENCY | NOTE DISTANCE |
|---|---|---|
| [0] | 172.38 | ——— |
| [1] | 190.34 | 1.7158 |
| [2] | 215.58 | 3.8715 |
| [3] | 226.02 | 4.6903 |
| [4] | 188.13 | 1.5137 |
| [5] | 200.58 | 2.6230 |
| [6] | 170.35 | -0.2051 |

FIG. 51

NOTE DISTANCE FROM SUCCEEDING TIME VALUE SECTION

| TIME VALUE SECTION NO. | GRID | SECTION NO. | [0] 172.38 | [1] 190.34 | [2] 215.58 | [3] 226.02 | [4] 188.13 | [5] 200.58 |
|---|---|---|---|---|---|---|---|---|
| [0] | 4 | 172.38 | ——— | | | | | |
| [1] | 4 | 190.34 | 1.7158 | ——— | | | | |
| [2] | 5 | 215.58 | 3.8715 | 2.1557 | ——— | | | |
| [3] | 6 | 226.02 | 4.6903 | 2.9744 | 0.8187 | ——— | | |
| [4] | 3 | 188.13 | 1.5136 | -0.2022 | -2.3579 | -3.1766 | ——— | |
| [5] | 6 | 200.58 | 2.6230 | 0.9072 | -1.2485 | -2.0672 | 1.1093 | ——— |
| ⋮ | ⋮ | ⋮ | ⋮ | ⋮ | ⋮ | ⋮ | ⋮ | ⋮ |

FIG. 52A

TIME

| TIME VALUE SECTION NO. | GRID | SECTION NO. | [0] 172.38 | [1] 190.34 | [2] 215.58 | [3] 226.02 | [4] 188.13 | [5] 200.58 |
|---|---|---|---|---|---|---|---|---|
| [0] | 4 | 172.38 | ——— | | | | | |
| [1] | 4 | 190.34 | 4 | ——— | | | | |
| [2] | 5 | 215.58 | 8 | 4 | ——— | | | |
| [3] | 6 | 226.02 | 13 | 9 | 5 | ——— | | |
| [4] | 3 | 188.13 | 19 | 15 | 11 | 6 | ——— | |
| [5] | 6 | 200.58 | 22 | 18 | 14 | 9 | 3 | ——— |
| ⋮ | ⋮ | ⋮ | ⋮ | ⋮ | ⋮ | ⋮ | ⋮ | ⋮ |

FIG. 52B

WEIGHT BASED ON TIME DISTANCE

| TIME VALUE SECTION NO. | GRID | SECTION NO. | [0] 172.38 | [1] 190.34 | [2] 215.58 | [3] 226.02 | [4] 188.13 | [5] 200.58 |
|---|---|---|---|---|---|---|---|---|
| [0] | 4 | 172.38 | ——— | | | | | |
| [1] | 4 | 190.34 | 100.0 | ——— | | | | |
| [2] | 5 | 215.58 | 33.3 | 66.7 | ——— | | | |
| [3] | 6 | 226.02 | 19.8 | 28.6 | 51.5 | ——— | | |
| [4] | 3 | 188.13 | 14.0 | 17.7 | 24.1 | 44.2 | ——— | |
| [5] | 6 | 200.58 | 7.4 | 9.0 | 11.6 | 18.0 | 54.0 | ——— |
| ⋮ | ⋮ | ⋮ | ⋮ | ⋮ | ⋮ | ⋮ | ⋮ | ⋮ |

FIG. 52C

SOUND SIGNAL ANALYZING DEVICE

BACKGROUND OF THE INVENTION

The present invention relates generally to a sound signal analyzing device and method which, on the basis of a sound signal, such as a voice signal or tone signal inputted via a microphone or the like, having undetermined pitch or note, analyzes sections appearing to have musical sounds and steady sections of the musical sounds so as to automatically analyze the notes (note names in a scale) and note lengths. The present invention also relates to a recording medium storing a program for implementing such operations.

Analyzed results by the present invention can be output as electronic musical staff information such as in the form of MIDI information, and therefore the present invention concerns a technique which permits automatic conversion, into a musical staff, of an audible melody input by human voices or the like.

In recent years, computer music performance systems, which use a computer to generate performance information such as MIDI information and reproduce performance sounds on the basis of the generated performance information, have been attracting people's attention as new musical sound performance devices. For input of various data to create the performance information, these computer music performance systems employ any of the real-time input method, step input method, numerical value input method, staff input method, etc.

In the real-time input method, information representative of player's actual operation on a keyboard or other performance operator, which is recorded on a tape recorder or the like, is converted into predetermined performance information on a real time basis. In the numerical value input method, performance information, such as pitches, lengths and strengths of sounds, is input in numerical value data directly from a computer keyboard. In the staff input method, simplified musical note symbols are put in a staff or stave visually presented on a display using function keys or mouse of a computer. In the step input method, musical notes are input using a MIDI keyboard or software keyboard and lengths of sounds are input using function keys or mouse of a computer.

Of the above-mentioned input methods, the real-time input method is advantageous in that it facilitates expression of human feelings and permits rapid input of performance information because the player's actual performance operation can be recorded directly as performance information. However, this method requires a high-level performance ability or experience on the part of players and hence is not suited to unexperienced players.

Thus, performance information generating devices have been proposed which allow even unexperienced players to readily input performance information while maintaining the advantages of the real-time input method. In the proposed performance information generating devices, a human voice or tone of a natural musical instrument (hereinafter collectively called "sounds") is input directly via a microphone, so as to generate performance information on the basis of the input sound. Namely, by just inputting a single human voice or tone of a natural musical instrument, such as guitar, to the performance information generating device, it can generate MIDI signals in a simple manner and control MIDI equipment without using a MIDI keyboard or the like.

These known performance information generating devices are arranged to generate MIDI information, in response to pitch variation of the sound inputted via the microphone, by use of any one of the following approaches. The first approach is to detect a pitch variation in semitones, so as to generate only note information representative of the detected tone pitch. The second approach is to detect a pitch variation in semitones to generate note information of the detected tone pitch and also generate pitch-bend information (tone pitch varying information). The third approach is to generate pitch bend information variable over one octave above and below the input sound signal without detecting a note. Also, the performance information generating devices compare each input sound level with a predetermined reference value so that it generates note-on information when the input sound level has exceeded the reference value and generates note-off information when the input sound level has lowered below the reference value.

However, where pitch variation is detected in semitones as in the above-mentioned first and second approaches, many unintended note information (note-on or note-off information) would be undesirably generated as the input sound fluctuates in pitch slightly. In addition, the third approach where pitch varying information is generated as pitch bend information is not suited for particular purposes, such as staff making, although intended pitch variation can be faithfully by the pitch bend information. Also, where note information is generated in accordance with the input sound level, many unintended note information would be undesirably generated in response to slight fluctuation in the level.

Furthermore, in the real-time input method, it is necessary efficiently analyze each section where a sound appears to be actually present, because a plurality of sounds are input to a microphone in a time-series at optional time intervals. If, in this case, analysis of pitch and the like is constantly performed on the input sounds, the analysis would be undesirably conducted wastefully even during a time when there is no input sound. Thus, the analysis efficiency could be greatly enhanced by extracting, out of the input sound signals, only sections where sounds appear to be actually present (i.e., available sections) and conducting complicated analysis operations, such as a tone pitch analysis, only for the extracted available sections. Conventionally, such an available section is extracted by merely comparing the input sound signal level with a predetermined reference level, which, however, would present the problem that the available section extraction tends to be inaccurate when the input sound level slightly fluctuates, particularly in the vicinity of the reference level.

SUMMARY OF THE INVENTION

It is therefore an object of the present invention to provide a sound signal analyzing device and method which, even when an input sound from a microphone or the like fluctuates slightly in pitch or level, can effectively analyze each steady section of the input sound, other than the fluctuating section, corresponding to a note. More particularly, the present invention provides a technique for effectively analyzing steady sections of a series of input sounds to thereby accurately analyzing respective pitches of the individual sounds.

It is another object of the present invention to provide a sound signal analyzing device and method which, even when an input sound from a microphone or the like fluctuates slightly in pitch or level, can readily analyze an available section of the sound where a musical sound appears to be actually present.

It is still another object of the present invention to provide a performance information generating device which, even when an input sound from a microphone or the like fluctuates slightly in pitch or level, can reliably generate accurate note information corresponding to the pitch of the input sound.

According to a first aspect of the present invention, there is provided a sound signal analyzing device which comprises: an input unit that inputs an optional sound signal to the sound signal analyzing device; an arithmetic operating unit that calculates an average of every predetermined number of sample amplitude values of the sound signal inputted via the input unit and outputs the respective averages as a time-series of average level information; a first section detecting unit that, on the basis of the average level information outputted from the arithmetic operating unit, detects a first section of the inputted sound signal where there appears to be a musical sound; and a second section detecting unit that, on the basis of the sample amplitude values within the first section, detects second sections of the inputted sound signal from the first section for subsequent analysis of the sound signal.

By thus calculating an average of every predetermined number of sample amplitude values of the sound signal inputted via the input unit, there can be obtained average sound pressure level information that smoothly changes sensitively in response to fluctuation in level of the inputted sound signal. Further, because degrees of inclination in the average sound pressure level information are calculated to thereby detect second sections of the inputted sound signal for subsequent analysis of the sound signal, the waveform level in possible same-waveform sections within the sound signal can be constantly stable, which would enhance the efficiency of waveform comparison and also permit reliable detection of same-waveform sections.

In a preferred implementation, the second section detecting unit detects, as a stable-level section, each of the signal sections where the degree of inclination in the average sound pressure level information is smaller than a predetermined value and is greater than a predetermined length, and it detects a second section by expanding such a stable-level section. If the degree of inclination, for a given signal section, in the average sound pressure level information is smaller than the predetermined value but the given signal section is not greater than the predetermined length, that signal section can not be the to be a stable-level section and hence is excluded from further analysis.

A sound signal analyzing device according to another aspect of the present invention comprises: an input unit that inputs an optional sound signal to the sound signal analyzing device; a waveform creating unit that detects a maximum value of every predetermined number of sample amplitude values of the sound signal inputted via the input unit and creates an auxiliary waveform by interpolating between the detected maximum values; a first section detecting unit that, on the basis of the auxiliary waveform created by the waveform creating unit, detects a first section of the inputted sound signal where there appears to be a musical sound; and a second section detecting unit that, on the basis of the sample amplitude values within the first section, detects second sections of the inputted sound signal from the first section for subsequent analysis of the sound signal.

By thus detecting a maximum value of every predetermined number of sample amplitude values of the inputted sound signal and detecting a first section on the basis of an auxiliary waveform obtained by interpolating between the maximum values, the first section detection can be made with highly increased speed.

Preferably, the stable section detecting unit detects the second section by: the second section detecting unit detects the second section by: detecting maximum values of the sample amplitude values of the inputted sound signal by performing envelope detection on the sample amplitude values in opposite directions; interpolating between the detected maximum values to obtain a maximum-value interpolation curve; evaluating total inclinations at individual sample points on the basis of the maximum-value interpolation curve; and detecting, as a stable-level section, a section over some of the sample points where the total inclinations are smaller than a predetermined value and then expanding the stable-level section. By thus performing envelope detection on the sample amplitude values in opposite (forward/rearward) directions, peaks in overtones can be prevented from being erroneously detected as pitch peaks in a waveform of progressively rising level.

A sound signal analyzing device according to another aspect of the present invention comprises: an input unit that inputs an optional sound signal to the sound signal analyzing device; a provisional-periodic-reference-point detecting unit that detects a plurality of provisional periodic reference points of the sound signal inputted via the input unit; a pitch data train generating unit that detects pitches of the inputted sound signal at the provisional periodic reference points detected by the provisional-periodic-reference-point detecting unit and generates a pitch data train indicative of the detected pitches; a filtering unit that performs, on the inputted sound signal, a filtering operation where pass band is controlled to vary over time in accordance with frequencies corresponding to the detected pitches in the pitch data train; a periodic-reference-point detecting unit that detects a plurality of periodic reference points of the sound signal outputted from the filtering unit; a same-waveform-section detecting unit that determines degrees of similarity in waveform between every adjacent signal sections of the inputted sound signal corresponding to the periodic reference points detected by the periodic-reference-point detecting unit and links together the sections having a high degree of similarity to thereby detect same-waveform sections of the inputted sound signal; and a steady section determining unit that determines a steady section of the inputted sound signal on the basis of the same-waveform sections detected by the same-waveform-section detecting unit.

In the sound signal analyzing device arranged in the above-mentioned manner, provisional periodic reference points of the inputted sound signal are detected from the inputted sound signal to detect same-waveform sections; however, if the detected provisional periodic reference points are not correct, it would be difficult to accurately detect same-waveform sections of the inputted sound signal. Thus, this invention is arranged to detect a pitch data train on the basis of the detected provisional periodic reference points and performs a filtering operation where pass band is controlled to vary over time using, as a cut-off frequency, frequencies corresponding to the detected pitches in the pitch data train, so that the inputted sound signal is allowed to approach a sine wave to enable more accurate detection of the provisional periodic reference points of the inputted sound signal. As a result, it is possible to detect same-waveform sections and steady section with highly increased accuracy.

A sound signal analyzing device according to still another aspect of the present invention comprises: an input unit that inputs an optional sound signal to the sound signal analyzing device; a filtering unit that performs, on the sound signal inputted via the input unit, a filtering operation using a predetermined frequency range; a determining unit that determines degrees of similarity in waveform between every adjacent signal sections on the basis of successive sample amplitude values of the inputted sound signal having undergone the filtering operation; a same-waveform-section detecting unit that detects, as same-waveform sections, those of the signal sections having waveforms determined by the determining unit as being similar within a range corresponding to a predetermined condition; and a pitch determining unit that determines a pitch of the sound signal within the same-waveform sections detected by the same-waveform-section detecting unit.

This sound signal analyzing device first detects a stable section of the inputted sound signal and then detects provisional periodic reference points and generates a pitch data train followed by detecting periodic reference points, so as to ultimately detect a steady section of the inputted sound signal. Because relatively stable tone pitch and the like are found in the stable section, detection of a steady section can be made with highly increased speed and accuracy.

A sound signal analyzing device according to still another aspect of the present invention comprises: an input unit that inputs an optional sound signal to the sound signal analyzing device; a provisional-periodic-reference-point detecting unit that detects a plurality of provisional periodic reference points of the sound signal inputted via the input unit; a pitch data train generating unit that detects pitches of the inputted sound signal at the provisional periodic reference points detected by the provisional-periodic-reference-point detecting unit and generates a pitch data train indicative of the detected pitches; a filtering unit that performs, on the inputted sound signal, a filtering operation where pass band is controlled to vary over time in accordance with frequencies corresponding to the detected pitches in the pitch data train; a periodic-reference-point detecting unit that detects a plurality of periodic reference points of the sound signal outputted from the filtering unit; a voiced-sound-containing section detecting unit that determines degrees of similarity in waveform between every adjacent signal sections of the inputted sound signal corresponding to the periodic reference points detected by the periodic-reference-point detecting unit and detects a voiced-sound-containing section of the inputted sound signal on the basis of the calculated degree of similarity; and a steady section determining unit that sequentially calculates degrees of similarity in waveform between a high-similarity basic signal section within the voiced-sound-containing section and other signal sections located to opposite sides of the basic signal section and determines a steady section of the inputted sound signal on the basis of the calculated degrees of similarity.

This sound signal analyzing device determines degrees of similarity in waveform between every adjacent signal sections of the inputted sound signal and determines, as a voiced-sound-containing section of the inputted sound signal, such sections having a degree of similarity greater than a predetermined value. Then, degrees of similarity in waveform are sequentially calculated between a high-similarity basic signal section within the voiced-sound-containing section and other signal sections located to opposite sides of the basic signal section so that a steady section of the inputted sound signal is determined on the basis of the calculated degrees of similarity. Because the high-similarity basic signal section is a basis of a vowel sound, variation in vowel can be detected by the degree of similarity determined by use of the high-similarity basic signal section. The thus-determined steady section can be identified as a vowel, namely, a single note.

The sound signal analyzing device according to still another aspect of the present invention comprises: an input unit that inputs an optional sound signal to the sound signal analyzing device; an available section analyzing unit that analyzes an available section of the sound signal, inputted via the input unit, for subsequent analysis of the sound signal; a provisional-periodic-reference-point detecting unit that detects a plurality of provisional periodic reference points of the sound signal forming the stable section; a pitch data train generating unit that detects pitches of the sound signal at the provisional periodic reference points detected by the provisional-periodic-reference-point detecting unit and generates a pitch data train indicative of the detected pitches; a filtering unit that performs, on the inputted sound signal, a filtering operation where pass band is controlled to vary over time in accordance with frequencies corresponding to the detected pitches in the pitch data train; a periodic-reference-point detecting unit that detects a plurality of periodic reference points of the sound signal outputted from the filtering unit; a voiced-sound-containing section detecting unit that determines degrees of similarity in waveform between every adjacent signal sections of the sound signal corresponding to the periodic reference points detected by the periodic-reference-point detecting unit and detects a voiced-sound-containing section of the sound signal on the basis of the calculated degree of similarity; and a steady section determining unit that sequentially calculates degrees of similarity in waveform between a high-similarity basic signal section within the voiced-sound-containing section and other signal sections located to opposite sides of the basic signal section and determines a steady section of the sound signal on the basis of the calculated degrees of similarity.

This sound signal analyzing device detects a stable section of the inputted sound signal and then detects a voiced-sound-containing section and a steady section within the stable section. Because relatively stable tone pitch and the like are found in the stable section, detection of a steady section can be made with highly increased speed and accuracy.

In a preferred implementation, the provisional-periodic-reference-point detecting unit includes: a first filtering unit that performs, on the sound signal inputted via the input unit, a band-pass filtering operation using predetermined cutoff frequencies as maximum and minimum frequencies; a first periodic-reference-point detecting unit that detects a plurality of provisional periodic reference points of the sound signal outputted from the first filtering unit; a frequency range detecting unit that detects the maximum and minimum frequencies of the sound signal on the basis of the provisional periodic reference points detected by the first periodic-reference-point detecting unit; a second filtering unit that performs, on the sound signal inputted via the input unit, a band-pass filtering operation using as cut-off frequencies the maximum and minimum frequencies detected by the frequency range detecting unit; and a second periodic-reference-point detecting unit that detects a plurality of periodic reference points of the sound signal outputted from the second filtering unit. Namely, such a preferred example of the provisional-periodic-reference-point detecting unit performs two band-pass filtering operations to detect the provisional periodic reference points.

Preferably, the pitch data train generating unit interpolates between pitch data of the sound signal determined at individual ones of the provisional periodic reference points, so as to detect the pitches and generate a data train of the detected pitches. Because the pitch data train is provided through the interpolation operation, the time-varying band-pass filtering can be effected with highly increased accuracy between every adjacent provisional periodic reference points.

Preferably, the provisional-periodic-reference-point detecting unit detects, as the provisional periodic reference points, peak points of the sound signal by focusing on one of plus and minus amplitude sides of a waveform of the sound signal where stronger peaks appear than on another of the plus and minus amplitude sides. With this arrangement, the provisional-periodic-reference-point detecting unit can operate properly even when the inputted sound signal presents more distinct or stronger waveform characteristics on one of the plus and minus sides than on the other.

It is preferable that the periodic-reference-point detecting unit detect, as the periodic reference points, peak points of the sound signal by focusing on one of plus and minus amplitude sides of a waveform of the sound signal where stronger peaks appear than on another of the plus and minus amplitude sides. With this arrangement, the periodic-reference-point detecting unit can operate properly even when the inputted sound signal presents more distinct or stronger waveform characteristics on one of the plus and minus sides than on the other.

It is also preferable that the periodic-reference-point detecting unit divide a waveform of the sound signal into signal sections at predetermined intervals corresponding to the cut-off frequency used in the band-pass filtering operation, by focusing on one of plus and minus amplitude sides of a waveform of the sound signal, having undergone the band-pass filtering operation, where stronger peaks appear than on another of the plus and minus amplitude sides, and wherein the periodic-reference-point detecting unit detects a greatest peak within each of the signal sections as the periodic reference point. By thus dividing the sound signal waveform into signal sections at predetermined intervals corresponding to the cut-off frequency and detecting peak points within each of the divided sections, such peaks occurring at shorter intervals than a predetermined interval can be effectively prevented from being erroneously detected, which permits detection of peak points with highly increased accuracy.

A sound signal analyzing device according to still another aspect of the present invention comprises: an input unit that inputs an optional sound signal to the sound signal analyzing device; a filtering unit that performs, on the sound signal inputted via the input unit, a filtering operation for a predetermined bass band; a peak point detecting unit that detects peak points in the sound signal having undergone the filtering operation by the filtering unit; a same-waveform-section detecting unit that, of signal sections obtained by dividing a waveform of the sound signal at optional pairs of the peak points detected by the peak point detecting unit, selects as many pairs of adjacent signal sections as possible that meet a limit defined by the pass band of the filtering unit, the same-waveform-section detecting unit determining a degree of similarity in waveform between two signal sections of each of the selected pairs and detecting one of the selected pairs having a highest similarity as same-waveform sections; and a steady section determining unit that determines a steady section of the sound signal on the basis of the same-waveform sections detected by the same-waveform-section detecting unit.

This sound signal analyzing device first detects a pair of same-waveform sections on the basis of peak points and then detects subsequent same-waveform sections on the basis of the length of the first detected same-waveform sections, rather than determining, for every pair of the signal sections, whether or not they are similar in waveform in consideration of the pitch length. This arrangement greatly increases the speed of the same-waveform section detection.

A sound signal analyzing device according to still another aspect of the present invention comprises: an input unit that inputs an optional sound signal to the sound signal analyzing device; an input unit that inputs an optional sound signal to the sound signal analyzing device; a peak point detecting unit that detects peak points in the sound signal inputted via the input unit; a first same-waveform-section detecting unit that, of signal sections obtained by dividing a waveform of the sound signal at optional pairs of the peak points detected by the peak point detecting unit, determines degrees of similarity in waveform between every two the signal sections and links together the signal sections having a high similarity so as to detect a first same-waveform section group; a second same-waveform-section detecting unit that, using first and last signal sections in the first same-waveform section group as a basis of comparison, calculates degrees of similarity in waveform between the first same-waveform section group and other signal sections adjoining the first and last signal sections and expands the first same-waveform section group to incorporate one or more of the other signal sections depending on the calculated degrees of similarity, the second same-waveform-section detecting unit detecting the expanded first same-waveform section group as a second same-waveform section group; and a steady section determining unit that determines a steady section of the sound signal on the basis of the second same-waveform section group detected by the second same-waveform-section detecting unit.

In this sound signal analyzing device, a first same-waveform section group detected by the first same-waveform-section detecting unit is expanded by the second same-waveform-section detecting unit. If a criterion used to detect same-waveform sections is very low, detected same-waveform sections tend to be so wide that detection of a steady section becomes difficult; if, on the other hand, the criterion is very high, same-waveform sections tend to be detected only sparsely. Thus, in the present invention, a relatively high criterion to detect same-waveform sections is used in the first same-waveform-section detecting unit, and once a first same-waveform-section detecting unit is detected, it is expanded by the second same-waveform-section detecting unit. This arrangement permits detection of same-waveform sections with highly increased efficiency.

Preferably, if there is any gap signal section that does not belong to either of adjacent second same-waveform sections, degrees of similarity in waveform are evaluated between the last signal section of a preceding one of the adjacent second same-waveform sections and the gap signal section and between the leading signal section of a succeeding one of the adjacent second same-waveform sections and the gap signal section, and the gap signal section is incorporated into one of the adjacent second same-waveform sections to which the gap signal section has a higher degrees of similarity in waveform.

When there is detected a gap signal section that does not belong to either of adjacent second same-waveform sections expanded by the second same-waveform-section detecting unit, this device incorporates it into one of the adjacent same-waveform sections in any one of various ways. For example, the incorporation of the gap signal section may be effected by sequentially comparing degrees of similarity, using, as comparison bases, the last signal section of a preceding one of the adjacent second same-waveform sections and the leading signal section of a succeeding one of the adjacent second same-waveform sections and the gap signal section. Alternatively, a similar operation may be conducted using the incorporated signal section as a last or first section. As another alternative, the gap signal section is not incorporated into either of the adjacent second same-waveform sections if the detected degree of similarity is lower than a predetermined criterion.

A sound signal analyzing device according to still another aspect of the present invention comprises: an input unit that inputs an optional sound signal to the sound signal analyzing device; a provisional-periodic-reference-point detecting unit that detects a plurality of provisional periodic reference points of the sound signal inputted via the input unit; a pitch data train generating unit that detects pitches of the sound signal at the provisional periodic reference points detected by the provisional-periodic-reference-point detecting unit and generates a pitch data train indicative of the detected pitches; a first filtering unit that performs, on the inputted sound signal, a band-pass filtering operation where pass band is controlled to vary over time in accordance with frequencies corresponding to the detected pitches in the pitch data train; a periodic-reference-point detecting unit that detects a plurality of periodic reference points of the sound signal outputted from the first filtering unit; a second filtering unit that performs, on the inputted sound signal, a plurality of filtering operations where pass band is controlled to vary over time in accordance with frequencies corresponding to the detected pitches in the pitch data train and integer multiples of the frequencies, the second filtering unit outputting a sound signal waveform synthesized from various waveforms resultant from the filtering operations; a same-waveform-section detecting unit that determines degrees of similarity in waveform between every adjacent signal sections obtained by dividing the sound signal waveform outputted from the second filtering unit and links together the signal sections having a high similarity so as to detect same-waveform sections of the sound signal; and a steady section determining unit that determines a steady section of the sound signal on the basis of the same-waveform sections detected by the same-waveform-section detecting unit.

This sound signal analyzing device is characterized by performing, on the inputted sound signal, filtering operations where pass band is controlled to vary over time in accordance with frequencies corresponding to the detected pitches in the pitch data train and; integer multiples of the frequencies and detecting same-waveform sections from a sound signal waveform synthesized from various waveforms resultant from the band-pass filtering operations. With this arrangement, the same-waveform-section detection can be made on a sound signal waveform with components of unnecessary frequency ranges removed, and hence the steady section determination can be made with highly increased accuracy.

A sound signal analyzing device according to still another aspect of the present invention comprises: an input unit that inputs an optional sound signal to the sound signal analyzing device; a provisional-periodic-reference-point detecting unit that detects a plurality of provisional periodic reference points of the sound signal inputted via the input unit; a pitch data train generating unit that detects pitches of the sound signal at the provisional periodic reference points detected by the provisional-periodic-reference-point detecting unit and generates a pitch data train indicative of the detected pitches; a first filtering unit that performs, on the inputted sound signal, a filtering operation where pass band is controlled to vary over time in accordance with frequencies corresponding to the detected pitches in the pitch data train; a periodic-reference-point detecting unit that detects a plurality of periodic reference points of the sound signal outputted from the first filtering unit; a second filtering unit that performs, on the inputted sound signal, a filtering operation which is controlled to vary over time in accordance with the detected pitches in the pitch data train in such a manner that a pass band of the filtering operation ranges from fundamental frequencies, corresponding to the detected pitches in the pitch data train, to integer multiples of the fundamental frequencies; a same-waveform-section detecting unit that determines degrees of similarity in waveform between every adjacent signal sections obtained by dividing the sound signal waveform outputted from the second filtering unit and links together the signal sections having a high similarity so as to detect same-waveform sections of the sound signal; and a steady section determining unit that determines a steady section of the sound signal on the basis of the same-waveform sections detected by the same-waveform-section detecting unit.

This sound signal analyzing device is characterized by band-pass filtering operation which is controlled to vary over time in accordance with the detected pitches in the pitch data train in such a manner that a pass band of the filtering operation ranges from fundamental frequencies, corresponding to the detected pitches in the pitch data train, to integer multiples of the fundamental frequencies, and then detecting same-waveform sections from the filtered sound signal waveform. With this arrangement, the same-waveform-section detection can be made on a sound signal waveform with components of unnecessary frequency ranges (outside the pass band) removed, and hence the steady section determination can be made with highly increased accuracy.

A sound signal analyzing device according to still another aspect of the present invention comprises: an input unit that inputs an optional sound signal to the sound signal analyzing device; a periodic-reference-point detecting unit that detects a plurality of periodic reference points of the sound signal inputted via the input unit; a pitch data train generating unit that detects pitches of the sound signal at the periodic reference points detected by the periodic-reference-point detecting unit and generates a pitch data train indicative of the detected pitches; a converting unit that converts differences between every adjacent ones of the detected pitches in the pitch data train into respective relative values based on musical interval representation in cents; a dynamic border calculating unit that calculates a dynamic border on the basis of a dynamic average of the relative values obtained by the converting unit; and a steady section determining unit that detects a stable-pitch steady section by comparing the relative values and the dynamic border calculated by the dynamic border calculating unit.

This sound signal analyzing device is characterized by converting pitches, detected at the individual periodic reference points of the sound signal, into respective relative values based on musical interval representation in cents, calculating a dynamic border on the basis of a dynamic average of the relative values, and then comparing the relative values and the dynamic border so as to determine a steady section of the sound signal. The dynamic average means an average of the relative values at the individual periodic reference points from a predetermined averaging start point to a current point; in other words, the dynamic average is an integral average of relative pitch values up to the current point. This dynamic average is used as a dynamic border, which is a dynamic (i.e., time-varying) boundary values. By creating the dynamic border using the dynamic average of the relative values based on musical interval representation in cents, it is possible to obtain normalized comparison basis data (i.e., dynamic border) for used in detection of a stable-pitch section, and the detecting accuracy can be enhanced. If a musical interval, i.e., relative value, between two adjacent pitches is "0", then the pitches are the same, from which it can be seen that tones of same pitch are sounded in succession. If a musical interval, i.e., relative value, between two adjacent pitches is "1" in the case where the relative value "1" is assumed to represent a semitone interval, the two pitches differ by a semitone, from which it can be seen that completely different tones of same are in succession. However, in effect, there may occur pitch variation over time even when a same tone is sounded continuously. To deal with such a situation, the dynamic border is used as a determination criterion for detecting a stable-pitch section of such time-varying tones. Thus, once a given signal section suddenly changes from a stable musical interval condition to an instable musical interval condition, it can be determined that the given signal section represents an end of a steady section of the sound signal. On the other hand, when a slight variation in musical interval occurs at a particular area in a stable-musical-interval section, it can be determined that the particular area is not an end of a steady section. As a result, the steady section detection can be made in much the same way as in human ears.

A sound signal analyzing device according to still another aspect of the present invention comprises: an input unit that inputs an optional sound signal to the sound signal analyzing device; a periodic-reference-point detecting unit that detects a plurality of periodic reference points of the sound signal inputted via the input unit; a pitch data train generating unit that detects pitches of the sound signal at the provisional periodic reference points detected by the periodic-reference-point detecting unit and generates a pitch data train indicative of the detected pitches; a converting unit that converts differences between every adjacent ones of the detected pitches in the pitch data train into respective relative values based on musical interval representation in cents; a dynamic border calculating unit that calculates a dynamic border on the basis of a dynamic average of the relative values obtained by the converting unit; a steady section determining unit that detects a stable-pitch steady section by comparing the relative values and the dynamic border calculated by the dynamic border calculating unit; a static border calculating unit that calculates a static border on the basis of a static average of the relative values within the steady section detected by the steady section determining unit; a pitch-determining-section detecting unit that compares the static border and the relative values within the steady section so as to detect a pitch determining section for calculating a representative frequency of the steady section; and a frequency calculating unit that calculates the representative frequency of the steady section on the basis of a pitch data train within the pitch determining section detected by the pitch-determining-section detecting unit.

The static average is a simple arithmetic mean of all the relative values within a steady section and therefore always the same for that steady section. This static average is used as a static border, which is a static boundary value (i.e., comparison basis value) that does not vary over time for the same steady section. If the relative value is smaller than the static border, the pitch-determining-section detecting unit judges that the pitch corresponding to the relative value belongs to a most stable section and determines the most stable section as a pitch determining section. Namely, this sound signal analyzing device is characterized by calculating a representative frequency of the steady section on the basis of pitch data within the most stable section, i.e., pitch determining section according to the static border, rather than performing the calculation for all waveform in the steady section. With this arrangement, a representative frequency of the steady section can be calculated with highly increased accuracy.

The dynamic border calculating unit may calculate the dynamic border using any one of a value obtained by multiplying the dynamic average of the relative values by a predetermined value, a value obtained by adding the predetermined value to the dynamic average of the relative values and a value obtained by adding the predetermined value to the value obtained by multiplying the dynamic average of the relative values by the predetermined value. This permits calculation of a very effective dynamic border.

Once a stable or steady section is detected using one or more of the above-mentioned approaches, a note assigning operation is performed on the thus-detected stable or steady section. Namely, the sound signal analyzing device of the present invention may further comprise a note assigning unit that analyzes a representative frequency of the sound signal and determining notes for the sound signal.

All of the steady sections detected through any of the above-mentioned approach do not always correspond to valid notes. To determine such an "invalid" steady section, the present invention can advantageously employ grids divided at time intervals corresponding to a predetermined note length (e.g., shortest possible note length). Namely, the present invention may further comprise a unit that allots each of the steady sections to one of the grids nearest to a start point thereof, and if a plurality of the steady sections are simultaneously allotted to a particular one of the grids, the unit selects one of the steady sections having a greatest time length as valid. This arrangement determines particular time values of notes to which the detected steady sections should be assigned.

A sound signal analyzing device according to still another aspect of the present invention comprises: an input unit that inputs an optional sound signal to the sound signal analyzing device; an arithmetic operating unit that calculates an average of every predetermined number of sample amplitude values of the sound signal inputted via the input unit and outputs respective the averages as a time-series of average sound pressure level information; a section determining unit that determines each signal section of the sound signal where the average sound pressure level calculated by the arithmetic operating unit is greater than a first predetermined value as an available section where there appears to be a musical sound and determines each other signal section of the sound signal where the average sound pressure level calculated by the arithmetic operating unit is smaller than the first predetermined value as an unavailable section where there appears to be musical sound; an available section adding unit that if any particular one of the unavailable sections located between the available sections is of a time length smaller than a first predetermined length, changes the particular unavailable section into an additional available section and combines the additional available section and the available sections adjoining opposite sides of the additional available section, the available section adding unit determining a combination of the additional available section and adjoining available sections as a new available section; a first unavailable section adding unit that if any particular one of the available sections located between the unavailable sections is of a time length smaller than a second predetermined length after determination by the available section adding unit, changes the particular available section into an additional unavailable section and combines the additional unavailable section and the unavailable sections adjoining opposite sides of the additional unavailable section, the first unavailable section adding unit determining a combination of the additional unavailable section and adjoining unavailable sections as a new unavailable section; and a second unavailable section adding unit that calculates an average of the average sound pressure levels in each of the available sections after determination by the first unavailable section adding unit and that if the calculated average of any particular one of the available sections is smaller than a second predetermined value, changes the particular available section into an additional unavailable section.

By thus calculating an average of every predetermined number of sample amplitude values of the sound signal inputted via the input unit, there can be obtained average sound pressure level information that smoothly changes sensitively in response to fluctuation in level of the inputted sound signal. The thus-obtained average sound levels are classified into available and unavailable sections on the basis of the first predetermined value, and then an ultimate available section is identified on the basis of the first and second predetermined lengths. Thus, even when an inputted sound from a microphone or the like fluctuates slightly in level, the device can effectively analyze the available section where there appears to be a musical sound.

A sound signal analyzing device according to still another aspect of the present invention comprises: an input unit that inputs an optional sound signal to the sound signal analyzing device; an arithmetic operating unit that calculates an average of every predetermined number of sample amplitude values of the sound signal inputted via the input unit and outputs respective the averages as a time-series of average sound pressure level information; a section determining unit that determines each signal section of the sound signal where the average sound pressure level calculated by the arithmetic operating unit is greater than a first predetermined value as an available section, determines each signal section of the sound signal which is located between the available sections and where the average sound pressure level calculated by the arithmetic operating unit is smaller than the first predetermined value as an unavailable section, and also determines each other signal section than the available and unavailable sections as an undetermined section; an available section adding unit that if any particular one of the unavailable sections located between the available sections is of a time length smaller than a first predetermined length, changes the particular unavailable section into an additional available section and combines the additional available section and the available sections adjoining opposite sides of the additional available section, the available section adding unit determining a combination of the additional available section and adjoining available sections as a new available section; a first unavailable section adding unit that if any particular one of the available sections located between the unavailable sections is of a time length smaller than a second predetermined length after determination by the available section adding unit, changes the particular available section into an additional unavailable section and combines the additional unavailable section and the unavailable sections adjoining opposite sides of the additional unavailable section so that the first unavailable section adding unit determines a combination of the additional unavailable section and adjoining unavailable sections as a new unavailable section, and that if any particular one of the available sections adjoining the undetermined section is of a time length smaller than the second predetermined length after determination by the available section adding unit, combines the particular available section and the unavailable and undetermined sections adjoining the particular available section so that the first unavailable section adding unit determines a combination of the particular available section and the unavailable and undetermined sections adjoining the particular available section as a new undetermined section; and a second unavailable section adding unit that calculates an average of the average sound pressure levels in each of the available and undetermined sections after determination by the first unavailable section adding unit and that if the calculated average of any particular one of the available and undetermined sections is smaller than a second predetermined value, changes the particular available or undetermined section into an additional unavailable section, but, if the calculated average of any particular one of the available and undetermined sections is greater than the second predetermined value, changes the undetermined section into an additional available section.

This sound signal analyzing device is characterized by classifying the rising and falling regions of obtained average sound levels as undetermined sections when classifying the sound levels into available and unavailable sections on the basis of the first predetermined value. This arrangement can thus accurately determine whether the rising and falling regions are available sections or not.

A sound signal analyzing device according to still another aspect of the present invention comprises: an input unit that inputs an optional sound signal to the sound signal analyzing device; a periodic-reference-point detecting unit that detects a plurality of periodic reference points of the sound signal inputted via the input unit; a same-waveform-section detecting unit that determines degrees of similarity in waveform between every adjacent signal sections of the sound signal corresponding to the periodic reference points detected by the periodic-reference-point detecting unit and links together the signal sections having a high similarity so as to detect same-waveform sections of the sound signal; and a steady section determining unit that determines a steady section of the sound signal on the basis of the same-waveform sections detected by the same-waveform-section detecting unit.

A sound signal analyzing device according to still another aspect of the present invention comprises: an input unit that inputs an optional sound signal to the sound signal analyzing device; a first periodic-reference-point detecting unit that detects a plurality of provisional periodic reference points of the sound signal inputted via the input unit; a frequency range detecting unit that detects maximum and minimum frequencies of the sound signal on the basis of the provisional periodic reference points detected by the first periodic-reference-point detecting unit; a filtering unit that performs, on the sound signal, a band-pass filtering operation using as cut-off frequencies the maximum and minimum frequencies detected by the frequency range detecting unit; a second periodic-reference-point detecting unit that detects a plurality of periodic reference points of the sound signal outputted from the filtering unit; a same-waveform-section detecting unit that determines degrees of similarity in waveform between every adjacent one of signal sections of the sound signal corresponding to the periodic reference points detected by the second periodic-reference-point detecting unit and links together the signal sections having a high similarity so as to detect same-waveform sections of the sound signal; and a steady section determining unit that determines a steady section of the sound signal on the basis of the same-waveform sections detected by the same-waveform-section detecting unit.

This sound signal analyzing device is characterized by detecting a plurality of provisional periodic reference points of the sound signal, detecting maximum and minimum frequencies of the sound signal on the basis of the provisional periodic reference points, and then performing a band-pass filtering operation using as cut-off frequencies the maximum and minimum frequencies. The band-pass filtering operation can effectively remove unnecessary low-frequency components and harmonics that would lead to errors in detecting same-waveform sections, so that the steady section analysis can be made with highly increased accuracy.

A sound signal analyzing device according to still another aspect of the present invention comprises: an input unit that inputs an optional sound signal to the sound signal analyzing device; an available section analyzing unit that analyzes an available section of the sound signal, inputted via the input unit, where there appears to be a musical sound; a periodic-reference-point detecting unit that detects a plurality of periodic reference points on plus and minus amplitude sides of the sound signal forming the available section; a same-waveform-section detecting unit that for each of the plus and minus amplitude sides of the sound signal, determines degrees of similarity in waveform between every adjacent signal sections of the sound signal corresponding to the periodic reference points detected by the periodic-reference-point detecting unit and links together the signal sections having a high similarity so as to detect same-waveform sections of the sound signal; a tone-color-section determining unit that determines, as same-tone-color sections, signal sections obtained by superposing the plus and minus amplitude sides of the same-waveform sections detected by the same-waveform-section detecting unit; and a steady section determining unit that determines a steady section of the sound signal on the basis of the same-tone-color sections determined by the tone-color-section determining unit.

By thus detecting a plurality of periodic reference points on plus and minus amplitude sides of the sound signal, detecting same-waveform sections on the basis of the detected periodic reference points and then superposing the plus and minus amplitude sides of the same-waveform sections to determine same-waveform sections, detection errors can be minimized even when the sound signal fluctuates slightly in pitch and level on the plus and minus amplitude sides. On the basis of sudden changes in pitch and sound pressure in the thus-determined same-tone-color sections, each steady section is analyzed which corresponds to a single note. Thus, even when an inputted sound from a microphone or the like fluctuates slightly in pitch or level, it is possible to effectively analyze each steady section of a musical sound other than the fluctuating section, i.e., section corresponding to a single note.

A sound signal analyzing device according to still another aspect of the present invention comprises: an input unit that inputs an optional sound signal to the sound signal analyzing device; an available section analyzing unit that analyzes an available section of the sound signal, inputted via the input unit, where there appears to be a musical sound; a first periodic-reference-point detecting unit that detects a plurality of provisional periodic reference points of the sound signal forming the available section; a frequency range detecting unit that detects maximum and minimum frequencies of the sound signal on the basis of the provisional periodic reference points detected by the first periodic-reference-point detecting unit; a filtering unit that performs, on the sound signal, a band-pass filtering operation using as cut-off frequencies the maximum and minimum frequencies detected by the frequency range detecting unit; a second periodic-reference-point detecting unit that detects a plurality of periodic reference points of the sound signal outputted from the filtering unit; a same-waveform-section detecting unit that, for each of plus and minus amplitude sides of the sound signal, determines degrees of similarity in waveform between every adjacent one of signal sections of the sound signal corresponding to the periodic reference points detected by the second periodic-reference-point detecting unit and links together the signal sections having a high similarity so as to detect same-waveform sections of the sound signal; and a steady section determining unit that determines a steady section of the sound signal on the basis of the same-waveform sections detected by the same-waveform-section detecting unit.

This sound signal analyzing device is characterized by detecting a plurality of provisional periodic reference points of the sound signal, detecting maximum and minimum frequencies of the sound signal on the basis of the provisional periodic reference points, and then performing a band-pass filtering operation using as cut-off frequencies the maximum and minimum frequencies. The band-pass filtering operation can effectively remove unnecessary low-frequency components and harmonics that would lead to errors in detecting same-waveform sections, so that the steady section analysis can be made with highly increased accuracy.

According to yet another aspect of the present invention, there is provided a performance information generating device which comprises: an input unit that inputs an optional sound signal to the performance information generating device; a steady section analyzing unit that analyzes a steady section, of the sound signal inputted via the input unit, corresponding to a single note; a frequency range determining unit that determines a representative frequency of each of the steady sections analyzed by the steady section analyzing unit; a converting unit that converts differences in the representative frequency between every adjacent ones of the steady sections into relative values based on musical interval representation in cents; a musical interval data creating unit that creates musical interval data indicative of a musical interval between the adjacent steady sections on the basis of the corresponding relative value; and a note assigning unit that assigns respective notes of a predetermined scale to the steady sections on the basis of the corresponding musical interval data.

This performance information generating device is characterized by determining a representative frequency of each of the analyzed steady sections, creating musical interval data indicative of a musical interval between adjacent steady sections on the basis of a difference in the representative frequency between the adjacent steady sections based on musical interval representation in cents, and then assigning respective notes of a predetermined scale to the steady sections on the basis of the musical interval data. The representative frequency of each of the steady sections is an average of a plurality of waveforms forming that steady section, and the musical interval data is created on the basis of a relative value representing a difference in the representative frequency between two adjacent steady sections. Thus, even when an inputted sound from a microphone or the like fluctuates slightly in pitch, resultant error components can be absorbed in ultimately assigned notes of a scale.

A performance information generating device according to another aspect of the present invention comprises: an input unit that inputs an optional sound signal to the performance information generating device; a steady section analyzing unit that analyzes a steady section, of the sound signal inputted via the input unit, corresponding to a single note; a frequency range determining unit that determines a representative frequency of each of the steady sections analyzed by the steady section analyzing unit; a phrase detecting unit that combines a plurality of the steady sections analyzed by the steady section analyzing unit to detect a single phrase; a converting unit that converts a difference in the representative frequency between each of the steady sections within the phrase detected by the phrase detecting unit and every other steady section preceding the steady sections within the phrase, into a relative value based on musical interval representation in cents; a weighing unit that, for each of the steady sections within the phrase detected by the phrase detecting unit, calculates a weight based on a time distance relative to every other steady section preceding the steady section; a musical interval data calculating unit that, for each of the steady sections, calculates musical interval data indicative of a musical interval from another steady section on the basis of the corresponding relative value obtained by the converting unit and the corresponding weight calculated by the weighing unit; and a note assigning unit that assigns respective notes of a predetermined scale to the steady sections on the basis of the corresponding musical interval data.

This performance information generating device is characterized by, for a phrase formed by a plurality of steady sections, determining a representative frequency and relative value based on musical interval representation in cents, weighting each of the steady section on the basis of a time distance relative to every other steady section preceding that steady section to calculate musical interval data, and then assigning respective notes of a predetermined scale to the steady sections on the basis of the corresponding musical interval data. Thus, even when an inputted sound from a microphone or the like fluctuates slightly in pitch, it is possible to carry out proper note assignment corresponding to respective tones of steady sections forming a phrase.

A performance information generating device according to still another aspect of the present invention comprises: an input unit that inputs an optional sound signal to the performance information generating device; a steady section analyzing unit that analyzes a steady section, of the sound signal inputted via the input unit, corresponding to a single note; a frequency range determining unit that determines a representative frequency of each of the steady sections analyzed by the steady section analyzing unit; a phrase detecting unit that combines a plurality of the steady sections analyzed by the steady section analyzing unit to detect a single phrase; a converting unit that converts a difference in the representative frequency between a leading one of the steady sections within the phrase detected by the phrase detecting unit and every other steady section succeeding the leading steady section, into a relative value based on musical interval representation in cents; a musical interval data calculating unit that, for each of the steady sections, calculates musical interval data indicative of a musical interval from the leading steady section on the basis of the corresponding relative value obtained by the converting unit; and a note assigning unit that assigns respective notes of a predetermined scale to the steady sections on the basis of the corresponding musical interval data.

For a phrase formed by a plurality of steady sections, this device determines a representative frequency of each of the steady section, calculates musical interval data indicative of a musical interval between the leading steady section and every other steady section, and assigns respective notes of a predetermined scale to the steady sections on the basis of the musical interval data. Thus, even when an inputted sound from a microphone or the like fluctuates slightly in pitch, it is possible to carry out proper note assignment corresponding to the leading tone of the phrase.

The note assigning unit may analyze a representative frequency of the sound signal for each of the steady sections analyzed by the steady section analyzing unit and then assign respective notes of a predetermined scale to the steady sections on the basis of analyzed results. At that time, the note assigning unit may first assigns a predetermined note of the predetermined scale to a leading one of the steady sections and then sequentially assign a note of the predetermined scale to every other steady section.

Further, in a preferred implementation, the note assigning unit analyzes a representative frequency of the sound signal for each of the steady sections analyzed by the steady section analyzing unit and then assigns respective notes of a predetermined scale to the steady sections on the basis of analyzed results. At that time, the note assigning unit may first analyzes a leading one of the steady sections to detect an average frequency of the leading steady section, then assign a predetermined note, based on the detected average frequency, of the predetermined scale to the leading steady section and then sequentially assign a note of the predetermined scale to every other steady section.

In another preferred implementation, the note assigning unit analyzes a representative frequency of the sound signal for each of the steady sections analyzed by the steady section analyzing unit and assigns respective notes of a predetermined scale to the steady sections on the basis of analyzed results. At that time, the note assigning unit may first provisionally assign respective notes of a plurality of scales to the steady sections while deviating note positions from each other so as to calculate cumulative total note assignment differences at the individual note positions of the scales and then determines an optimum scale on the basis of the calculated cumulative total note assignment differences so as to sequentially assign respective notes of the determined optimum scale to the steady sections.

In still another preferred implementation, the note assigning unit analyzes a representative frequency of the sound signal for each of the steady sections analyzed by the steady section analyzing unit and selects a predetermined scale on the basis of analyzed results so as to assigns respective notes of the predetermined scale to the steady sections. The note assigning unit may also be arranged to assign a note, other than the notes of the predetermined scale, depending on a predetermined note difference allowance.

BRIEF DESCRIPTION OF THE DRAWINGS

For better understanding of the above and other features of the present invention, the preferred embodiments of the invention will be described in greater detail below with reference to the accompanying drawings, in which:

FIGS. 19A to 19C are diagrams showing an exemplary manner in which a representative frequency is detected from each of the steady sections;

FIG. 40 is a diagram explanatory of a detailed manner in which a difference rate is calculated between the two waves of FIG. 39 during a waveform operation of step 33;

FIGS. 41A and 41B are diagrams showing a manner in which reference peak points are modified in position to detect regularly appearing peak points during the waveform comparison operation of FIG. 33;

FIGS. 44A and 44B are diagrams explanatory of an exemplary manner in which a steady section superposition operation of FIG. 33 is carried out;

FIGS. 45A and 45B are diagrams explanatory of an exemplary manner in which a subdivision operation of FIG.

Figure 33:
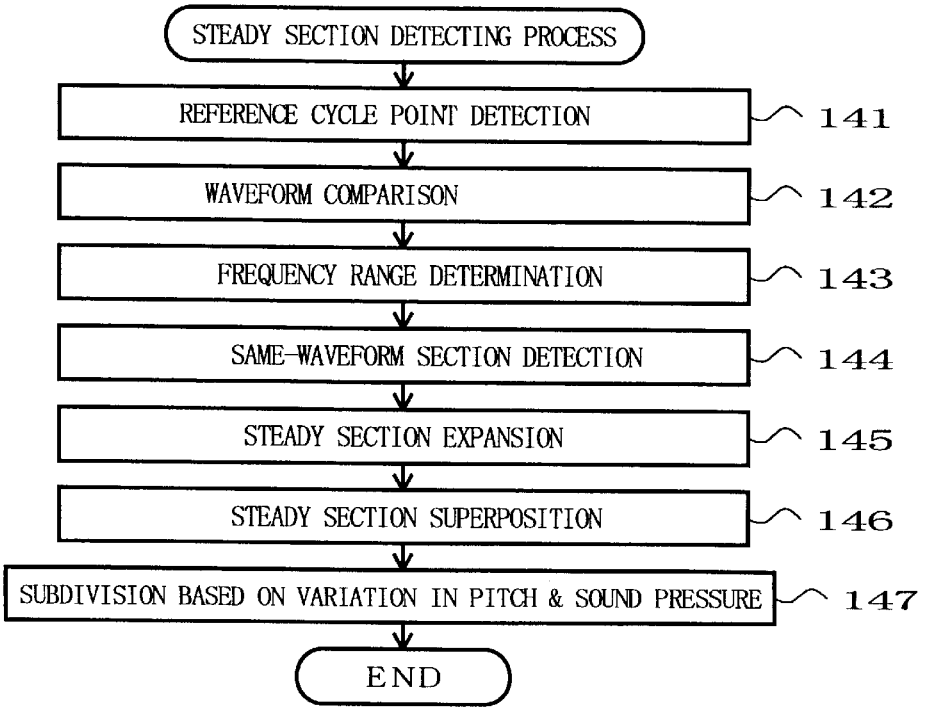
FIG. 33 is a flowchart showing a detailed example of a steady section detecting process shown in FIG. 32.
Figure 34:
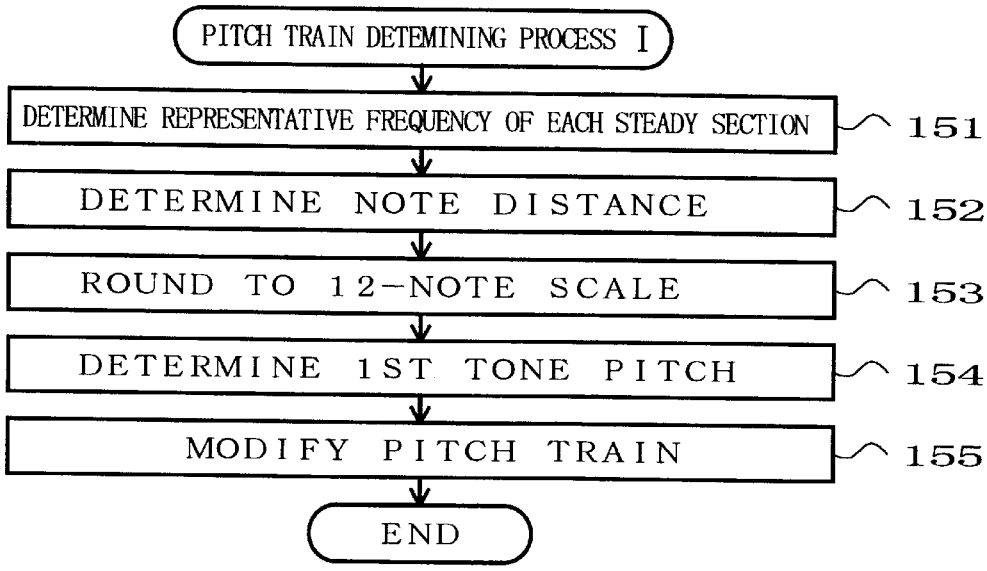
FIG. 34 is a flowchart showing a detailed example of a pitch train determining process shown in FIG. 32.
Figure 35:
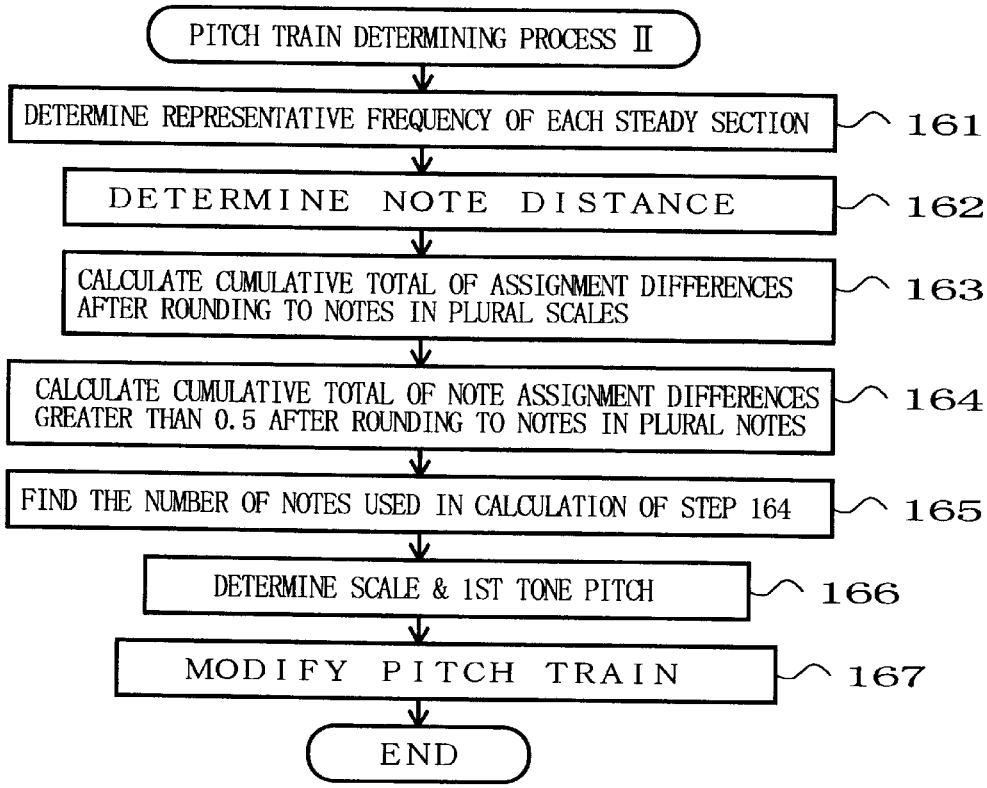
FIG. 35 is a flowchart showing another example of the pitch train determining process shown in FIG. 32.
Figure 36:
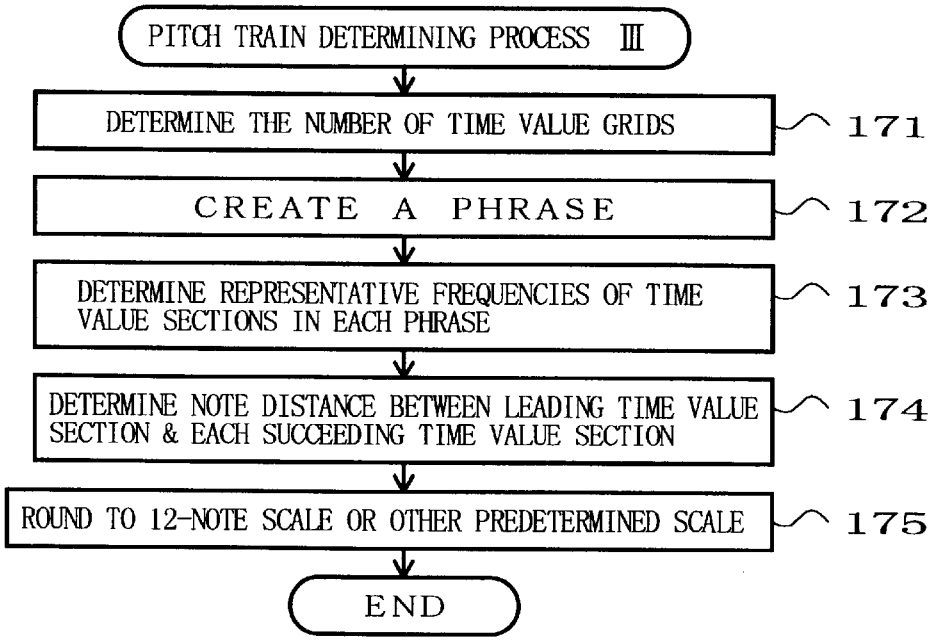
FIG. 36 is a flowchart showing still another example of the pitch train determining process shown in FIG. 32.
Figure 37:
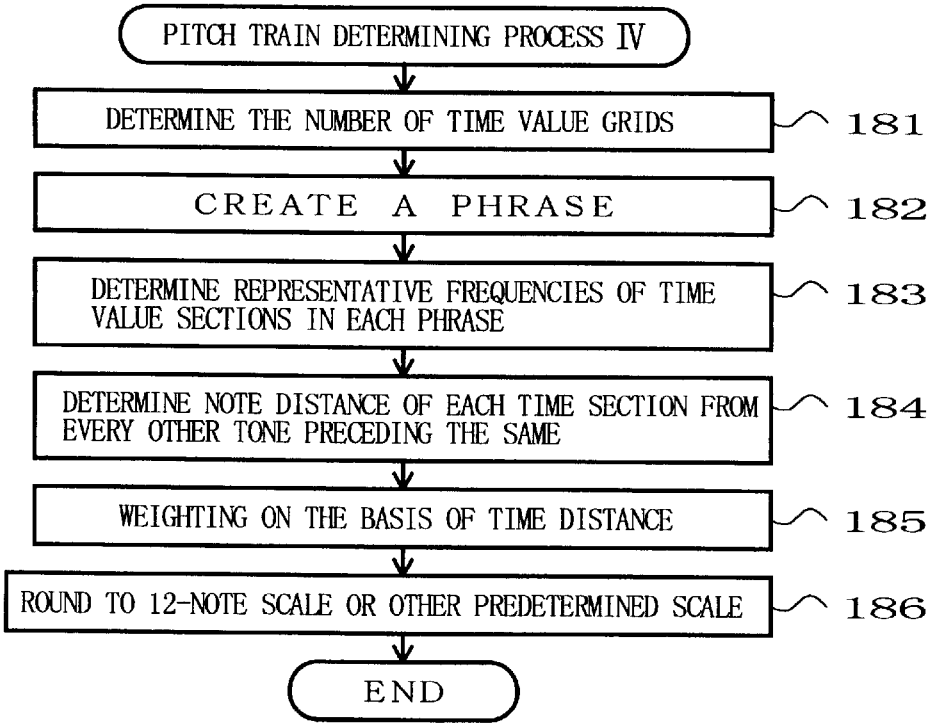
FIG. 37 is a flowchart showing still another example of the pitch train determining process shown in FIG. 32.
Figure 50:
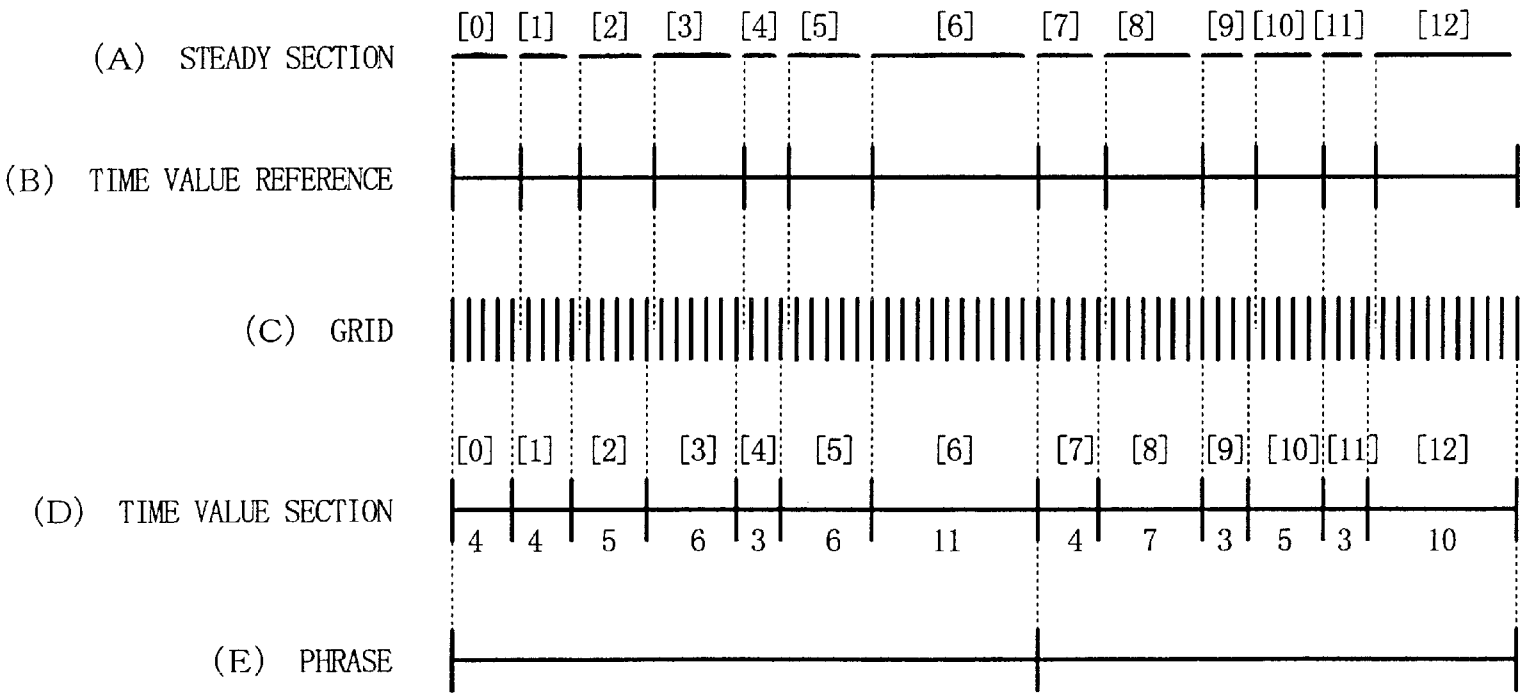

33 is carried out on the basis of variations in tone pitch and sound pressure;

FIG. 46 is a conceptual diagram explanatory of a manner in which steady sections are detected from an available section in the steady section detecting process of FIG. 33;

FIGS. 47A to 47C are conceptual diagrams explanatory of an exemplary manner in which pitch train determining process I of FIG. 34 is carried out;

FIG. 48 is a diagram showing an example of a plurality of scales used in pitch train determining process II of FIG. 35;

FIGS. 49A to 49D are conceptual diagrams explanatory of an exemplary manner in which pitch train determining process II of FIG. 35 is carried out;

FIG. 50 is a conceptual diagram explanatory of an exemplary manner in which pitch train determining process III of FIG. 36 is carried out;

FIG. 51 is a diagram showing a specific example of an operation for determining note distances from a first tone in a phrase shown in FIG. 36; and FIGS. 52A to 52C are conceptual diagrams explanatory of an exemplary manner in which pitch train determining process IV of FIG. 37 is carried out.

DETAILED DESCRIPTION OF THE PREFERRED EMBODIMENTS

Figure 2:
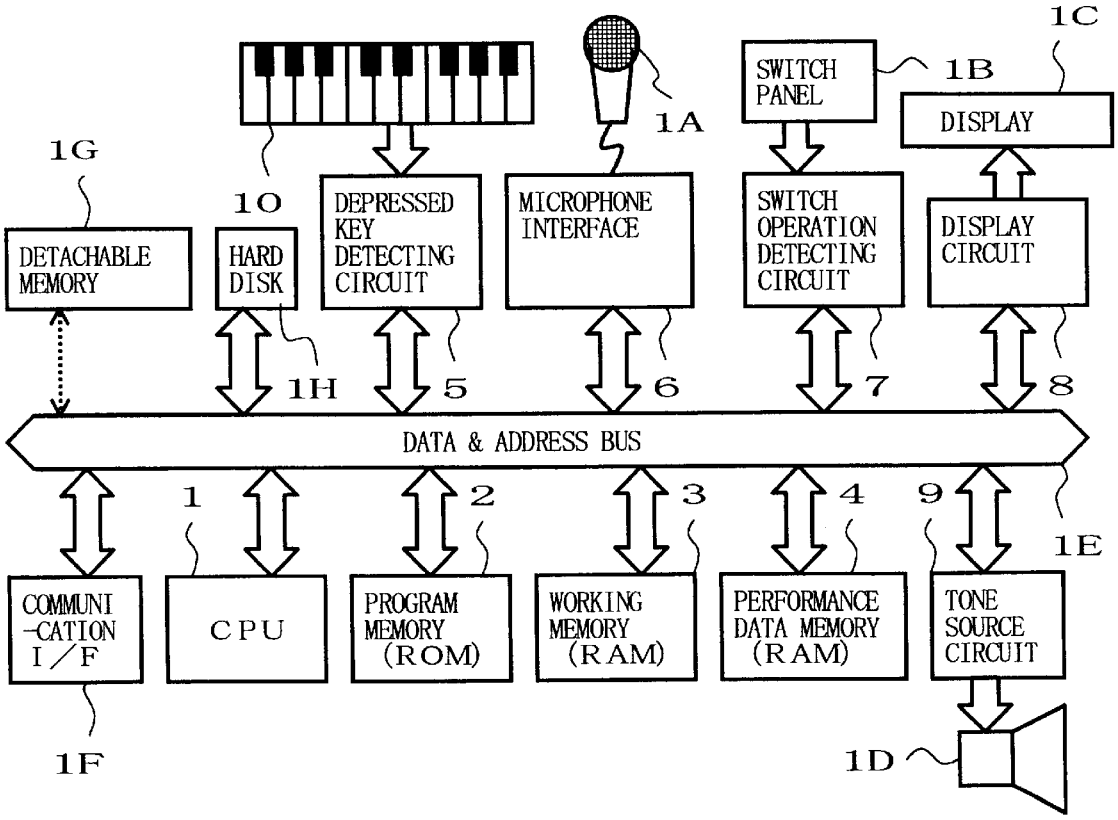
FIG. 2 is a block diagram illustrating a general hardware setup of an electronic musical instrument, according to a first embodiment of the present invention, having functions of a sound signal analyzing device and a performance information generating device.

FIG. 2 is a block diagram illustrating a general hardware setup of an electronic musical instrument having functions of a sound signal analyzing device and a performance information generating device in accordance with a first embodiment of the present invention. This electronic musical instrument is controlled by a microcomputer comprising a microprocessor unit (CPU) 1, a program memory 2 and a working memory 3.

The CPU 1 controls overall operations of the electronic musical instrument. To the CPU 1 are connected, via a data and address bus 1E, the program memory 2, working memory 3, performance data memory 4, depressed key detecting circuit 5, microphone interface 6, switch operation detecting circuit 7, display circuit 8 and tone source circuit 9.

The program memory 2, which is a read-only memory (ROM), has prestored therein various programs (including system and operating programs).and various data. The working memory 3, which is for temporarily storing data generated as the CPU 1 executes the programs, is allocated in predetermined address regions of a random access memory (RAM) and used as registers, flags, buffers, tables, etc. The performance data memory 4 is provided for storing performance information (MIDI data) generated on the basis of input tones from the microphone etc.

Further, a hard disk device 1H or the like may be connected to the CPU 1 so as to store therein various data, such as automatic performance data, chord progression data, and the operating program. By prestoring the operating program in the hard disk device 1H rather than in the program memory 2 and loading the operating program into the working memory 3, the CPU 1 can operate in exactly the same way as in the case where the operating program is stored in the program memory 2. This arrangement greatly facilitates version-up of the operating program, addition of a new operating program, etc. A CD-ROM may be used as a removably-attachable (detachable) external recording medium for recording various data and an optional operating program. Such an operating program and data stored in the CD-ROM can be read out by a CD-ROM drive (not shown) to be then transferred for storage in the hard disk device 1H. This facilitates installation and version-up of the operating program.

Further, a communication interface 1F may be connected to the data and address bus 1E so that the electronic musical instrument can be connected via the interface to various communication networks such as a LAN (Local Area Network) and the Internet to exchange data with a desired sever computer. Thus, in a situation where the operating program and various data are not contained in the hard disk device 1H, these operating program and data can be downloaded from the server computer. In such a case, the electronic musical instrument, which is a "client" tone generating device, sends a command to request the server computer to download the operating program and various data by way of the communication interface and communication network. In response to the command, the server computer delivers the requested operating program and data to the electronic musical instrument via the communication network. The electronic musical instrument receives the operating program and data via the communication interface and accumulatively store them into the hard disk device. In this way, the necessary downloading of the operating program and various data is completed.

The keyboard 10 includes a plurality of keys for selecting a pitch of a tone to be generated and a plurality of key switches provided in corresponding relations to the keys, and it may a key-depression-velocity detecting means and a key-depression-force detecting means as necessary.

When one of the keys is newly depressed on the keyboard 10, the depressed key detecting circuit 5 outputs key-on event data including a key code corresponding to the depressed key, while when one of the keys is newly released on the keyboard 10, the depressed key detecting circuit 5 outputs key-off event data including a key code corresponding to the released key. Also, the depressed key detecting circuit 5 determines a key-depressing velocity or force when one of the keys is newly depressed, so as to generate touch data and then output it as velocity data. These key-on event data, key-off event data and velocity data are expressed in data conforming to the MIDI standard (hereinafter referred to as "MIDI data") and each contain data indicative of a key code and an assigned channel.

Microphone 1A converts a sound signal or tone of a musical instrument into an analog voltage signal and outputs the converted signal to the microphone interface 6. The microphone interface, in turn, converts the analog voltage signal into a digital signal and outputs the converted signal to the CPU 1 via the data and address bus 1E.

Switch panel 1B includes various operators, such as ten-keys for entering numerical value data, a keyboard for entering character data, and a start/stop switch for activating or deactivating predetermined note processing (tone information analyzing processing and a performance information generating processing). The switch panel 1B includes various other operators, but detailed description about these other operators is omitted here because they are not part of the present invention.

The switch operation detecting circuit 7 constantly detects respective operational states of the individual operators on the switch panel 1B and output switch information, corresponding to the detected operational states, to the CPU 1 via the data and address bus 1E.

The display circuit 8 visually displays various information, such as controlling conditions of the CPU 1 and currently set data, on a display screen 1C. Specifically, this display screen 1C comprises a LCD (Liquid Crystal Device) or CRT and controlled by the display circuit 8. The switch panel 1B and display screen 1C together constitute a GUI (Graphical User Interface).

The tone source circuit 9, which is capable of simultaneously generating tone signals in a plurality of channels, receives MIDI data supplied via the data and address bus 1E and generates tone signals based on these data to be output to a sound system ID, which audibly reproduces or sounds each of the tone signals generated by the tone source circuit 9. The tone generation channels to simultaneously generate a plurality of tone signals in the tone source circuit 9 may be implemented by using a single circuit on a time-divisional basis or by providing a separate circuit for each of the channels.

Further, any tone signal generation method may be used in the tone source circuit 9 depending on an application intended. For example, any conventionally known tone signal generation method may be used such as: the memory readout method where sound waveform sample value data stored in a waveform memory are sequentially read out in accordance with address data that vary in correspondence to the pitch of a tone to be generated; the FM method where sound waveform sample value data are obtained by performing predetermined frequency modulation operations using the above-mentioned address data as phase angle parameter data; or the AM method where sound waveform sample value data are obtained by performing predetermined amplitude modulation operations using the above-mentioned address data as phase angle parameter data. Other than the above-mentioned, the tone source circuit 9 may also use the physical model method where a sound waveform is synthesized by algorithms simulating a tone generation principle of a natural musical instrument; the harmonics synthesis method where a sound waveform is synthesized by adding a plurality of harmonics to a fundamental wave; the formant synthesis method where a sound waveform is synthesized by use of a formant waveform having a specific spectral distribution; or the analog synthesizer method using VCO, VCF and VCA. Further, the tone source circuit 9 may be implemented by a combined use of a DSP and microprograms or of a CPU and software programs, rather than by use of dedicated hardware.

Next, a description will be made about exemplary behavior of the electronic musical instrument when it operates as the sound signal analyzing device and performance information generating device according to the principle of the present invention.

Figure 1:
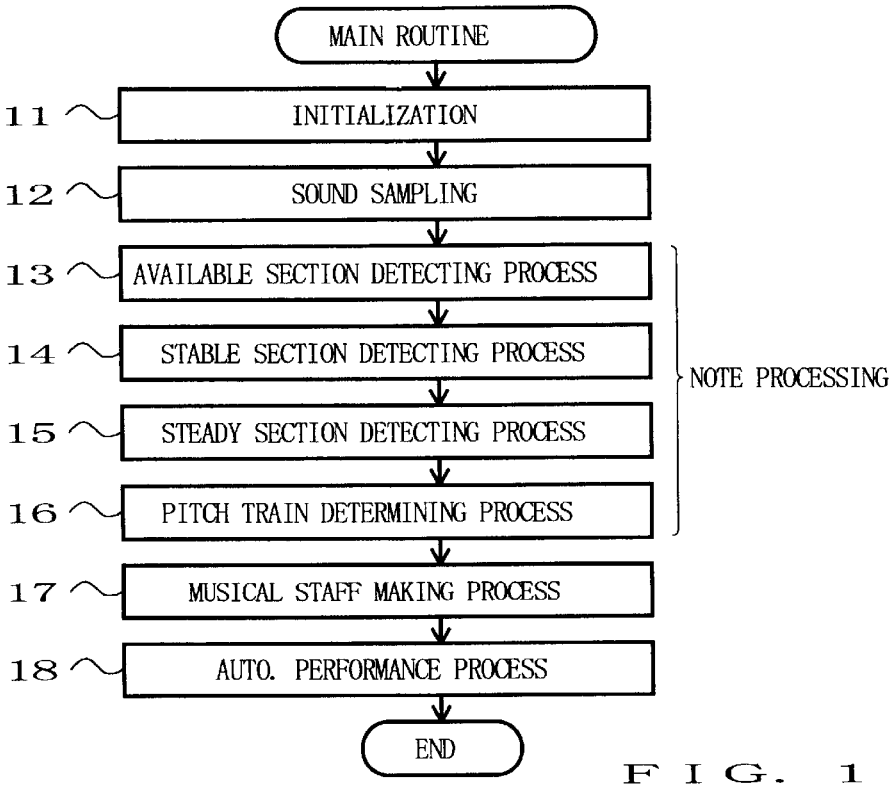
FIG. 1 is a flow chart of a main routine for sound signal analyzing processing and performance information generating processing according to the present invention.

FIG. 1 is a flowchart of a main routine when the electronic musical instrument when it operates as the performance information generating device. The main routine is carried out in the following step sequence.

Step 11: A predetermined initialization process is executed, where, for example, respective initial values are set into various registers and flags in the working memory 3 of FIG. 2. Then, a series of operations of steps 12 to 18 is executed once the note processing start switch is turned on the switch panel 1B.

Step 12: Operation of this step is executed when it is determined that the note processing start switch has been turned on the switch panel 1B. Specifically, in response to the activation of the note processing start switch, this routine samples, at a predetermined frequency (e.g., 44.1 kHz), a voltage waveform of a musical instrument tone or a sound signal picked up by the microphone 1A via the microphone interface 6 and then stores the sampled results into a predetermined storage area of the working memory 3 as digital sample signals. The sampling operation itself is conventional and hence will not be described in detail here.

Steps 13 to 16 perform the note processing in response to the activation of the note processing start switch, in which each sampled tone signal or digital sample signal from a musical instrument is analyzed variously and converted into a train of tone pitches, i.e., MIDI data that can be presented in a staff.

Step 13: An available section detecting process is executed to determine, on the basis of the digital sample signals obtained through the operation of the sound sampling operation of step 12, locations where there are available (musically significant) sections containing musical sounds that are to be processed in subsequent operations, as will be described in greater detail later.

Step 14: A stable section detecting process is executed to divide each of the available sections detected by the available section detecting process of step 13 into stable-level sections (hereinafter called "stable sections"), as will also be described in greater detail later.

Step 15: A steady section detecting process is executed to detect steady sections of the musical sound (i.e., section corresponding to a single note) contained in each of the stable section detected by the stable section detecting process of step 14, as will also be described in greater detail later.

Step 16: A pitch train determining process is executed to allocate an optimum note to each of the steady sections detected as a result of the processes of steps 13 to 16. Namely, this step generates MIDI data, as will also be described in greater detail later.

Step 17: A musical staff making process is executed to create a staff on the basis of the MIDI data generated by the pitch train determining process of step 16. This staff making process can be readily implemented using the conventionally-known technique and hence will not be described in detail here.

Step 18: An automatic performance process is executed on the basis of MIDI data generated by the pitch train determining process of step 16. This automatic performance process can also be readily implemented using the conventionally-known technique and hence will not be described in detail here.

Figure 3:
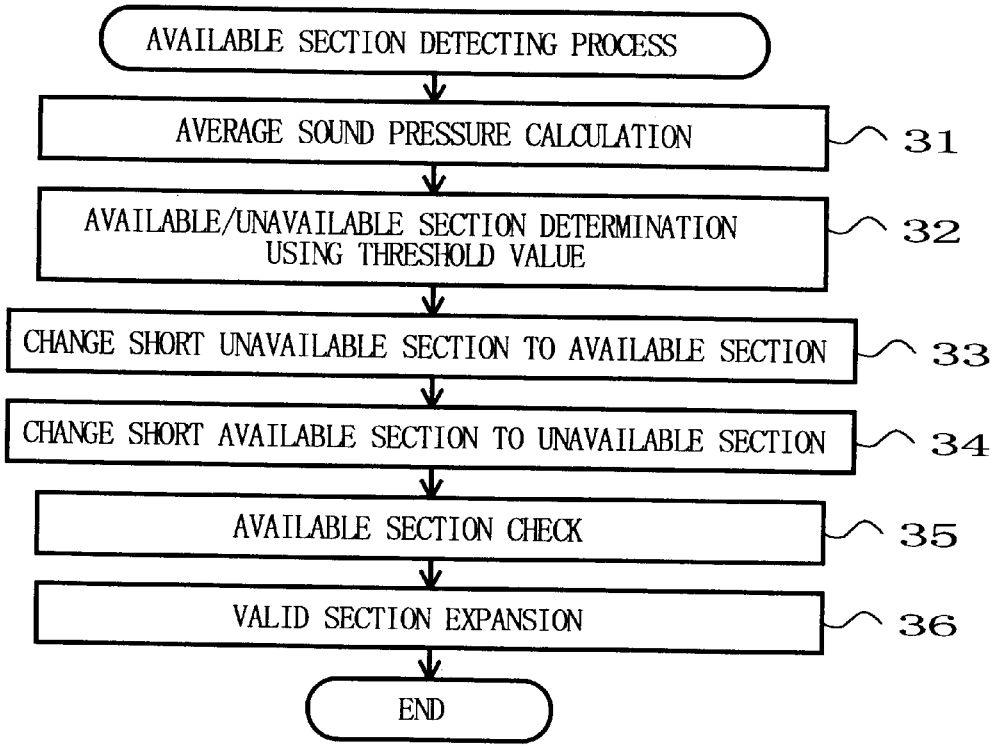
FIG. 3 is a flowchart illustrating a detailed example of an available section detecting process shown in FIG. 1.

FIG. 3 is a flowchart showing the details of the available section detecting process of step 13 shown in FIG. 1. The following paragraphs describe an exemplary manner in which this process detects an available section from the digital sample signals obtained at step 12, with reference to FIGS. 7 and 8.

Figures 6, 7:
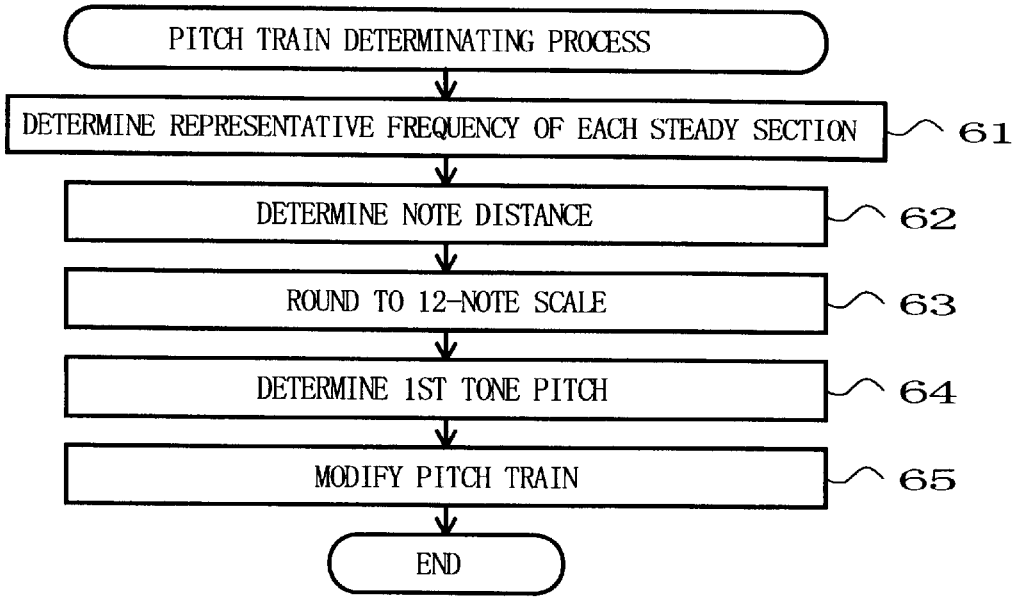
FIG. 6 is a flowchart illustrating a detailed example of a pitch train determining process in FIG. 1.
FIG. 7 is a diagram showing an example set of waveform values of sound signals sampled at a sampling frequency of 44.1 kHz, i.e., digital sample signals.

Step 31: An average sound pressure level is calculated on the basis of the digital sample signals obtained at step 12. FIG. 7 shows, by way of example, waveform values of the digital sample signals sampled at the sampling frequency of 44.1 kHz, where waveform values at 20 sample points are shown. This step calculates an average of amplitude values for every predetermined number of samples (e.g., the predetermined number of samples corresponds to a 10 msec. period) and sets the calculated average as an average sound pressure level. Thus, in the case where the sampling frequency is 44.1 kHz, the predetermined number of samples is "441", and the average sound pressure level at a given sample point is calculated by dividing, by 441, a sum of waveform values from the given sample point to a sample point that is located 10 msec. before the given sample point—i.e., back to a 441st sample point from the given sample point. Note that for each sample point within a range from a 0th sample point to a 440th sample point where there are not waveform values for 441 sample points, an average of waveform values from the 0th to that sample point is calculated and set as an average sound pressure level. In this way, a time-series of average sound pressure level information is obtained for each sample timing.

However, for convenience of explanation, FIG. 7 shows a case where an average of waveform values for 15 sample points is calculated as an average sound pressure level. Therefore, for each sample point before the first 15th sample point, a sum of waveform values up to that sample point is divided by a total number of sample points counted up to that sample point. Note that the sum of waveform values is calculated by summing up their absolute values.

Figure 8A:
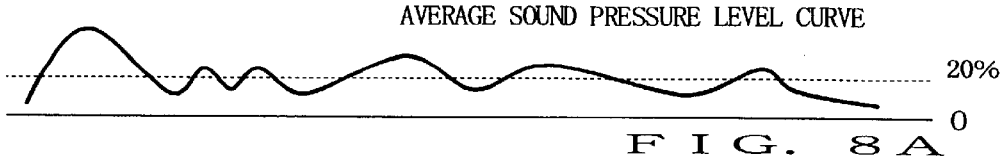
FIGS. 8A to 8G are conceptual diagrams explanatory of an exemplary manner in which the available section detecting process of FIG. 3 is carried out in the embodiment.

FIG. 8A is a graph showing a curve of the thus-calculated average sound pressure levels (hereinafter called a "average sound pressure level curve"), where the horizontal axis represents the sample points.

Where the average sound pressure level is calculated for 15 sample points as in the illustrated example FIG. 7, a low-pass filtering operation using a cut-off frequency of about 10 Hz is preferably applied to smooth the level variations. Thus, if an average of waveform values is actually calculated for 441 sample points, then it is desirable to apply low-pass filtering with a cut-off frequency of about 80 to 100 Hz in order to smooth the level variations.

Whereas the average sound pressure level at a given sample point has been described above as being calculated by totalling waveform values up to the given sample point, it may alternatively be calculated by summing up waveform values at the given sample point and a predetermined number of other sample points before and after the given sample point, or by summing up waveform values at the given sample point and a predetermined number of other sample points succeeding the same.

Step 32: The average sound pressure level curve, as shown in FIG. 8A, obtained at step 31 is divided into available and unavailable (i.e., musically insignificant) sections using a predetermined threshold value. In this operation, a value corresponding to 20% of the maximum waveform value in the average sound pressure level curve is used as the threshold value, although any other threshold value may of course be used. For instance, the mean of the average sound pressure levels, 80% of such an average value, or half of the maximum waveform value in the average sound pressure level curve may be used as the threshold value.

Figure 8B:
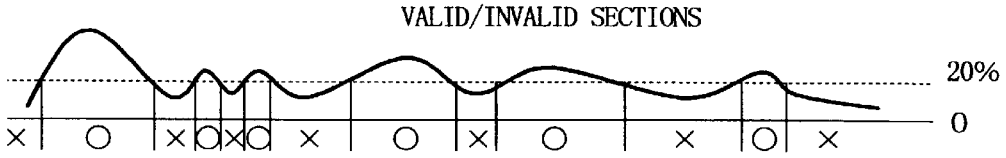

FIG. 8B shows the classification of the average sound pressure level curve into available and unavailable sections, where the threshold value is denoted in broken line. Namely, each intersection between the average sound pressure level curve and the broken line (threshold value) represents a boundary between the available and unavailable sections; that is, each signal section where the average sound pressure level is greater than the threshold value is determined as the available section, while each signal section where the average sound pressure level is smaller than the threshold value is determined as the unavailable section. In FIG. 8B, each of the available sections is denoted by mark ○, while each of the unavailable sections is denoted by mark X.

Figure 8C:
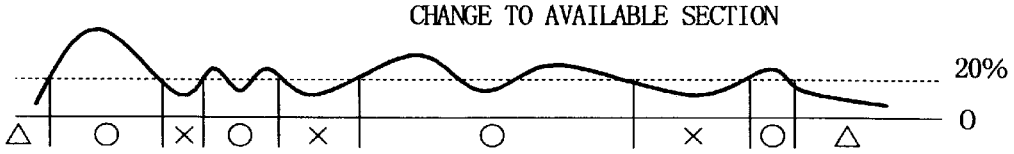

Step 33: Assuming that a minimum length with which humans can identify a tone pitch is 0.05 msec. each of the unavailable sections determined at step 32 which is shorter than the minimum length is changed to an available section. For example, where the sampling frequency is 44.1 kHz, each unavailable section containing 2,205 samples or less is changed to an available section. In the illustrated example FIG. 8B, the third and fifth sections from the left end are such short unavailable sections and hence changed at this step 33 to available sections, resulting in expansion of the available sections as shown in FIG. 8C. However, in this operation, the leading and last unavailable sections are treated as exceptional or special sections that are not changed to available sections although they fall in the category of short-enough unavailable section, and these sections are denoted in FIG. 8C by mark Δ.

Figure 8D:
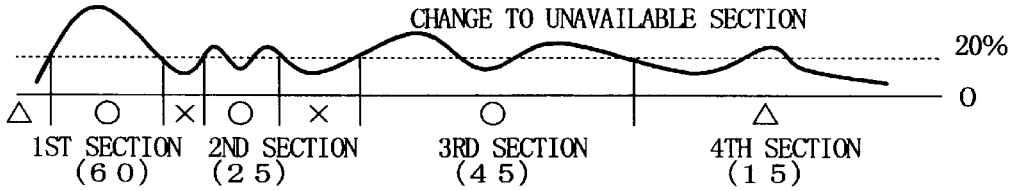

Step 34: Of the available and unavailable sections having been identified so far, each of the available sections which is shorter than 0.05 msec. is changed to an unavailable section in a manner similar to step 33. In the illustrated example FIG. 8C, the rightmost available section is such a short available section and hence changed at this step 34 to an unavailable section as shown in FIG. 8D. As clear from FIG. 8D, the section-changing operation of step 34 provides a total of four available sections, first to fourth available sections; the last section denoted by mark Δ is treated as the fourth available section.

Figure 8E:
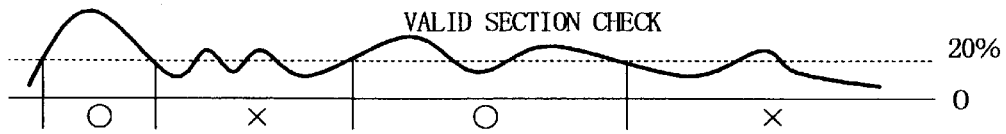

Step 35: A final check is performed on the available sections. Specifically, the mean of the average sound pressure levels is calculated for each of the available sections determined at step 34, and then ultimately determines the section as an unavailable section if the calculated means is smaller than a predetermined value. Specifically, the means is calculated here by dividing a sum of the average sound pressure level values at the individual sample points present in the available section by a length of the available section. The calculated means are parenthesized in FIG. 8D below the names of the corresponding available sections; that is, the calculated mean is "60" for the first available section, "25" for the second available section, "45" for the third available section, and "15" for the fourth available section. Each of the available sections for which the calculated mean of the average sound pressure levels is below 30% of the maximum waveform value of that section is changed to ah unavailable section. In the illustrated example of FIG. 8D, the second and fourth available sections are changed to unavailable sections because their calculated means are below 30%. FIG. 8E shows the available and unavailable sections ultimately determined by the final check of step 35.

Figure 8F:
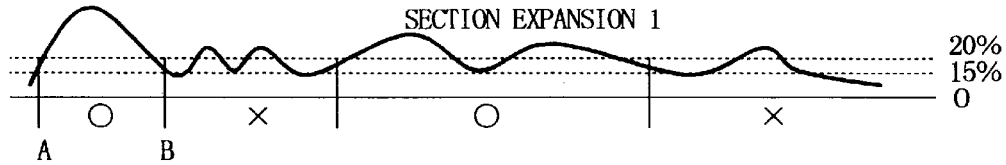

Step 36: An operation is executed to expand the available sections identified through the operations of steps 31 to 35. For example, as shown in FIG. 8F, 15% of the maximum waveform value is set as an expansion permitting level and a horizontal line (broken line in FIG. 8F) is drawn to represent the expansion permitting level. Then, the line defining each of the available sections is expanded to the expansion permitting level. Namely, the expansion is carried out while checking the upward and downward swings in the average sound pressure level curve of each of the available sections to see whether or not the curve has become lower than the expansion permitting level. Thus, each of the available sections is expanded up to a point where its downward swing turns into an upward swing or becomes lower than the expansion permitting level.

Figure 8G:
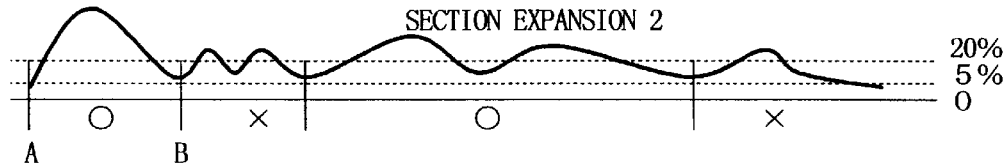

FIG. 8G shows another example of the available section expansion operation at step 36, where the expansion permitting level is set at 5% of the maximum waveform value and each of the available section is expanded up to a point where its downward swing ends or its upward swing starts. In the illustrated example FIG. 8G, the first and third sections are expanded in width (horizontally) further than in the illustrated example FIG. 8F. The above-described operations ultimately determines such available sections which can be recognized as a tone pitch by humans.

It is important to note that where the expansion permitting level is relatively low and the available sections are at a relatively small distance from each other, the expanded trailing (rear) end of a given available section may be located close to or may overlap the expanded leading (front) end of the next available section. Also, the boundary between the two successive available sections may vary depending on whether a downward-swing ending point or an upward-swing starting point is used as the limit of the available section expansion. If the successive available sections overlap as a result of the expansion operation, then the midway between these sections may be set as the boundary.

Whereas the examples of FIGS. 8F and 8G have been described above as expanding the available section both forward and rearward, the available section expansion may be in only one of the forward and rearward directions. Further, in the case where the available section is expanded both forward and rearward, the expansion permitting level may be made different between the forward and rearward expansions.

Figure 4:
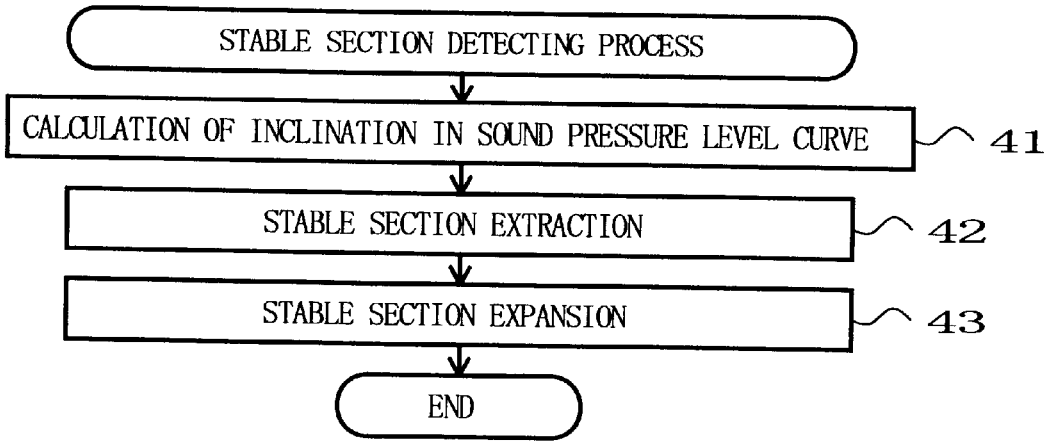
FIG. 4 is a flowchart illustrating a detailed example of a stable section detecting process shown in FIG. 1.

FIG. 4 is a flowchart illustrating details of the stable section detecting process of step 14 shown in FIG. 1, which is performed on the average sound pressure level curve for each of the available sections determined at step 13 in order to detect stable-level sections in that section. Individual operations of the stable section detecting process are illustrated in FIG. 9, which shows an example where the stable section detection is made for the first available section ranging from point A to point B.

Figure 9A:
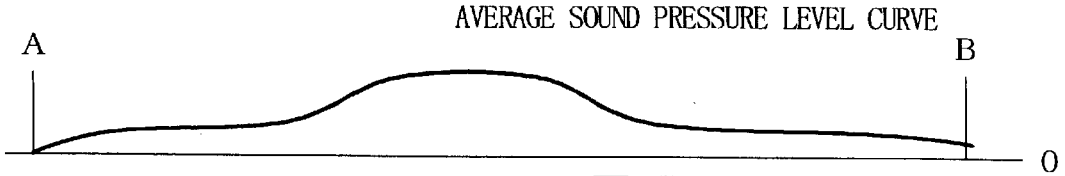
FIGS. 9A to 9D are conceptual diagrams explanatory of an exemplary manner in which the steady section detecting process of FIG. 4 is carried out in the embodiment.
Figure 9B:
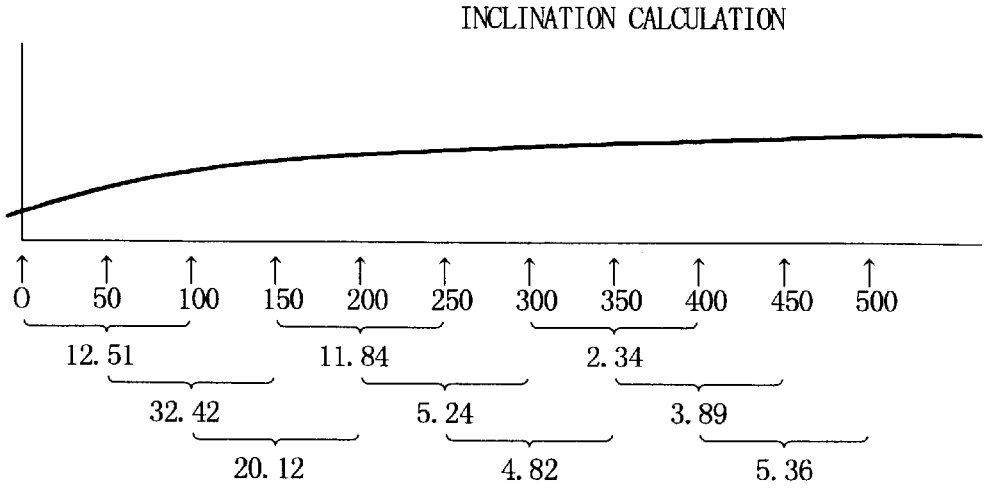

Step 41: Calculation is made of degrees of inclination in the average sound pressure curve for the available section detected in the process of FIG. 3. As shown in FIG. 9B, a unit section over which the inclination calculation is to be made is set to, for example, 100 sample points, and respective degrees of inclination over the successive unit sections are calculated while sequentially shifting the unit section by a predetermined shift amount corresponding to, for example, 50 sample points. More specifically, assuming that point A is sample point "000", a degree of inclination is first calculated for the first unit section between sample points "000" and "100", and then another degree of inclination is calculated for the second unit section between sample points "050" and "150" shifted from the first unit section by 50 sample points. If, for example, the average sound pressure level at sample point "000" is "325" and the average sound pressure level at sample point "100" is "1576", an inclination of 12.51 is obtained by calculating (1576–325)/100. Then, in a similar manner, degrees of inclination are sequentially calculated for the third unit section between sample points "100" and "200", the fourth unit section between sample points "150" and "250", the fifth unit section between sample points "200" and "300", and so on. Examples of the thus-calculated degrees of inclination are shown in FIG. 9B. In the illustrated example of FIG. 9B, the calculated degree of inclination is 12.51 between sample points "000" and "100", 32.42 between sample points "050" and "150", 20.12 between sample points "100" and "200", 11.84 between sample points "150" and "250", 5.24 between sample points "200" and "300", 4.82 between sample points "250" and "350", 2.34 between sample points "300" and "400", 3.89 between sample points "350" and "450", and 5.36 between sample points "400" and "500". Each of the calculated degrees of inclination is then stored as the inclination for the former of the two sample points; that is, "12.51" is stored as the inclination for sample point "000", "32.42" is stored as the inclination for sample point "050", and so on.

In the above-mentioned manner, degrees of inclination are calculated for the entire available section from point A to point B. After that, a stable section extraction operation is executed at next step 42.

Figure 9C:
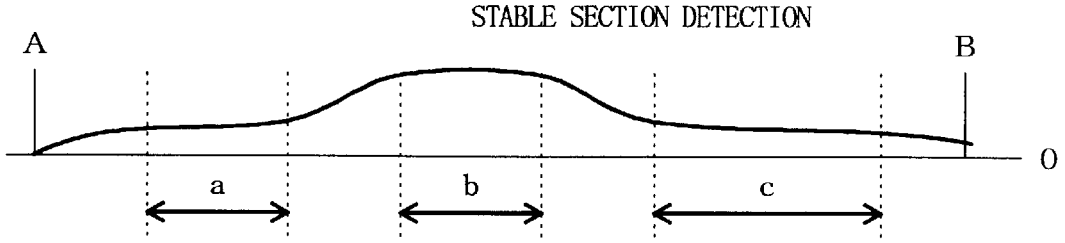
Figure 9D:
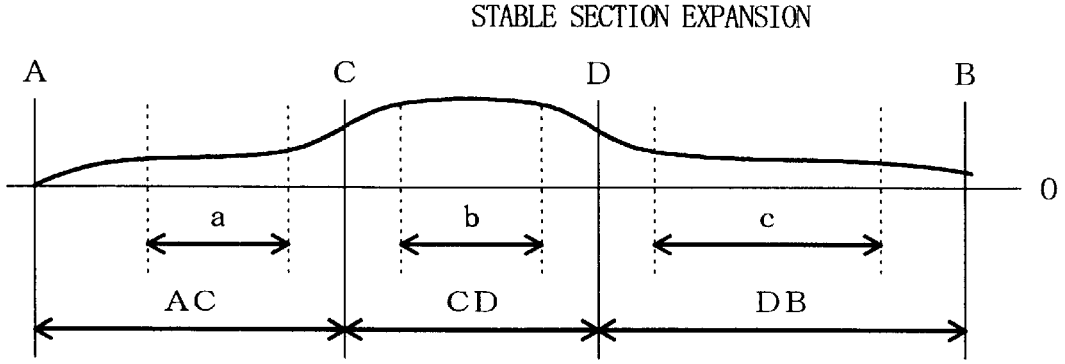

Step 42: Stable sections are extracted out of the available section on the basis of the degrees of inclination calculated at preceding step 41. More specifically, each of the sample points for which the calculated degree of inclination is smaller than a predetermined value (e.g., 10) is regarded as a stable sample point, and each signal section which includes a predetermined number of such stable sample points in succession, i.e., where such stable sample points occur in succession for a predetermined time period, is determined as a stable section. The predetermined time period may be set to a value corresponding to, for example, about 2,000 sample points, taking a currently-set tempo into account. For the average sound pressure level curve shown in FIG. 9A, three stable sections a, b and c are extracted as shown in FIG. 9C.

Step 43: From the presence of the stable sections extracted at preceding step 42, a human observer knows for the first time that a start or trigger point of a note does exist near the start point of each of the stable sections. At this step, the stable sections extracted at step 42 are expanded in order to determine the start point of a note.

In this case, point A becomes the note start point of stable section "a", and point B becomes the note end point of stable section "c"; however, the note end point of stable section "a" and the note start point of stable section "b" can not be readily identified. Thus, in this example, one of the sample points, between the end point of a given stable section and the start point of a next stable section, which has a greatest degree of inclination is determined as the note end point of the given stable section and the note start point of the next stable section. Therefore, point C is determined as the note end point of stable section "a" and the note start point of next stable section "b", and similarly point D is determined as the note end point of stable section "b" and the note start point of next stable section "c".

Whereas step 43 has been described above as determining a sample point having a greatest degree of inclination as the note end point of a given stable section and the note start point of a next stable section, one of the sample points between the end point of the given stable section and the start point of the next stable section whose degree of inclination first exceeds a predetermined threshold value may be determined as the note end and start points. Alternatively, one of the sample points between the end point of the given stable section and the start point of the next stable section whose degree of inclination first goes below a predetermined threshold value immediately before the start point of the next stable section may be determined as the note end and start points. As another alternative, composite calculation may be performed on the sample points determined by the above-mentioned three methods, so as to newly determine the note end and note start points. "AC", "CD" and "DB" represent sections expanded in this manner; that is, in the illustrated example of FIG. 9D, expanded section AC corresponds to the levels of stable section "a", expanded section CD corresponds to the levels of stable section "b", and expanded section DB corresponds to the levels of stable section "c".

Figure 5:
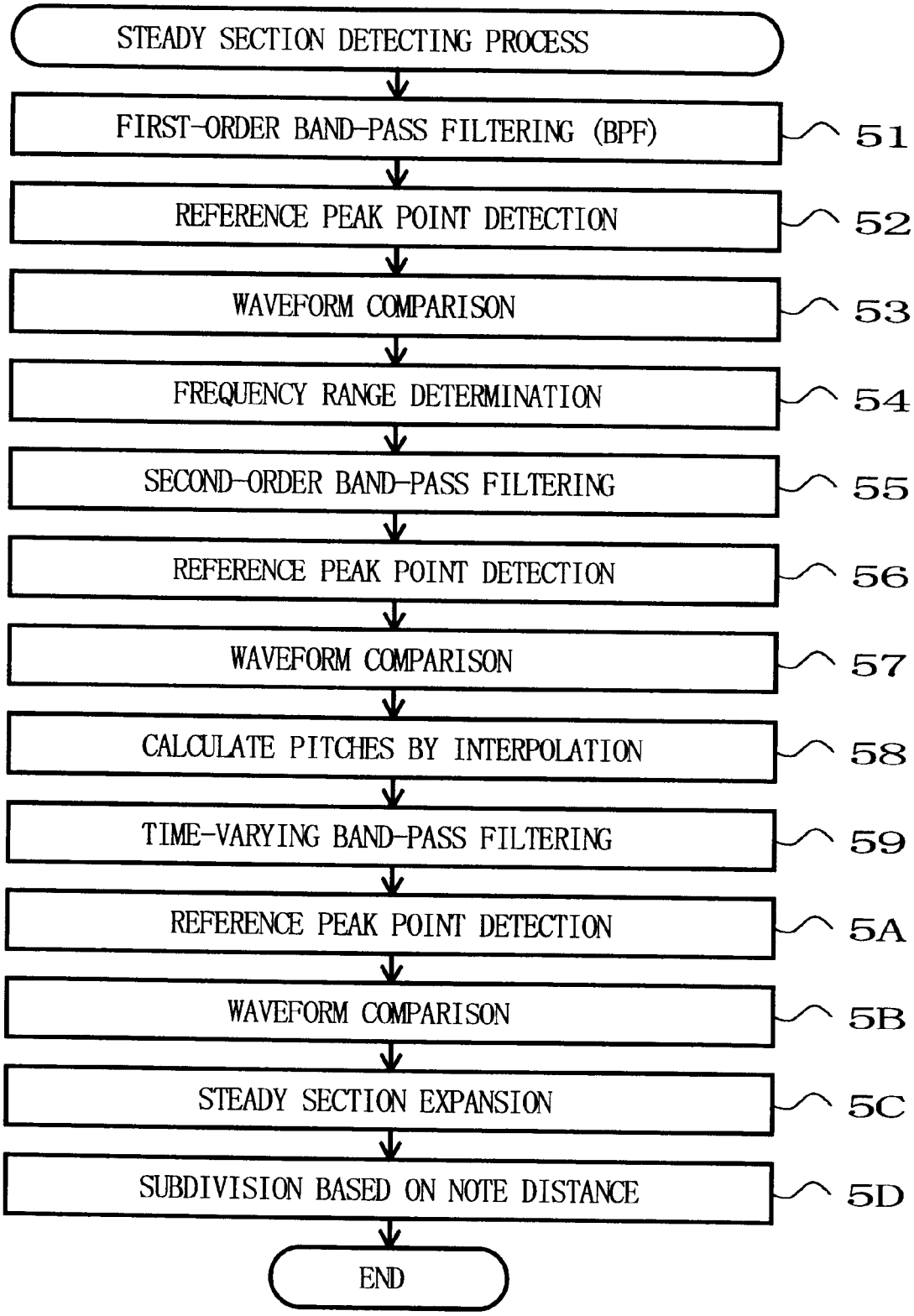
FIG. 5 is a flowchart illustrating a detailed example of a steady section detecting process shown in FIG. 1.

FIG. 5 is a flowchart illustrating details of the steady section detecting process of step 15. The details of the steady section detecting process, and particularly a manner in which steady sections are detected will be described with reference to FIGS. 10 to 17 as well as FIG. 5.

In analyzing a musical audio signal such as of human voice or musical instrument tone, it is important to know where its steady sections are. This is because, for timbers (tone colors) other than those of rhythm sounds, a tone pitch is determined by periodic characteristics of the steady sections and time values are determined depending on the framework of the steady sections. In the present embodiment, the term "steady section" refers to a portion corresponding to a single note when expressed on a staff, and the steady section detection means an operation for identifying a particular section, perceivable by a human observer as a single note, on the time axis on the basis of variations of three principal factors of sound: color or timber; pitch; and velocity.

The following paragraphs describe the steady section detecting process in accordance with a step sequence of FIG. 5. For detection of a steady section, it is necessary to detect a reference point in each cycle (i.e., periodic reference point) in the sound signal waveform. Generally, either the zero-cross point detecting method or the peak point detecting method is employed for detection of such a reference point. The periodic reference point detection using the zero-cross point detecting method will be difficult unless overtones are removed as much as possible such as by a filtering operation and will also require a frequency band division operation. Although it is also desirable to remove overtones as much as possible in the peak point detecting method, the need for the overtone removal is not so great as in the zero-cross point detecting method, so that it is only necessary to apply a band-pass filter operation using, as its cut-off frequency, a soundable band or frequency range of humans or musical instruments and no particular band division operation is required. Thus, the peak detecting method is more preferable in that it involves simpler procedures and yet yields acceptable results. Therefore, the present embodiment will be described in relation to the case where the periodic reference points in the sound signal waveform are detected using the peak detecting method.

Figure 10A:
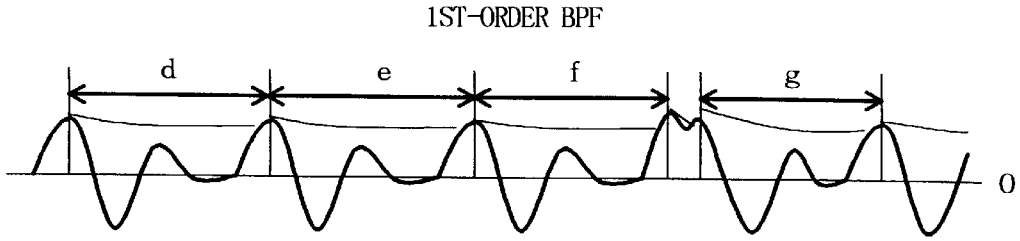
FIGS. 10A to 10D are conceptual diagrams explanatory of an exemplary manner in which first-order and second-order band-pass filtering operations and waveform comparison operation of FIG. 5 are carried out in the embodiment.

Step 51: The sound waveform signal is passed through a first-order band-pass filter, using as its cut-off frequency the soundable frequency range of humans or musical instruments, to remove predetermined overtones therefrom. The soundable frequency range of humans is about 80–1000 Hz, and a frequency range as wide as this will be required when analysis of sound is to be made universally without limiting the users. However, if the users are limited, dissimilarities or differences caused by overtones could be minimized by somewhat narrowing the soundable frequency range, which would thus enhance the detection accuracy. Similarly, with a guitar whose soundable frequency range is about 80–700 Hz, the detection accuracy can be enhanced by use of predetermined bounds of tone pitch. Even higher detection accuracy may be achieved by use of predetermined different tone pitch bounds for various possible musical instruments. FIG. 10A shows part of the sound waveform having undergone the filtering operation by the first-order band-pass filter at step 51.

Step 52: Using the peak detecting method in the conventionally known manner, detection is made of peak points as periodic reference points in the sound waveform signal having passed through the first-order band-pass filter. Specifically, a first peak level in the sound waveform is detected and retained in a predetermined time constant circuit. Then, using the thus-retained level as a threshold voltage, a next peak level higher than the threshold voltage is detected and retained in the time constant circuit. By repeating these operations, successive peak points are detected as shown in FIG. 10A.

Figure 10B:
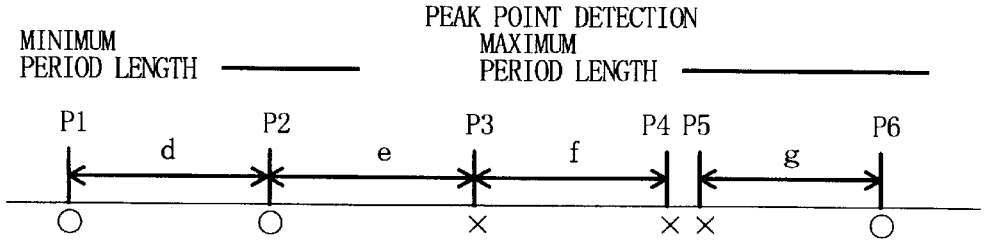

Peak points as shown in FIG. 10B are detected from the sound waveform of FIG. 10A. In the illustrated example FIG. 10B, reference peak points P1, P2, P3 and P6 occur at predetermined regular locations, while reference peak points P4 and P5 occur at irregular or erroneous locations due to slight disturbances in the sound waveform This is because the cut-off frequency of the first-order band-pass filtering (BPF) operation at step 51 covers a relatively wide range so that peak points appear in succession as shown in FIG. 10A.

Step 53: On the basis of the reference peak points detected at preceding step 52, a comparison is made to determine whether or not a basic signal section beginning at a given reference peak point and a next section extending up to a first reference peak point immediately after the end of the basic signal section (hereinafter referred to as a "transitive section") substantially match each other in waveform, i.e., whether the two adjacent sections have waveform similarity greater than a predetermined level.

Referring to the reference peak points shown in FIG. 10B, section "d" is from reference peak point P1 to reference peak point P2, and next section "e" is from reference peak point P2 to reference peak point P3. Because the two sections "d" and "e" are both greater than a minimum period length but smaller than a maximum period length, section "d" is determined as a basic signal section and section "e" is determined as a transitive section, which are then subjected to a waveform comparison operation as will be described later.

At the following stage, section "e" becomes a basic signal section, and a section "f" from reference peak point P3 to reference peak point P4 becomes a transitive section. Namely, because the two sections "e" and "f" are both greater than the minimum period length but smaller than the maximum period length, section "e" is determined as the basic signal section and section "f" is determined as the transitive section, which are then subjected to the waveform comparison as will be described later.

However, a further next section from reference peak point P4 to reference peak point P5, which is smaller than the minimum period length, is not subjected to the waveform comparison. The following section "g" from reference peak point P5 to reference peak point P6 is subjected to the waveform comparison with section "f".

Figure 10C:
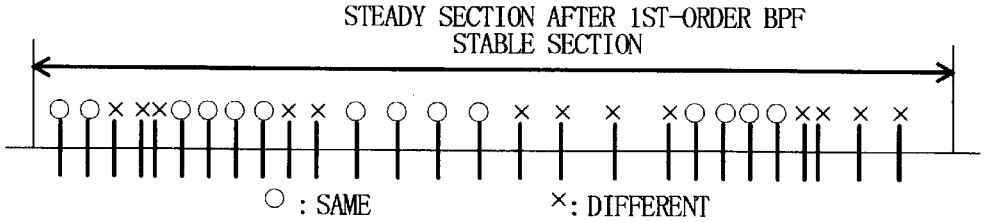

Through the waveform comparison operation, sections "f" and "g" will be identified as being different in waveform from other signal sections "d" and "e". The working memory (RAM) includes data storage areas where similarity and dissimilarity flag data are written using reference peak point information as respective addresses. For the example of FIG. 10B, because sections "d" and "e" are determined as matching each other in waveform (i.e., same-waveform sections), similarity flag data is written into the data storage area for reference peak point information P2 corresponding to section "e". Because sections "e" and "f" are determined as not substantially matching each other in waveform (non-same-waveform sections), dissimilarity flag data is written into the data storage area for reference peak point information P3 corresponding to section "f". Further, because the section from reference peak point P4 to reference peak point P5 is smaller than the minimum period length, dissimilarity flag data are written into the data storage areas for reference peak point information P4 and P5. Let's assume here that similarity flag data have been written previously in the data storage areas for reference peak point information P1 and P6. FIG. 10C shows the similarity and dissimilarity flag data thus sequentially written in association with the reference peak point information.

Figures 12, 13:
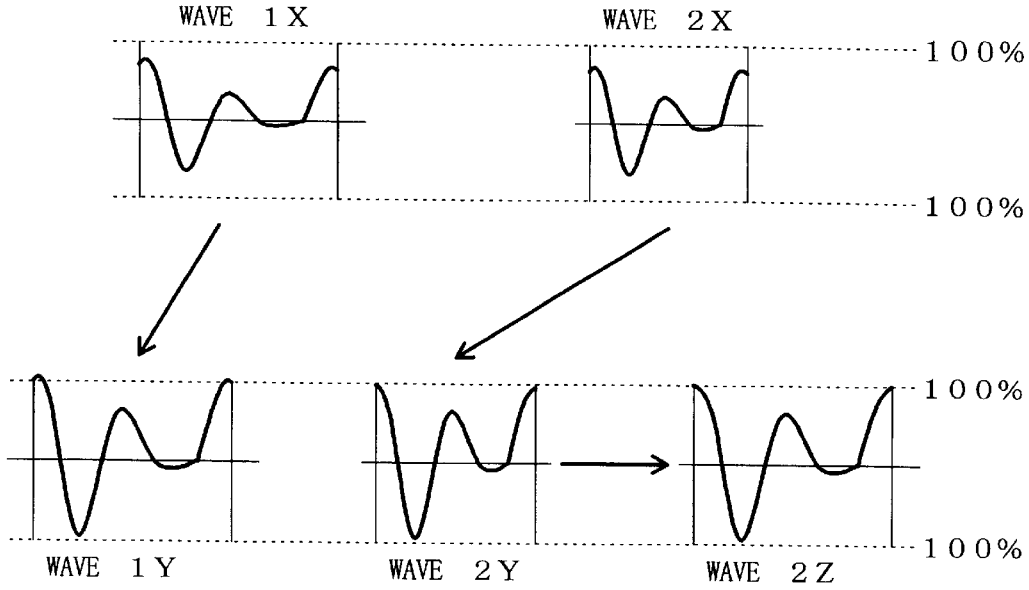
FIG. 12 is a diagram showing a detailed example of a manner in which a difference rate is calculated during the waveform comparison operation of FIG. 5, using two waves.
FIG. 13 is a diagram showing a specific example of various values to explain how the difference-rate is calculated from the two waves of FIG. 11 during the waveform comparison operation of FIG. 5.

The above-mentioned waveform comparison is carried out, using a later-described method for calculating dissimilarity or difference rates. FIG. 13 is a diagram explanatory of the manner in which the difference rates are calculated during the waveform comparison operation. Let's assume here that two waveforms to be compared for waveform similarity are waveform 1X and waveform 2X as shown in FIG. 12. Each of waveforms 1X and 2X has a length:defined by the reference peak points.

First, the amplitude values of two waveforms 1X and 2X are normalized in such a manner that their maximum amplitude values take a 100% value. Thus, waveform 1X becomes a normalized waveform 1Y and waveform 2X becomes a normalized waveform 2Y. Because the normalized waveform 2Y has a length in the time-axis (horizontal-axis) direction shorter than that of the normalized waveform 1Y, it is expanded horizontally to have the same time length as the latter. Namely, the time-axis length of the normalized waveform 2Y is expanded to provide an expanded waveform 2Z. After that, difference-rate calculation is carried out between the normalized waveform 1Y and the expanded waveform 2z.

In FIG. 13, there are shown various values used to calculate a dissimilarity or difference rate between the normalized waveform 1Y and the expanded waveform 2Z. With reference to FIG. 13, the following paragraphs describe a case where the difference rate is calculated, between the two waveforms 1Y and 2Z; for the first cycle, i.e., 24 samples.

First, a difference is calculated between the two waveforms 1Y and 2Z at corresponding sample points, and the respective absolute values of the thus-calculated differences are summed up. The total of the absolute values, which is 122 in the illustrated example FIG. 13 is then divided by the number of the samples, i.e., 24 to provide a difference rate, which, in this example, is 5. If a threshold value of 10 is used to determine whether or not the two waveforms match each other, the difference rate of 5 in the illustrated example FIG. 13 is smaller than the threshold value and hence the two waveforms are treated as substantially matching or the same. Note that each of the waveforms in FIG. 13 is normalized with 1,000 as its maximum level.

Step 54: Using the result of the waveform comparison at step 53, the sections having a difference rate smaller than the threshold value (e.g., 10) are linked together to provide quasi-same-waveform sections, from which maximum and minimum tone pitch values are detected so as to determine a cut-off frequency range. Assume here that the minimum tone pitch value is 235 points and the maximum tone pitch value is 365 points in a plurality of the same-waveform sections obtained as a result of the waveform comparison. To give some margin to the same-waveform sections, the minimum tone pitch value is decreased by 10% and the maximum tone pitch value is increased by 10%, so that the section changes from the section having about 212 points to a section having about 402 points. Where the sampling frequency is 44.1 kHz, this is equal to an audio signal frequency range of 110 to 208 Hz, which is therefore set as the cut-off frequency range.

Step 55: The sound waveform signal is passed through a second-order band-pass filter using the newly set cut-off frequency range, to remove unnecessary overtones therefrom. In the above-mentioned case, the cut-off frequency range is 110 to 208 Hz. By so doing, dissimilarities or differences caused by the overtones can be reduced to thereby provide an enhanced detection accuracy.

Step 56: A reference peak point detection operation is carried out in the same manner as step 52.

Step 57: A waveform comparison operation is carried out in the same manner as step 53.

Figure 10D:
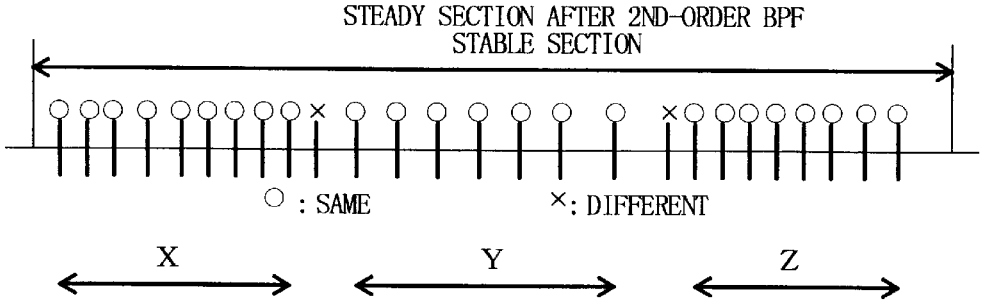

Through a series of the operations at steps 55 to 57, low frequency components and harmonics that would lead to waveform differences can be effectively cut off to thereby achieve more accurate reference peak detection and waveform comparison, so that same-waveform sections can be detected with higher accuracy than previously detected same-waveform sections. By the waveform comparison operation at step 57, tone pitch trains for three steady sections X, Y, Z are obtained, as shown in FIG. 10D, from the waveforms of the available sections characterized by the similarity and dissimilarity flag data as shown in FIG. 10C.

Step 58: Although the tone pitch trains, such as those shown in FIG. 10D, obtained by the operations up to step 57 may be used with no particular modification, this step interpolates between tone pitch data at the individual reference peak points, so as to provide one tone pitch data per sample point. As seen from FIG. 10A, the pitch interpolation can not be performed on the sample points before the first reference peak point and after the last reference peak point because there exists no tone pitch data to be interpolated at these sample points. For this reason, the tone pitch data at the first peak point and the tone pitch data at the last peak point are used directly at this step for such sample points before the first reference peak point and after the last reference peak point. Between every adjacent reference peak points, the tone pitch data values at the two peak points are linearly interpolated. Specifically, in the illustrated example FIG. 10B, if the tone pitch data at the reference peak points P1 and P2 are "PD1" and "PD2", respectively, tone pitch data at a given sample point PV between the reference peak points P1 and P2 can be obtained from the following mathematical expression:

$$(PD2-PD1)\times(PV-PA)/(P2-P1)$$

Step 59: Band-pass filtering (BPF) operation is carried out using the tone pitch data at each sample point obtained by the operation of step 58. Namely, because the tone pitch data vary with time, a so-called time-varying band-pass filtering (BPF) operation is carried out where the cut-off frequency range is also controlled vary over time. Thus, the sound waveform signal is changed to be close to that of a sine waveform, so that ideal peak point detection is permitted by performing the peak point detection operation on such a waveform. Further, because the waveform comparison can be performed on the basis of the thus-detected peak points, the difference rate is minimized, which makes it possible to find same-waveform (same-vowel) sections with highly increased accuracy.

Step 5A: The waveform having undergone the time-varying band-pass filtering (BPF) operation of step 59 is subjected to a reference peak point detection operation similar to that of step 52.

Step 5B: The waveform having undergone the time-varying band-pass filtering (BPF) operation of step 59 is subjected to a waveform comparison operation similar to that of step 53.

The embodiment has been described above in relation to the case where steps 52, 56 and 5A of the steady section detecting process of FIG. 5 detect reference peak points only on the positive (plus) side of the sound waveform; however, it is possible that waveforms of sound and musical instrument tone have distinct or strong peaks on either the positive side or the negative side, or both the positive and negative sides. Thus, with the waveform having more distinct or stronger peaks on the positive side, tone pitch detection can be made by detecting reference peak points on the positive side. The waveform having distinct peaks on the positive and negative sides may present no significant problem in detecting reference peak points therefrom. With the waveform having far more distinct peaks on the negative side, however, tone pitch detection can of course be made by detecting reference peak points on the negative side. In any case, it is of course most recommendable that the reference peak point detection be conducted by focusing on the side where peaks appear most distinctly. In case the reference peak point detection is made by focusing more on the side where peaks appear less distinctly, there may arise problems that the reference peak point detection itself tends to become obscure or inaccurate or can not be conducted as intended by a user. The phenomenon that more distinct peaks appear on one of the positive and negative sides of a waveform varies depending on time-dependent conditions of a human or musical instrument producing a sound, one can not definitely tell which side of the waveform the user's attention should be paid to for detecting reference peak points.

Figure 11:
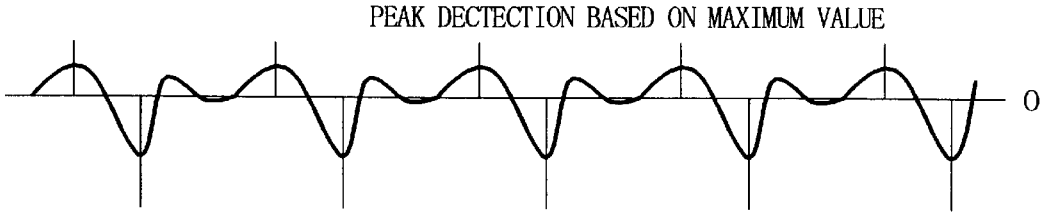
FIG. 11 is a diagram showing an example of a waveform, having undergone the first-order band-pass filtering operation of FIG. 5, where stronger peaks of stable sections appear on its negative or minus side and weaker peaks appear on its positive or plus side.

Thus, to always provide for proper reference peak point detection, it is desirable precheck the sound waveform to see which of the positive and negative sides of the waveform has more distinct peaks and perform the reference peak point detection and tone pitch detection. Let's assume here that the sound waveform of the stable section having undergone the first-order band-pass filtering (BPF) operation at step 51 of FIG. 5 is as shown in FIG. 11. In this sound waveform, stronger peaks appear on the negative side and weaker peaks appear on the positive side. If the reference peak point detection operation is carried out on both sides of the sound waveform in this case, it is possible to properly detect regular reference peak points generally in generally the same manner for both the positive side and the negative side, since stable peaks appear on both the sides although they differ in intensity. Consequently, for this waveform, the steady section detecting process of FIG. 5 may be safely carried out by focusing only on the positive side. However, with sound waveforms having a relatively short period and repetitively lasting for a relatively long time, its peaks may progressively become blunt, so that its reference peak points can sometimes not be detected accurately if the steady section detecting process is carried out by focusing on the positive side alone. Therefore, for such a sound waveform as shown in FIG. 11 as well, it is desirable to focus on the negative side where stronger peaks appear.

So, for each of the stable sections detected through the stable section detecting process of FIG. 4, it is desirable to detect which of the positive and negative sides has a maximum absolute value of the entire section and perform the reference peak point detection operation by focusing on the detected side. For the sound waveform of FIG. 11, it is desirable to perform the reference peak point detection operation by focusing on the negative side, because the maximum absolute value of the sound waveform is present on the negative side. By so doing, reference peak points can be detected accurately without interference by overtones or the like.

As described above, the embodiment is arranged to detect peak points by repeating the operations of: first detecting a peak level of a sound waveform and retaining it in the predetermined time constant circuit; and then using the retained level as a threshold voltage to detect a next peak level and retaining it in the time constant circuit. However, the described method would present the problem that well-ordered peaks can not be properly detected in the case of a human voice or musical instrument tone containing overtones over a considerably wide frequency range, because whether desired reference peak points can be detected or not largely depends on a value of the time constant used. To provide a solution to the problem, the above-described embodiment is arranged to determine, through the waveform comparison operation based on the detected peak points, whether or not the detected reference peak points are accurate enough to be used in a subsequent frequency range determination operation. This means that the peak points detected by the above-described reference peak point detection operation need not be so accurate.

Figure 14:
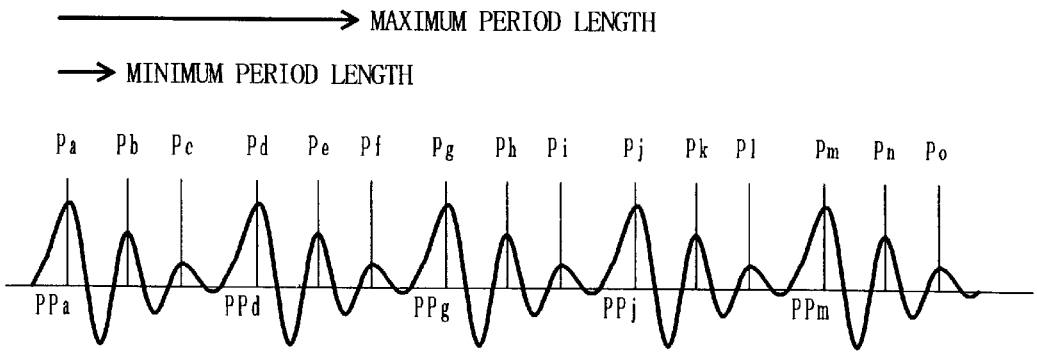
FIG. 14 is a diagram showing an example of a sound waveform.

Thus, in detecting peak levels in the sound waveform, the time constant may be set at a considerable small value to extract relatively many possible reference peak points from the sound waveform so that actual reference peak points are sequentially determined by performing the waveform comparison operation based on the extracted reference peak points. In such a case, by detecting peak points while focusing on the positive side of a sound waveform as shown in FIG. 14, three points are detected per cycle. If the waveform comparison operation is made on the basis of the three peak points per cycle, then a large amount of time will be required for the operation. Therefore, the current embodiment is arranged to efficiently perform the subsequent same-waveform section detection operation on the basis of signal sections having been identified as matching each other in waveform.

In the case of the sound waveform shown in FIG. 14, peak points Pa to Po are detected. Therefore, the waveform comparison is first performed on the following 16 pairs of signal sections beginning at peak point Pa; that is, between: section (Pa-Pb) and section (Pb-Pc); section (Pa-Pb) and section (Pb-Pd); section (Pa-Pb) and section (Pb-Pe); section (Pa-Pb) and section (Pb-Pf); section (Pa-Pc) and section (Pc-Pd); section (Pa-Pc) and section (Pc-Pe); section (Pa-Pc) and section (Pc-Pf); section (Pa-Pc) and section (Pc-Pg); section (Pa-Pd) and section (Pd-Pe); section (Pa-Pd) and section (Pd-Pf); section (Pa-Pd) and section (Pd-Pg); section (Pa-Pd) and section (Pd-Ph); section (Pa-Pe) and section (Pe-Pf); section (Pa-Pe) and section (Pe-Pg); section (Pa-Pe) and section (Pe-Ph); and section (Pa-Pe) and section (Pe-Pi).

As a result of the waveform comparison operation, section (Pa-Pd) and section (Pd-Pg) are determined as matching in waveform. Consequently, peak point Pa becomes pitch reference point PPa and other peak points Pb and Pc are excluded from the candidate list. After that, the waveform comparison operation is performed on 16 pairs of signal sections beginning at peak point Pd, so that peak point Pd becomes pitch reference point PPd. Then, pitch reference points are detected one after another in a similar manner.

To detect same-waveform sections from among the 16 pairs, difference rates of all the 16 pairs may be calculated so that one of the pairs whose difference rate is the smallest of all and yet less than a predetermined value (e.g., 10) is determined as same-waveform sections. Alternatively, one of the pairs whose difference rate first reaches a predetermined value (e.g., 10) may be determined as same-waveform sections.

Considering that a considerable amount of time is required for calculating the difference rates for many pairs of signal sections in order to extract same-waveform sections, the same-waveform signal section operation is thereafter carried out on the basis of the sections identified as matching in waveform. Namely, no waveform comparison operation is carried out on nine of the foregoing 16 pairs of sections. These nine pairs are:

section (Pa-Pb) and section (Pb-Pd); section (Pa-Pb) and section (Pb-Pe); section (Pa-Pb) and section (Pb-Pf); section (Pa-Pc) and section (Pc-Pd); section (Pa-Pc) and section (Pc-Pg); section (Pa-Pd) and section (Pd-Pe); section (Pa-Pd) and section (Pd-Pf); section (Pa-Pe) and section (Pe-Pf); and section (Pa-Pe) and section (Pe-Pg).

This is because the ratio between the two sections in each of the nine pairs is close to 2 and it is obvious that they can never match in waveform.

For such a reason, the current embodiment performs the same-waveform section detection operation only on the following seven pairs: section (Pa-Pb) and section (Pb-Pc); section (Pa-Pc) and section (Pc-Pe); section (Pa-Pc) and section (Pc-Pf); section (Pa-Pd) and section (Pd-Pg); section (Pa-Pd) and section (Pd-Ph); section (Pa-Pe) and section (Pe-Ph); and section (Pa-Pe) and section (Pe-Pi).

As a result of the waveform comparison operation, section (Pa-Pd) and section (Pd-Pg) are determined matching in waveform. Consequently, peak point Pa becomes pitch reference point PPa and other peak points Pb and Pc are excluded from the candidate list. After that, the waveform comparison operation is carried out on seven pairs of sections beginning at peak point Pd, in which the sections to be compared next are limited on the basis of section (Pd-Pg); that is, the waveform comparison operation is carried out sections corresponding to the section length of section (Pd-Pg)$\pm\alpha$, i.e., sections (Pg-Pi), (Pg-Pj) and (Pg-Pk). Here, $\alpha$ is set at about a quarter of the length of section (Pa-Pd), although it may be any other appropriate value. As a result of the waveform comparison operation, section (Pd-Pg) and section (Pg-Pj) are determined as matching in waveform. Thus, after that, it is only necessary that the waveform comparison operation be carried out on three pairs of sections, which greatly simplifies the necessary arithmetic operations.

Step 5C: The steady sections obtained at steps 51 to 5B are expanded. Namely, if the steady sections X, Y, Z resulting from the operations of step 51 to 5B are separated from each other by one different-waveform section as shown in FIG. 10D, no expansion is necessary, but if these steady sections X, Y, Z are separated from each other as shown in FIG. 10C, then the steady sections have to be expanded by coupling the different-waveform sections with the steady sections at this step.

When, for example, same-waveform sections or steady sections, i.e., first and second same-vowel sections XX and YY have been detected from a single stable section, as shown in FIG. 15, through the operations of steps 51 to 5B, a first cycle section S1 of the first same-vowel section XX at the head of the stable section and a last cycle section E2 of the second same-vowel section YY at the end of the stable section may be expanded along the stable section. However, from different-waveform section N1 to N6, the sections can be not easily expanded and thus expanded in the following manner.

Figure 15A:
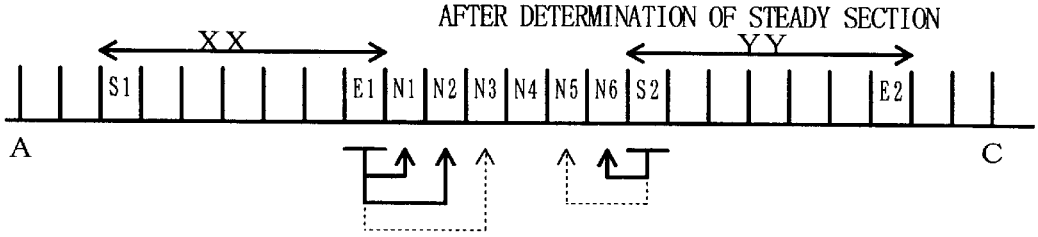
FIGS. 15A to 15D are diagrams explanatory of an exemplary manner in which the steady section detecting process of FIG. 5 is carried out in the embodiment.
Figure 15B:
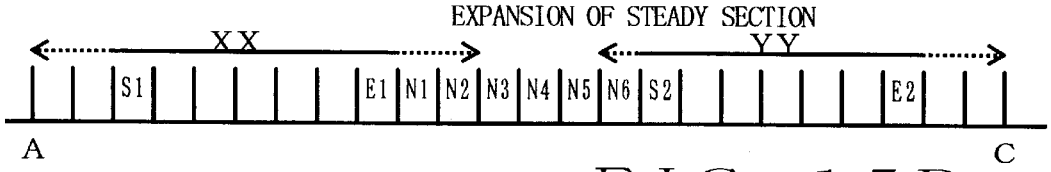

First, on the basis of a predetermined expanding difference rate greater (less strict) than the dissimilarity or difference rate used in the waveform comparison operations at step 53, 57 and 5B, a comparison is sequentially made between a last cycle section El of the first-vowel section XX and each of the different-waveform sections N1, N2, N3, N4, N5, N6 in the mentioned order, and each of the different-waveform sections determined as having a difference rate smaller than the predetermined expanding difference rate is incorporated into the first same-vowel section XX for expansion of the section XX. Similarly, a comparison is sequentially made between the first cycle section S2 of the second same-vowel section YY and each of the different-waveform sections N6, N5, N4, N3, N2, N1 in the mentioned order, and each of the different-waveform sections determined as having a difference rate smaller than the predetermined expanding difference rate is incorporated into the first same-vowel section XX or the second same-vowel section YY for expansion of the section XX or YY. In the illustrated example of FIG. 15A, the different-waveform sections N1 and N2 are incorporated into the first same-vowel section XX and the different-waveform sections N6 is incorporated into the second same-vowel section YY, thereby resulting in expansion of the sections XX and YY as shown in FIG. 15B.

Figure 15C:
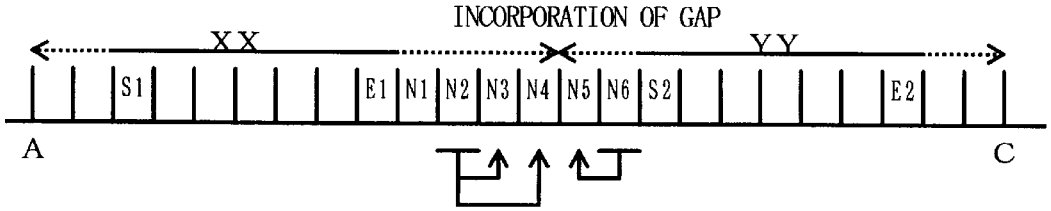
Figure 15D:
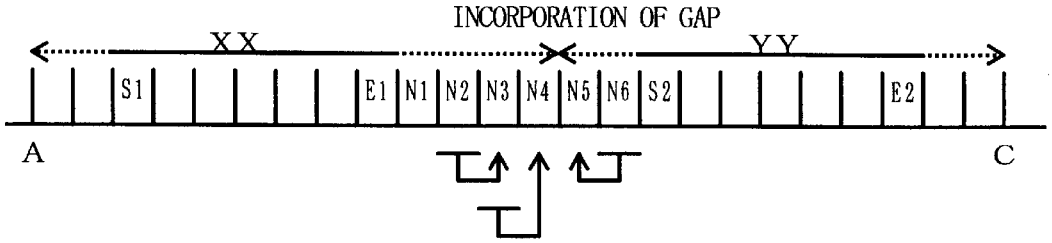

The other different-waveform sections N3, N4, N5 left unincorporated in the same-vowel sections are then incorporated in the following manner. A waveform comparison operation is carried out between the different-waveform section N3 and the different-waveform section N4 incorporated in the first same-vowel section XX so as to evaluate a difference rate therebetween, and similarly a waveform comparison operation is carried out between the different-waveform section N5 and the different-waveform section N6 incorporated in the second same-vowel section YY so as to evaluate a difference rate therebetween. Then, the two evaluated difference rates are compared so that one of the different-waveform sections N5 and N6 having a smaller difference rate (having greater similarity) than the other is incorporated into the associated same-vowel section for expansion thereof. Because the difference rate between the different-waveform sections N2 and N3 is smaller than that between the different-waveform sections N5 and N6 in the illustrated example, the section N3 is incorporated into the first same-vowel section XX as shown in FIG. 15C. After that, difference rates are evaluated between the different-waveform sections N2 and N4 and between the different-waveform sections N6 and N5, so that one of the compared different-waveform sections having the smaller difference rate is incorporated into the associated same-vowel section for expansion thereof. This way, the different-waveform sections N3 and N4 are incorporated into the first same-vowel section XX and the different-waveform section N5 is incorporated into the second same-vowel section YY as shown in FIG. 15C.

After the different-waveform section N3 has been incorporated into the first same-vowel section XX in the above-mentioned manner, a comparison may of course be made between the different-waveform section N3 and the different-waveform section N4 with the section N3 considered to part of the first same-vowel section XX. In the above-mentioned manner, different-waveform or gap sections are incorporated into the same-vowel sections and the steady section expansion operation is completed.

As a modification, an upper limit may be set to the evaluated difference rate so that if the evaluated difference rate of a different-waveform section is greater than the upper limit, this section is not incorporated into its associated same-vowel section.

The waveform comparison operation has been described above as being carried out, in the manner of step 5B, on the sound waveform after the time-varying band-pass filtering operation. In such a case, however, the waveform comparison is, in effect, applied to a near-sine waveform having undergone the band-pass filtering, so that the significance of extracting same-vowel sections would be lost because characteristics of each vowel are also filtered. To avoid this inconvenience, it is preferable that two waveforms be prepared separately for the peak point detection and for the waveform comparison operation. Namely, in this case, the peak point detection directly uses one waveform having undergone the band-pass filtering, while the waveform comparison operation uses the other waveform that has been subjected to band-pass filtering that leaves a frequency-domain waveform of a period several times greater than that of the frequency component used in the time-varying band-pass filtering operation.

Let's assume here that respective frequencies of the individual signal sections are determined on the basis of the reference peak points detected by the reference peak point detection operation of step 5A to thereby provide the following series of frequencies:

134.6 Hz, 135.2 Hz, 145.7 Hz, 135.7 Hz, . . .

Then, using the series of frequencies as a series of fundamental frequencies, a time-varying band-pass filtering operation is carried out for the individual frequency ranges with cut-off frequencies that are integer multiples of the fundamental frequency. Namely, the time-varying band-pass filtering operation is carried out separately using, as the cut-off frequency, integer multiples of the fundamental frequencies, such as:

two-fold frequencies of the fundamental frequencies, i.e., 269.2 Hz, 270.4 Hz, 291.4 Hz, 271.4 Hz, . . . ;

three-fold frequencies of the fundamental frequencies, i.e., 403.8 Hz, 405.6 Hz, 437.1 Hz, 407.1 Hz, . . . ; and four-fold frequencies of the fundamental frequencies, i.e., 538.4 Hz, 540.8 Hz, 582.8 Hz, 542.8 Hz, . . .

The waveforms having undergone the band-pass filtering operation corresponding to the thus-obtained individual frequency series are then synthesized, and the resultant synthesized waveform is used for the waveform comparison operation at step 5B. Such an arrangement provides for accurate detection of same-vowel sections according to changes in tone color (vowel). Note that band-pass filtering may be carried out using the fundamental frequency as a lowest frequency and an integer multiple of the fundamental frequency as a highest frequency so that a thus-processed waveform is used for the waveform comparison.

Step 5D: In consideration of changes and stability in tone pitch, an operation is carried out to subdivide each of the steady sections identified through the operations of steps 51 to 5C, so as to ultimately determine steady sections. In the steady section detection operations up to step 5C, even a tone pitch change in the sound waveform of successive vowels, such as "a a", is detected as a single sound because signal sections are compared after expansion as noted above. Thus, it would sometimes be impossible to detect a pitch change in a waveform of a given sustain tone generated by a musical instrument. To avoid such an inconvenience, the present embodiment is arranged to examine tone pitch changes in each of the steady sections, so as to determine, from the tone pitch changes, whether or not the steady section needs to be subdivided; if so, the steady section is divided into smaller steady sections.

Figure 16A:
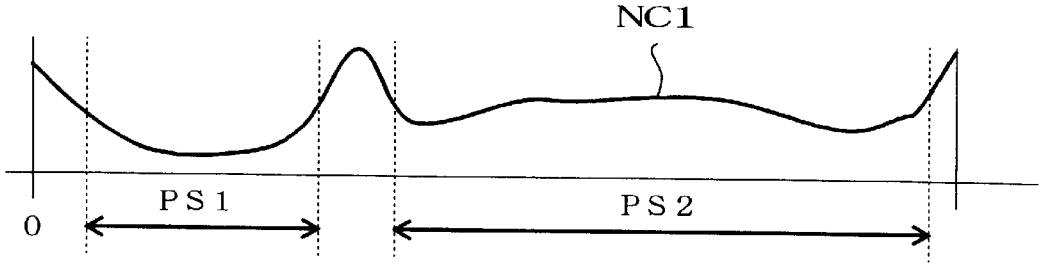
FIGS. 16A and 16B are diagrams explanatory of an exemplary manner in which a subdivision operation based on note distances of FIG. 5 is carried out in the embodiment.

More specifically, a distance between adjacent reference peak points (period length) of the steady section is calculated and the sampling frequency is divided by the calculated distance to thereby evaluate a frequency for these reference peak points. A note distance variation curve as shown in FIG. 16A may be obtained by evaluating a difference (namely, ratio) between frequency $f_1$ of a current signal section and frequency $f_0$ of a preceding signal section and expressing the absolute value of the thus-evaluated difference in numerical value along a note-corresponding linear axis, i.e., in relative value x which may be obtained from the following mathematical expressions:

$$f_1/f_0=2^{(X/12)}$$

thus, $$x=\log(f_1/f_0)/\log(\sqrt[12]{2})$$

where $(\sqrt[12]{2})$ is the 12th root of 2. As generally known, this corresponds to a formula for converting a difference or ratio between two frequencies (namely, musical interval) into cents. Note that whereas a semitone interval is commonly expressed as 100 cents in the art, the relative value "x" in the above equation is a musical interval value including decimal fraction where each semitone interval is expressed by a value "1". However, because it is just a matter of positional notation, the relative value x may be considered to correspond substantially to the cent value; in short, the value x is information representative of a relative musical interval. The relative value x takes a plus or minus sign depending on which of the frequencies $f_1$ and $f_0$, but because the plus and minus signs are unnecessary for detection of stable-pitch sections, its absolute value |x| will hereinafter be considered further and referred to as a "note distance". FIG. 16A shows an exemplary function of time variations in the note distance which will hereinafter be called a "note distance variation curve". In FIG. 16A, the vertical axis represents the note distance, while the horizontal axis represents time. Flat regions of the note distance variation curve represent stable-pitch sections.

Then, by differentiating the note distance variation curve of FIG. 16A and breaking the curve at a portion where a sharp rise and fall occur, two stable-pitch sections PS1 and PS2 are detected.

Figure 16B:
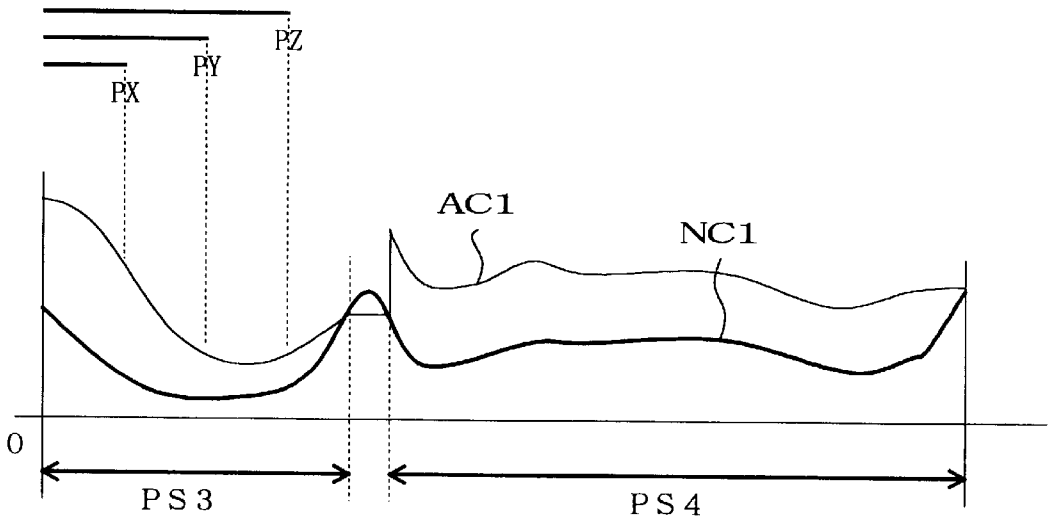

According to the present embodiment, the stable-pitch section may be detected by calculating a dynamic border curve on the basis of the note distance variation curve. The dynamic border at a given sample point PX may be obtained by evaluating an average value in the note distance variation curve from the start point to the sample point PX and then multiplying the average value by a predetermined constant. An offset value may be added to the dynamic border as necessary. In the case of the note distance variation curve of FIG. 16A, a dynamic border curve AC1 is obtained. A comparison is made between the dynamic border curve AC1 and the note distance variation curve NC1, and each signal section where the note distance variation curve NC1 is lower in value than the dynamic border curve AC1 is determined as a stable-pitch section. At that time, when the dynamic border curve AC1 has become lower in value than the note distance variation curve NC1, the calculation of the dynamic border curve AC1 is halted to retain the last-calculated value, and then once the note distance variation curve NC1 has become equal to the retained value, the values of the dynamic border curve AC1 so far calculated are reset so that the calculation of the dynamic border curve AC1 is started again from the beginning. FIG. 16B shows the manner in which the calculation of the dynamic border curve AC1 is carried out. As a result, stable-pitch sections PS3 and PS4 are obtained as shown in FIG. 16B. In the note distance variation curve NC1 shown in FIG. 16, there is no big difference between the stable-pitch sections detected by the differentiation operation and the stable-pitch sections detected by calculation of the dynamic border curve.

However, a note distance variation curve NC2 shown in FIG. 17 presents clear differences.

Figure 17A:
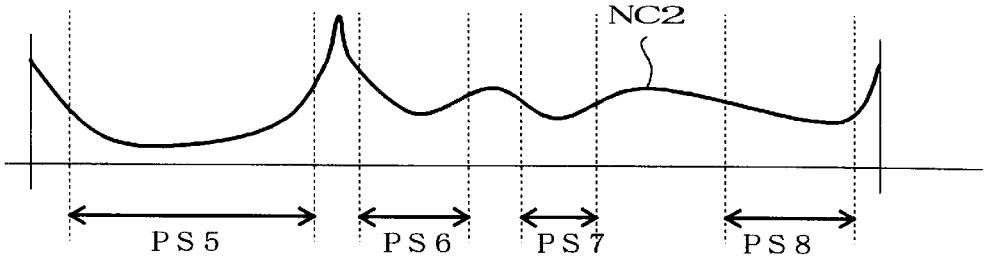
FIGS. 17A and 17B are diagrams explanatory of another example of the manner in which the subdivision operation based on note distances of FIG. 5 is carried out.

For the note distance variation curve NC2 of FIG. 17, tone pitch instability occurs in the latter half of same-vowel sections, many stable-pitch sections PS5, PS6, PD7 and PS8 are detected as shown in FIG. 7A if the detection is based on the degrees of inclination of the curve NC2. However, in the case of the note distance variation curve NC2, observer's ears tend to respond dully (roughly) to tone pitch changes in the instable-pitch sections, so that the observer, in effect, would not perceive many stable-pitch sections as shown in FIG. 17A but just perceive two major stable-pitch sections as shown in FIG. 16B.

Figure 17B:
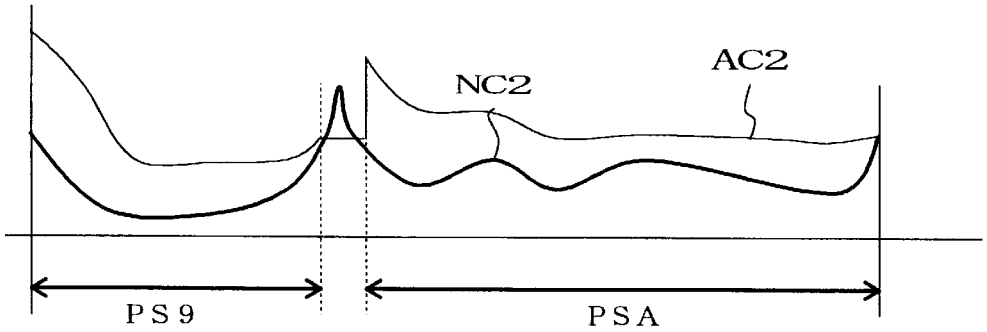

On the other hand, where the stable-pitch section is detected on the basis of the above-mentioned dynamic border curve, a response just as in human observer's ears is provided. Namely, a dynamic border curve AC2 as shown in FIG. 17B may be obtained from the note distance variation curve NC2 of FIG. 17B. Thus, sections of the note distance variation curve NC2 lower in value than the dynamic border curve AC2 are detected as stable-pitch sections PS9 and PSA and identified as two major stable-pitch sections similar to those of FIG. 16. Namely, upon occurrence of a considerable musical interval change after a stable-interval section (stable-pitch section PS9 of FIG. 17), the human observer feels that a new sound has started. Conversely, in an instable-interval section (stable-pitch section PSA of FIG. 17), the human listener can not well perceive a considerable pitch change as a new sound or section. Accordingly, an interval change in the instable-interval section would not be accurately perceived as a musical interval change unless it is a relatively great change. To permit detection of a stable-pitch section substantially as in human ears, the present embodiment is arranged to dynamically detect stable-pitch or instable-pitch sections through a series of operations using the above-mentioned dynamic border curve.

Each of the thus-detected stable-pitch sections is determined, by the steady section detecting process of FIG. 5, as an ultimate steady section, i.e., a section corresponding to a note when written on a staff.

FIG. 6 is a flowchart illustrating details of the pitch train determining process of step 16 in FIG. 1, which is intended to determine an optimum series or train of tone pitches for each of the steady sections detected at step 15 of FIG. 1. The following paragraphs describe the pitch train determining process with reference to FIGS. 18 and 19 as well as FIG. 6.

Generally, in ultimately converting human voices or musical sounds into note information, melody would greatly vary depending on which tone pitches particular frequencies are rounded to, to such an extent that desired detection sometimes becomes impossible. Thus, the present embodiment is arranged to determine a tone pitch train by first determining tone pitches primarily on the basis of relative sounds and then selecting optimum tone pitch transitions using a musical key.

An example of the pitch train determining process will be described in accordance with a step sequence flow-charted in FIG. 6.

Step 61: A representative frequency is determined in each of the steady sections identified by the steady section detecting process of step 15 (FIG. 5). FIG. 19A illustrates an example set of the ultimately identified steady sections (e.g., 12 steady sections), to which bracketed section numbers [1] to [12] are allotted.

What is important in determining respective representative frequencies in the steady sections is to judge a frequency tendency from the period position in each of the steady sections to thereby determine a single frequency unique to that steady section. A first preferred approach for this purpose may be to determine as its representative frequency an average frequency over the entire steady section, a second preferred approach may be to determine as its representative frequency a frequency in the approximate middle point of the steady section, and a third preferred approach may be to determine as its representative frequency an average frequency in stable-pitch regions of the steady section.

According to the present embodiment, the representative frequency is calculated using the note distance variation curve used in the subdivision operation based on note distance at step 5D of FIG. 5, as well as the pitch-stable sections detected during the operations. More specifically, an average is calculated of the note distance variation curve in each of the subdivided sections stable-pitch sections, and the calculated average is provided as a static border. In the case of the note distance variation curve NC2 shown in FIG. 17, a static border SB1 is provided in the stable-pitch section PS9 and a static border SB2 is provided in the stable-pitch section PSA. Then, sections in the stable-pitch sections PS9 and PSA where the note distance variation curve NC2 is lower in value than the respective static borders SB1 and SB2 are set as representative frequency detecting sections F1 and F2, so that respective representative frequencies of the steady (stable-pitch) sections PS9 and PSA are determined on the basis of tone pitches present in the detecting sections F1 and F2.

Figure 18:
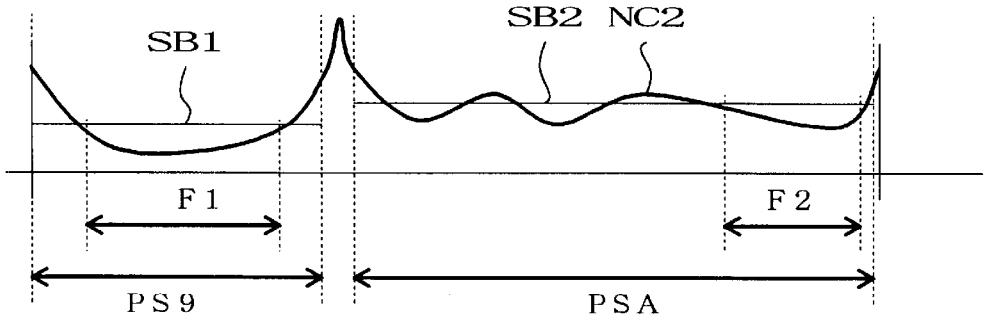
FIG. 18 is a diagram showing from which segment of the steady section a representative frequency is detected in an operation for determining a representative frequency of each of the steady sections.

Let's assume here that the frequency detecting section F1 of FIG. 18 consists of 12 signal sections as shown in FIG. 19B and period lengths of the individual signal sections are as shown in the figure. In this case, the average of the period lengths in the frequency detecting section F1 is 255.833. The period lengths are each expressed in terms of the number of samples, and the representative frequency of the frequency detecting section F1 may be evaluated by dividing the sampling frequency of 44.1 kHz by the average period length. In the illustrated example FIG. 19, 172.38 Hz is thus obtained as the representative frequency, and the value of the representative frequency is treated as effective up to the second decimal place. FIG. 19C shows thus-calculated representative frequencies of the individual ultimate steady sections shown in FIG. 19A.

Step 62: Once the respective representative frequencies of the individual ultimate steady sections have been determined, this step determines, on the basis of the representative frequencies, a note distance between using the same mathematical expression as used at step 5D of FIG. 5. FIG. 19C also shows an example set of thus-calculated note distances.

Step 63: Each of the calculated note distances is rounded off to nearest one. Thus, in the illustrated example FIG. 19C, the calculated note distances are rounded off to whole numbers as shown on a right-side column of FIG. 19C. Because each of the whole numbers represents a difference in note number from a preceding tone pitch, it is possible to complete tone pitch train data by just determining a first tone pitch. The tone pitch train data on a rightmost column of FIG. 19C represent tone pitch transitions "0-2-4-5-2-3 . . . " with the first tone pitch set to "0".

Step 64: Pitch of a first sound is determined. In the simplest firm, note number "60" (note name "C4") is allotted to the first sound as a default value, considering that the allottable note numbers are 0–127 according to the MIDI standards. Thus, tone pitches can be assigned to 67 higher (plus)-side semitone and 60 lower (minus)-side semitone.

By so doing, the tone pitch train data on the rightmost column of FIG. 19C become "60(C4)-62(D4)-64(E4)-65 (F4)-62(D4)-63(D#4) . . . ".

Step 65: The tone pitch train data determined at step 64 are modified. Specifically, deflection in the tone pitch train data determined at step 64 is first detected. If the detected deflection is greater than 60 in the downward (minus) direction, the default value "60" is modified in accordance with the minimum deflection (−60), i.e., by shifting the default value upward so that the note of the minimum deflection takes a note number of "0" or more. For example, if the minimum deflection is 64, then the default value "60" is shifted upward by 4 so as to allot "64" to the first sound. Similarly, if the detected deflection is greater than 67 in the upward (plus) direction, the default value "60" is modified in accordance with the maximum deflection (+67). Over-deflection in both the downward (minus) and upward (plus) directions is unlikely in view of the possible frequency range of voices produced by humans, and hence it is not considered here. However, in the case where such over-deflection in both the downward (minus) and upward (plus) directions could occur, the note numbers may be exceptionally set to a range of 0–256.

Whereas step 64 has been described above as allotting the default value (e.g., 60) to the first sound to create the tone pitch train data, the embodiment is not so limited; for example, a frequency of the just-intonation scale closest to the representative frequency of the first steady section may be detected and applied to the scale. In the illustrated example FIG. 19C, the representative frequency of steady section [0] is 172.38 Hz, and hence the first tone pitch is set to note number "53" (note name "F3") that is closest thereto. By so doing, the tone pitch train data of FIG. 19C become "53(F3)-55(G3)-57(A3)-58(A#3)-55(G3)-56(G#3) . . . ". It is important to note that the tone pitch train assignment may be conducted in any other suitable manners than the above-mentioned.

Next, a description will be made about a second embodiment of the musical instrument which has functions as the sound signal analyzing device and performance information generating device. Main flow when the musical instrument operates as the sound signal analyzing device and performance information generating device is generally the same as that shown in FIG. 1 and will therefore not be described in detail here, except for steps 13 to 15 which are different from the counterparts of the first embodiment.

Figure 20:
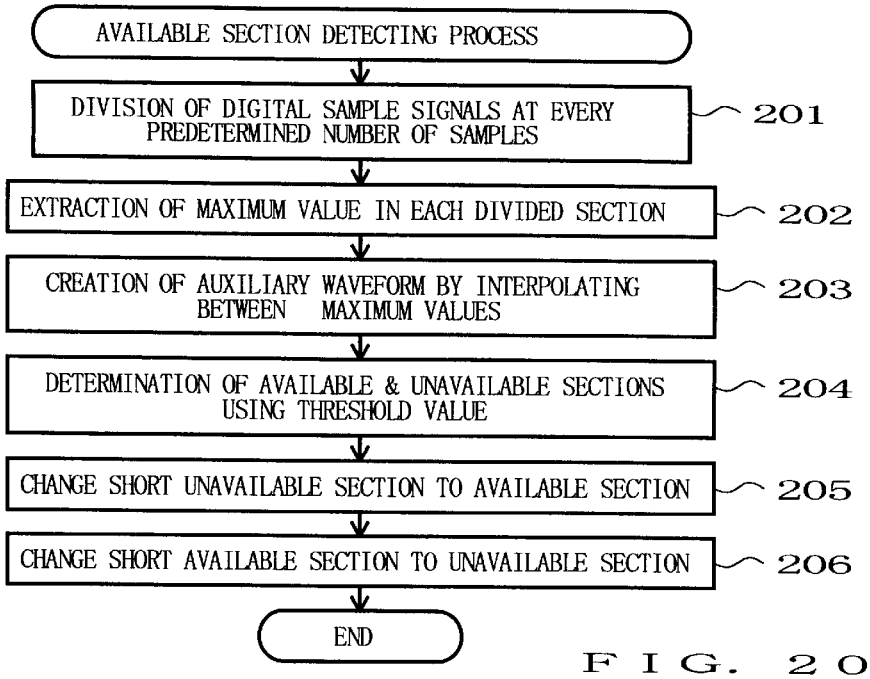
FIG. 20 is a flowchart showing details of another example of the available section detecting process carried out in a second embodiment of the present invention.

FIG. 20 corresponds to FIG. 3 and is a flowchart showing details of the available section detecting process of step 13, which is intended to detect, on the basis of the digital sample signals obtained by the sound sampling operation of step 12, available (musically significant) sections where there appear to be musical sounds, as will be described hereinbelow in greater detail with reference to FIG. 23.

Figures 23A, 23B, 23C, 23D:
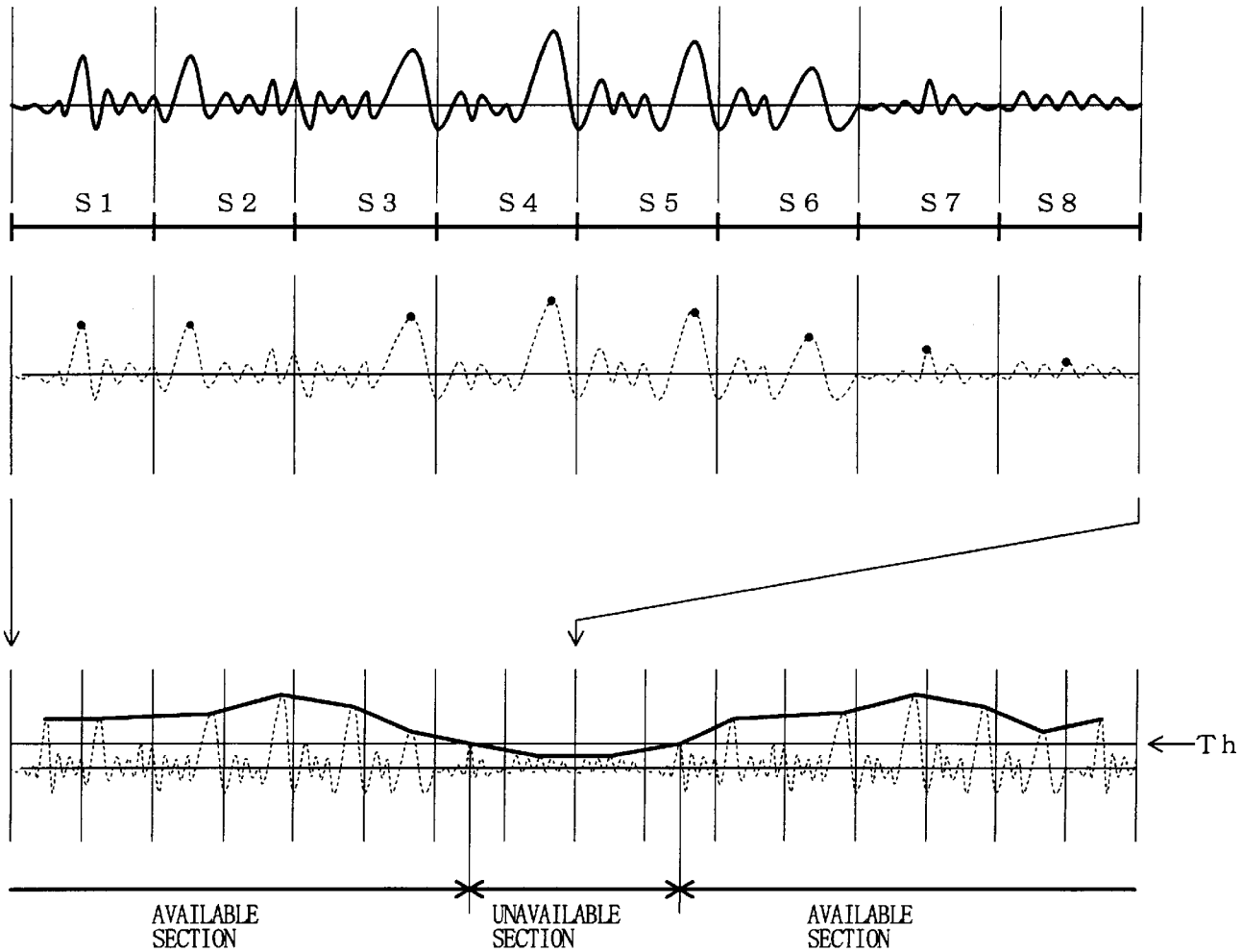
FIGS. 23A to 23D are conceptual diagrams explanatory of an exemplary manner in which the available section detecting process of FIG. 20 is carried out.

Step 201: This step divides the digital sample signal waveform obtained at step 12 every predetermined number of samples. FIG. 23A shows an example set of waveform values of the sound signals, i.e., digital sample signals sampled at the sampling frequency of 44.1 kHz. Waveform values for about 4,408 sample points are shown in FIG. 23A, and waveform values for about 8,816 sample points, twice as many as those of FIG. 23A, are shown in FIG. 23D. At this step 201, the digital sample signals are divided every predetermined number of samples (for example, where a minimum frequency of human voice is assumed to be 80 Hz, the predetermined number of samples corresponds to its maximum period). Thus, with the 44.1 kHz sampling frequency, the predetermined number of samples is 551 (=44,100/80). FIG. 23B shows signal sections or waveform divisions S1 to S8 which correspond to the waveform values of FIG. 23A when divided every 551 samples.

Step 202: For each of the signal sections or waveform divisions divided at step 201, this step extracts a maximum waveform value of the digital sample signals present in that division. In FIG. 23C, the digital sample signal waveform of FIG. 23A is denoted in dotted line and the maximum waveform value in each of the divisions S1 to S8 is denoted in black point.

Step 203: Interpolation (e.g., linear interpolation) is made between every adjacent maximum waveform values of the waveform divisions S1 to S8. FIG. 23D shows an auxiliary waveform, for divisions increased about twofold from those of FIGS. 23A to 23C, obtained by thus linearly interpolating between the adjacent maximum waveform values of the divisions S1 to S8, in which the digital sample signal waveform of FIG. 23A is denoted in dotted line.

At next steps 204 to 206, the available section detection operations are carried out on the basis of the thus-obtained auxiliary waveform in the following manner.

Step 204: Using a predetermined threshold value Th, the auxiliary waveform is classified into available (musically significant) and unavailable (musically insignificant) sections. Here, a value corresponding to one-third of the maximum waveform value is used as the threshold value, although any other threshold value may of course be used. For instance, the average of the solid-line waveform of FIG. 23D or 80% of the average may be used as the threshold value Th. Namely, each intersection between the threshold value Th and the auxiliary waveform represents a boundary between the available and unavailable sections; that is, each signal section greater in waveform value than the threshold value Th is determined as the available section, while each signal section smaller in waveform value than the threshold value Th is determined as the unavailable section.

Step 205: On the assumption that the minimum period length necessary for humans to perceive a tone pitch is 0.05 msec., each of the unavailable sections identified at the above-mentioned step 202 shorter than the minimum period length is changed to an available section. With the 44.1 kHz sampling frequency., each of the unavailable sections containing less than 2,205 samples is shorter than such a minimum period length and hence is changed to an available section. In FIG. 23D, the unavailable section is changed to an available section through the operation of step 205, because it corresponds to three waveform divisions (i.e., about 1,653 samples) and hence is shorter than the minimum period length.

Step 206: Each of the available sections which is shorter than 0.05 msec. is changed to an unavailable section in a manner similar to step 205.

Figure 21:
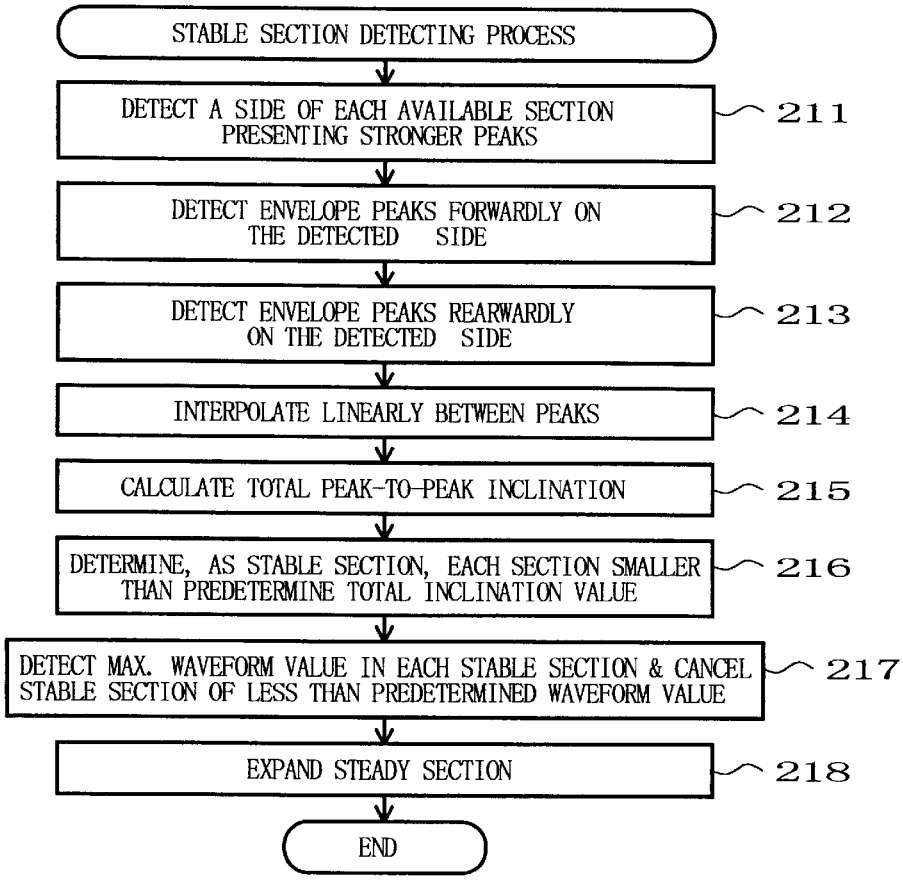
FIG. 21 is a flowchart showing details of another example of the stable section detecting process carried out in the second embodiment.

FIG. 21 corresponds to FIG. 4 and is a flowchart showing details of the stable section detecting process at step 14 of FIG. 1, which is intended to detect stable-signal-level sections within the available sections identified by the available section detecting process of FIG. 20. The available section detecting process will be described hereinbelow in accordance with a step sequence flowcharted in FIG. 21, with reference to FIGS. 24 to 26.

Figure 24A:
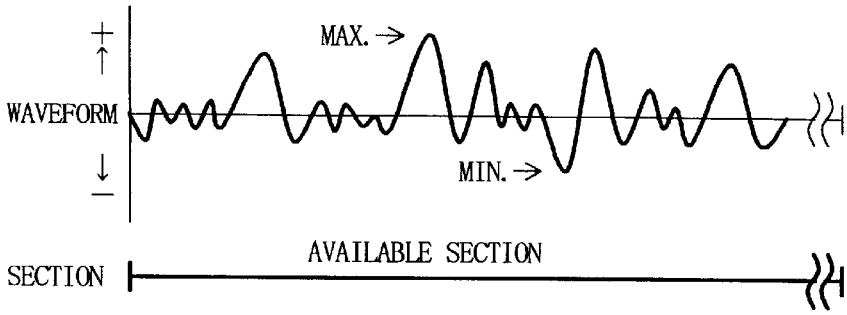
FIGS. 24A to 24D are conceptual diagrams explanatory of an exemplary manner in which operations at steps 211 to 215 of FIG. 21 are carried out.

Step 211: This step detects which side of the waveform presents more distinct or stronger peaks, on the basis of the digital sample signals within each of the available sections identified by the available section detecting process of FIG. 20. Namely, the stronger peak side is detected by measuring respective absolute peak values of the digital sample signals on the positive or plus (+) side and negative or minus (−)

side and determining which of the sides has the greatest absolute peak value—in the illustrated example FIG. 24A, the stronger peak side is the plus side. However, the stronger peak side may be detected in any other suitable manner; for example, it may be detected by summing several (three to five) greater absolute peak values on each of the sides and comparing the respective sums.

Figure 24B:
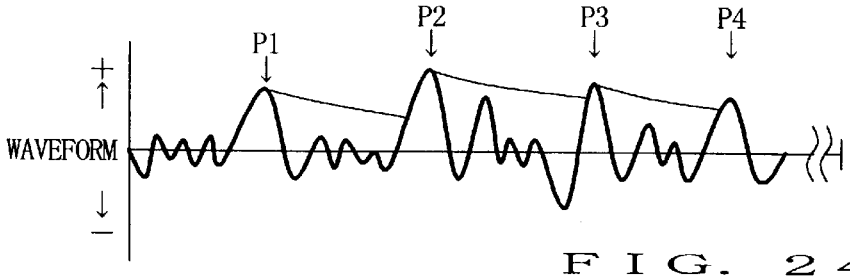

Step 212: On the stronger peak side detected at step 211, an envelope is drawn forward relative to time-elapsing direction and the envelope peaks are detected. Namely, as shown in FIG. 24B, an envelope is drawn forward on the plus side, and four peak points P1 to P4 are detected.

Figure 24C:
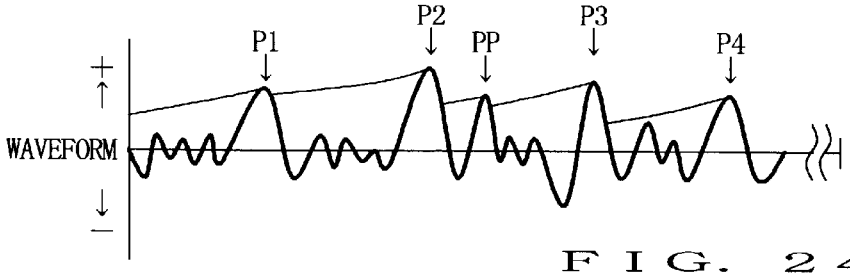

Step 213: This step draws an envelope rearward in the time-elapsing direction and detects the envelope peaks. Thus, as shown in FIG. 24C, four peak points P1 to P4 are detected as at step 211, but another peak point PP is also detected. Generally, if the envelope detection is carried out only in one direction on a waveform progressively increasing in level, an overtone peak (such as peak point PP) tends to be misdetected as a peak. This is why steps 212 and 213 draw envelopes in the opposite directions to detect the peak points; by so doing, the peak points can be detected with highly increased accuracy.

Figure 24D:
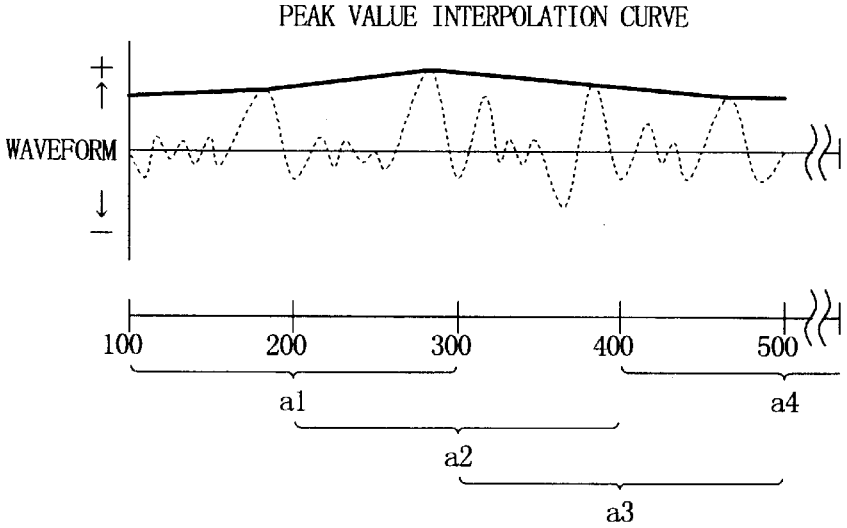

Step 214: Linear interpolation is made between the peak points detected through the operations of steps 212 and 213, so as to create a new waveform. FIG. 24D shows such a new waveform, i.e., a peak-value interpolation curve, created by linearly interpolating between the peak points P1 to P4 detected through the operations of steps 212 and 213, in which the digital sample signal waveform of FIG. 24A is denoted in dotted line.

Step 215: Peak-to-peak degrees of inclination are calculated on the basis of the peak-value interpolation curve. Specifically, as shown in FIG. 24D, the peak-to-peak degrees of inclination are sequentially calculated by, for example, setting a unit range over which to calculate a degree of inclination to 200 sample points and shifting the unit range by 100 sample points. If the first sample point al in the available section is "100", inclination b1 in the first unit range, i.e., between the sample points "100" and "300", can be calculated from a mathematic expression of (a3−a1)/200. Next, inclination b2 is calculated in the second unit shifted by 100 points from the first unit range, i.e., between sample points "200" and "400".

Figures 25, 26:
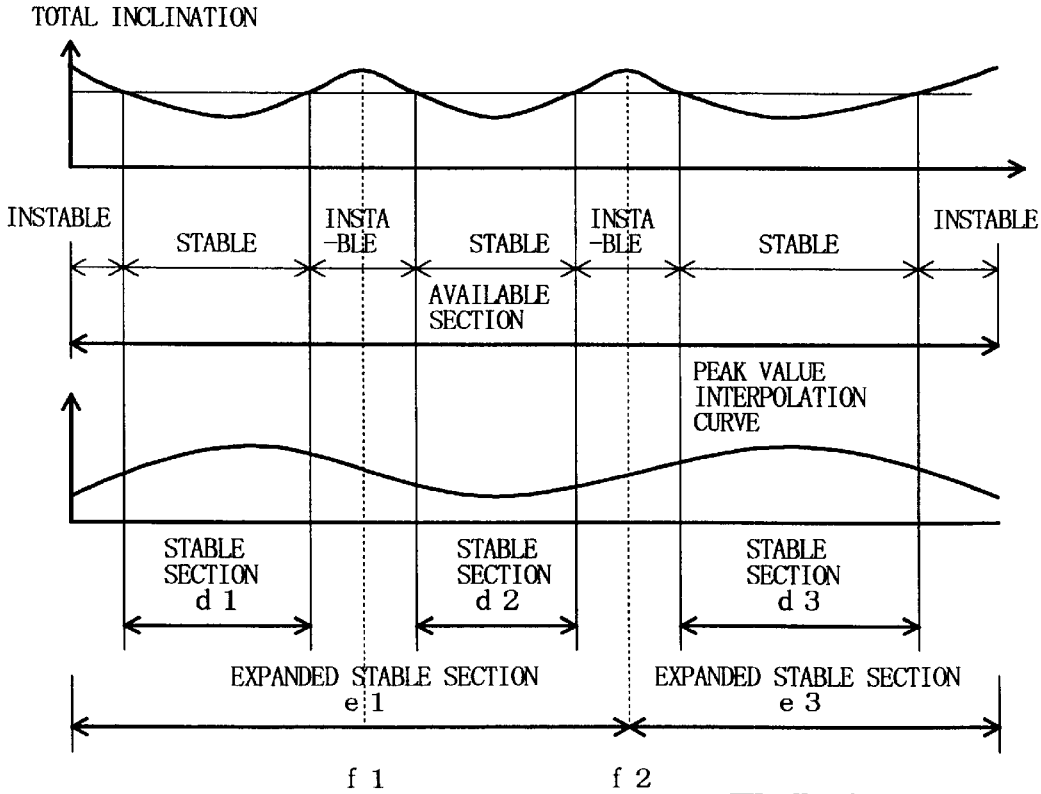
FIG. 25 is a diagram explanatory of an exemplary manner in which total degrees of inclination are calculated at step 215 of FIG. 21.
FIG. 26 is a conceptual diagram explanatory of an exemplary manner in which operations at steps 216 and 218 of FIG. 21 are carried out.

Example of the thus-calculated degrees of inclination is illustrated in FIG. 25. In the illustrated example of FIG. 25, inclination b1 between sample points "100" and "300" is 0.03; inclination b2 between sample points "200" and "400" is 0.15; inclination b3 between sample points "300" and "500" is 0.25; inclination b4 between sample points "400" and "600" is 0.50; inclination b5 between sample points "500" and "700" is 0.90; inclination b6 between sample points "600" and "800" is 1.80; inclination b7 between sample points "700" and "900" is 1.90; inclination b8 between sample points "800" and "1000" is 2.00; inclination b9 between sample points "900" and "1100" is 1.70; inclination b10 between sample points "1000" and "1200" is 1.20; and inclination b11 between sample points "1100" and "1300" is 0.70.

These degrees of inclination b1 to b11 are then each stored in memory as a degree of inclination at the beginning sample point in the unit range; that is, 0.03 is stored as inclination b1 at sample point a1, 0.15 is stored as inclination b2 at sample point a2, and so on. Then, total degrees of inclination are sequentially calculated on the basis of the thus-calculated degrees of inclination b1 to b11. Specifically, the total degree of inclination for each sample point is calculated by summing the degrees of inclination at that sample point and succeeding four sample points. For example, total inclination cl for sample point a1 is calculated by summing the inclination b1 at that sample point and degrees of inclination b2 to b5 at succeeding four sample points; that is, C1=b1+b2+b3+b4+b5. In the illustrated example of FIG. 25, total inclination cl for sample point al is 1.83; total inclination c2 for sample point a2 is 3.60; total inclination c3 for sample point a3 is 5.35; total inclination c4 for sample point a4 is 7.10; total inclination c5 for sample point a5 is 8.30; total inclination c6 for sample point a6 is 8.60; and total inclination c7 for sample point a7 is 7.50.

After having calculated the total degrees of inclination in the entire section, an operation of next step 216 is carried out. Whereas the embodiment has been described as determining a sum of the degrees of inclination at five sample points as a total degree of inclination for the first one of the sample points, the sum may alternatively determined as a total degree of inclination for the central one of the five sample points. For example, sum cl may be determined as a total degree of inclination for sample point a3. It should also be obvious that the sum may be determined as a total degree of inclination for any desired one of the five sample points as long as the position of the desired one is clear. Further, the total degree of inclination may be the sum of the degrees of inclination at any other number of sample points than five. By using such total degrees of inclination, it is possible to detect appropriate degrees of inclination without being misled by temporary inclination, and hence appropriate stable sections can be effectively identified.

Step 216: This step detects stable sections on the basis of the total degrees of inclination determined at preceding step 215. Namely, a total inclination curve is drawn by linking the total degrees of inclination for the individual sample points as by linear or other form of interpolation, and each signal section in the total inclination curve smaller than a predetermined total inclination value (e.g., 5) is determined as a stable section while each other signal section is determined as an instable section.

Step 217: A maximum waveform value, i.e., a maximum value in the peak value interpolation value, is detected for each of the stable sections determined at step 216. If the detected maximum value for a given stable section is smaller than a predetermined value, the section is changed to an instable section.

Step 218: From the presence of the thus-extracted stable sections, the human observer knows for the first time that a start or trigger point of a given note does exist near the start point of each of the stable sections. Thus, in order to determine the note start point and its neighborhood, detection is made of the note start point of each of the stable sections identified at step 217 and expansion of the stable sections are carried out on the basis of the detected note start points.

FIG. 26 is a conceptual diagram of the operations of steps 216 to 218. Where a total inclination curve in a given available section is as shown in FIG. 26, three stable sections d1 to d3 are detected by dividing the curve using a predetermined value. For the stable section d2, the maximum value in the peak value interpolation curve is cancelled through the operation of step 217 because it is smaller than the predetermined value. Thus, in the available section of FIG. 26, two stable sections d1 and d3 are left with the cancelled stable section d2 and instable sections intervening therebetween. Then, it is necessary to expand the stable sections d1 and d3 by linking these instable sections thereto.

For the stable section d1, the start point of the available section naturally becomes the note start point of the stable section d1, and for the stable section d3, the end point of the available section naturally becomes the note end point of the stable section d3. The note start point of the stable section d3 and the end point of the stable section d1 are determined in the following manner. Namely, of the instable sections identified at step 216, detection is made of one instable section that is nearest to the stable section whose note start point is to be detected, and the sample point corresponding to the peak value in the total inclination curve of the instable section is determined as the note start point of that instable section. Thus, in the illustrated example FIG. 26 where two instable sections exist with one stable section d2 cancelled, sample point f2, corresponding to the peak value in the total inclination curve of one of the instable sections closer to stable section d3 whose note start point is to be detected, is determined as the note start point of instable section d3. Thus, sample point f2 becomes the note end point of stable section d1, so that ultimately, stable section d1 becomes expanded stable section e1 and stable section d2 becomes expanded stable section e3.

In case stable section d2 is not cancelled at step 217, sample point f1 becomes both the note end point of stable section d1 and the note start point of stable section d2, and sample point f2 becomes both the note end point of stable section d2 and the note start point of stable section d3.

Figure 22:
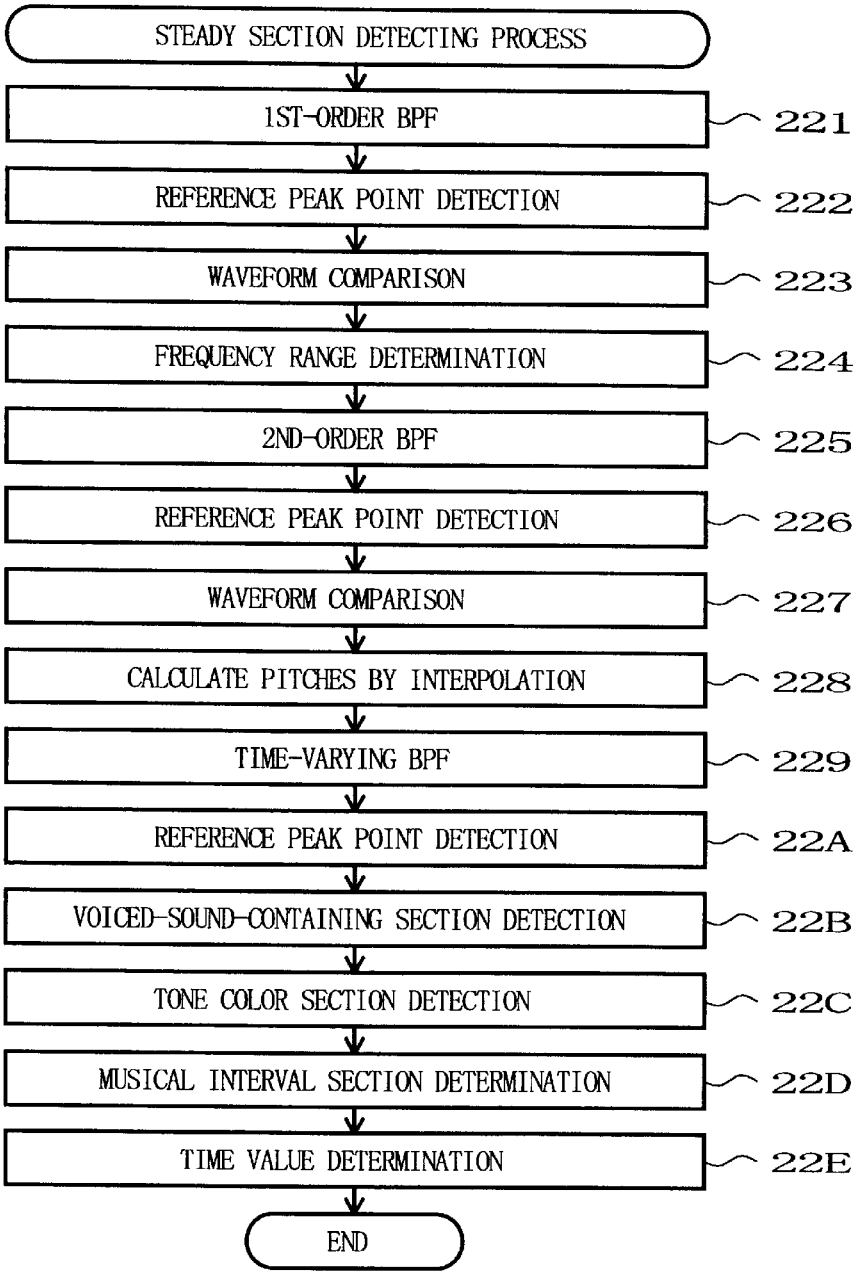
FIG. 22 is a flowchart showing details of another example of the steady section detecting process carried out in the second embodiment.

FIG. 22 corresponds to FIG. 5 and is a flowchart showing details of the steady section detecting process at step 15 of FIG. 1, which is intended to detect steady sections from among the stable sections identified by the stable section detecting process of FIG. 21. In the steady section detecting process of FIG. 22, steps 221 to 229 are virtually the same as steps 51 to 59 of FIG. 5 and will be described only briefly, and only other steps different from those of FIG. 5 will be detailed.

Step 221: The sound waveform signal is passed through a first-order band-pass filter to remove predetermined overtones therefrom.

Step 222: Using the peak detecting method, detection is made of peak points as reference points in the individual cycles of the sound waveform signal having passed through the first-order band-pass filter at step 221.

Step 223: On the basis of the reference peak points detected at preceding step 222, a comparison is made to determine whether or not a basic signal section beginning at a given reference peak point and a next section (transitive section) extending up to another reference peak point immediately after the end of the basic signal section match each other in waveform.

Step 224: Using the result of the waveform comparison at step 223, the sections having a difference rate smaller than a predetermined threshold value (e.g., 10) are linked together to provide quasi-same-waveform sections, from which maximum and minimum tone pitch values are detected so as to determine a cut-off frequency range.

Step 225: The sound waveform signal is passed through a second-order band-pass filter using the new cut-off frequency range determined at step 224, to remove unnecessary overtones therefrom.

Step 226: A reference peak point detection operation is carried out in the same manner as step 222.

Step 227: A waveform comparison operation is carried out in the same manner as step 223.

Through a series of the operations at steps 225 to 227, low frequency components and harmonics causing waveform differences can be removed to thereby achieve more accurate reference peak detection and waveform comparison, so that same-waveform sections having a higher accuracy than the previous sections can be obtained.

Step 228: Linear interpolation is made between the tone pitch data at the individual reference peak points determined by the operations up to step 227, so as to provide one tone pitch data per sample point.

Step 229: Time-varying band-pass filtering (BPF) operation is carried out using the tone pitch data at each sample point obtained by the operation of step 228.

Figure 27:
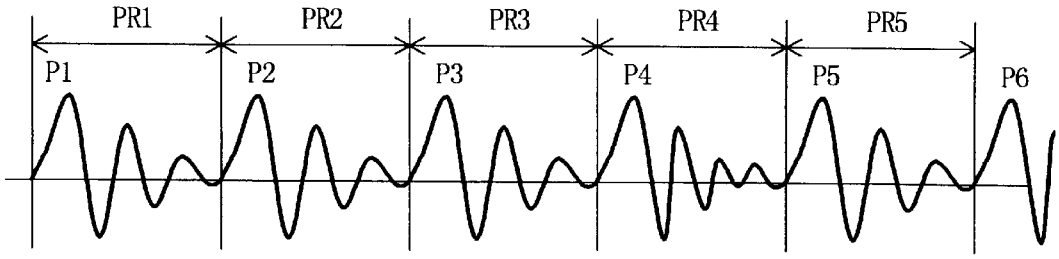
FIG. 27 is a conceptual diagram explanatory of an exemplary manner in which a reference peak point detection operation of FIG. 22 is carried out.

Step 22A: This step determines which side of the sound waveform, having undergone the time-varying band-pass filtering operation at step 229, has more distinct or stronger peaks. Then, this step divides the sound waveform into period sections as determined on the basis of the frequency variations obtained at step 228, and detects a maximum value point in each of the period sections to determine the detected point as a reference peak point. FIG. 27 shows a sound waveform having undergone the time-varying band-pass filtering operation at step 229, and this sound waveform is divided, at this step, into period sections PR1 to PR5 as determined on the basis of is frequency variations. Maximum values in these divided period sections PR1 to PR5 are determined as reference peak points. If reference peak points in the sound waveform as shown in FIG. 10A are detected by the reference peak point detection operations of step 222 (step 52) and step 226 (step 56), an inconvenience would arise that reference peak points P4 and P5 appear at apparently wrong positions. However, such an inconvenience can be effectively avoided by dividing the sound waveform into period sections to detect reference peak point in each of the period sections at step 22A, which thus allows the reference peak points to be detected with highly increased accuracy.

Step 22B: On the basis of the reference peak points detected by the reference peak point detection operation at step 22A, an operation is perform to detect voiced-sound-containing sections in the waveform. Namely, similarly to step 223, on the basis of the reference peak points detected at preceding step 22A, a comparison is made to determine whether or not a basic signal section beginning at a given reference peak point and a next section (transitive section) extending up to another reference peak point immediately after the end of the basic signal section match each other in waveform, using the difference calculation shown in FIG. 13. To this end, if the basic signal section and the transitive section have been determined as different in waveform, this step judges it as the end of a voiced-sound-containing section of the sound signal only when the negative determination (i.e., determination that the two compared sections are different in waveform) occurs successively more than a predetermined times, in stead of so judging immediately. In this way, each signal section containing two or more vowels in succession, such as "a-i-u" or "a-a-a", can be accurately detected as a voiced-sound-containing section of the sound signal.

Figure 28:
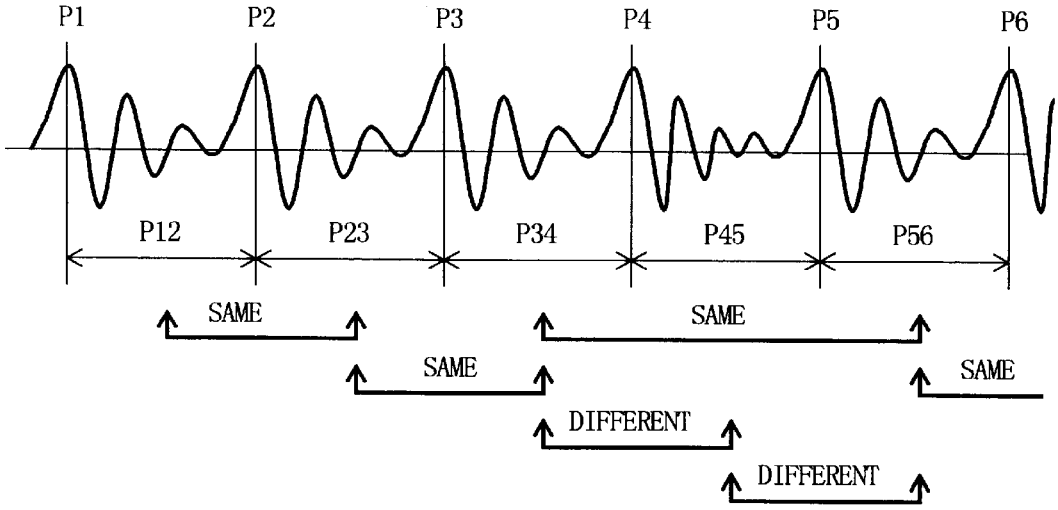
FIG. 28 is a conceptual diagram explanatory of an exemplary manner in which a former half of an available section detection operation of FIG. 22 is carried out.

FIG. 28 assumes a case where basic signal section P12 is from reference peak point P1 to reference peak point P2, transitive section P23 is from reference peak point P2 to reference peak point P3. Let's also assume that basic signal section P12 and transitive section P23 have been determined as matching in waveform and that transitive section P23 and next section P34 have also been determined as matching in waveform. In this case, if sections P34 and P45 are determined as not matching or different in waveform, then the waveform comparison is made between sections P34 and section P56 following section P45. In the event that sections P34 and section P56 are determined as matching in waveform through the waveform comparison, these three successive sections P34, P45 and P56 are treated as matching in waveform even if sections P45 and P56 are different in waveform, and then sections P56 and P67 (not shown) are compared. In the case where the negative determination has been made between sections P34 and P45, sections P34 and P56, sections P34 and P67 (not shown), sections P34 and P78 (not shown) and sections P34 and P89 (not shown), i.e., where the negative determination has resulted in succession more than a predetermined times (e.g., five times), sections P34 is determined as the end of the voiced-sound-containing section and then a similar comparison is made between sections P45 and P56. If sections P45 and P56 do not match in waveform, sections P45 and P67 (not shown) are compared. In the case where sections P45 and P56 do not match in waveform, the comparison between sections P45 and P67 may be conducted without determining whether the negative determination has resulted in succession, and the above-mentioned operation may be carried out only when adjacent sections match in waveform.

After the voiced-sound-containing sections have been determined in the above-mentioned manner, each of the voiced-sound-containing sections smaller than a predetermined length (short voiced-sound-containing section) is cancelled.

Figure 29:
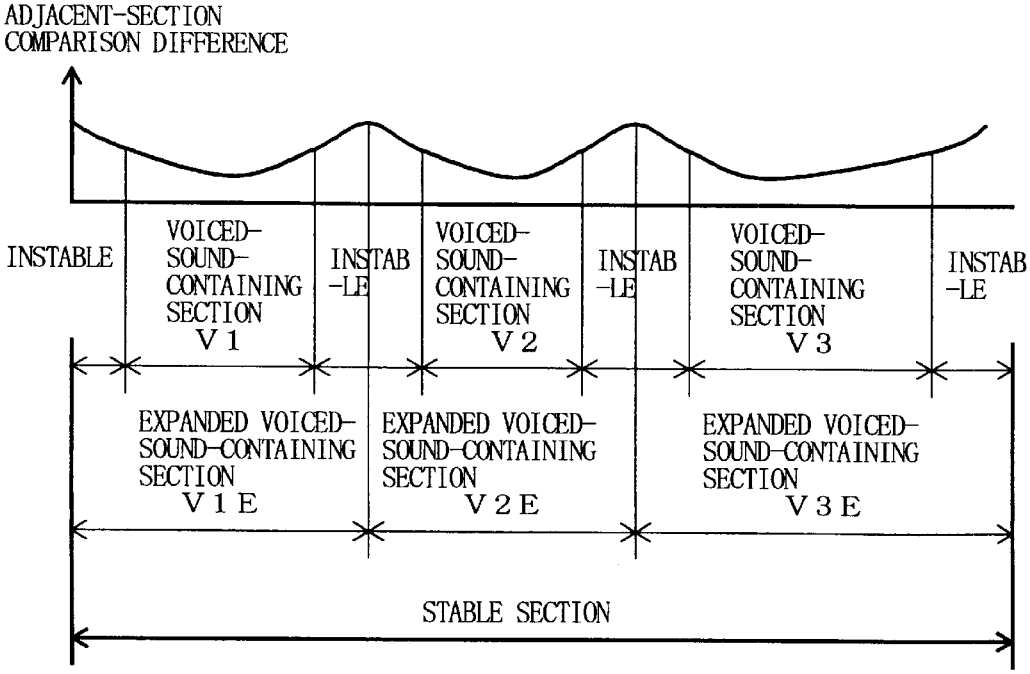
FIG. 29 is a conceptual diagram explanatory of an exemplary manner in which a latter half of the available section detection operation of FIG. 22 is carried out.

Through the above-described operations, the stable section is classified into voiced-sound-containing sections V1 to V3 separated from each other by instable sections, as shown in FIG. 29. The voiced-sound-containing sections V1 to V3 correspond to low-value stable sections of the adjacent-section comparison difference curve, and the instable sections correspond to high-value sections of the adjacent-section comparison difference curve. Therefore, an operation to expand the voiced-sound-containing sections V1 to V3 is carried out on the basis of the adjacent-section comparison difference curve. In this expansion operation, these voiced-sound-containing sections in contact with the start and end points of the stable section are unconditionally expanded up to the start and end points, and for the instable section interposed between two voiced-sound-containing sections, the voiced-sound-containing section is expanded up to the maximum value point of the adjacent-section comparison difference curve. Consequently, with the adjacent-section comparison difference curve shown in FIG. 29, the voiced-sound-containing sections V1 to V3 are expanded to provide expanded voiced-sound-containing sections V1E to V3E. Whereas the adjacent-section comparison difference curve is shown in FIG. 29 as having only one zero-inclination (bottom) region in each of the expanded voiced-sound-containing sections, it should be obvious that the curve in effect may have two or more one zero-inclination (bottom) regions in some of the expanded voiced-sound-containing sections.

Step 22C: For each of the expanded voiced-sound-containing sections obtained by the operations of step 221 to 22B, detection is made of a region where inclination in the difference between adjacent sections, i.e., adjacent-section comparison difference, is zero (i.e., bottom region). The detected bottom region is determined as a reference point of a vowel, and the section corresponding to the vowel sound is detected as a tone color section.

In the tone color detecting operation, a waveform comparison operation is sequentially conducted with the waveform region, corresponding to the bottom of the adjacent-section comparison difference curve, fixed as a basic signal section and with a plurality of signal sections before and after the basic signal section used as transitive sections, so as to determine comparison differences between every adjacent sections. The thus-determined comparison differences will hereinafter be referred to as reference comparison differences.

Figure 30A:
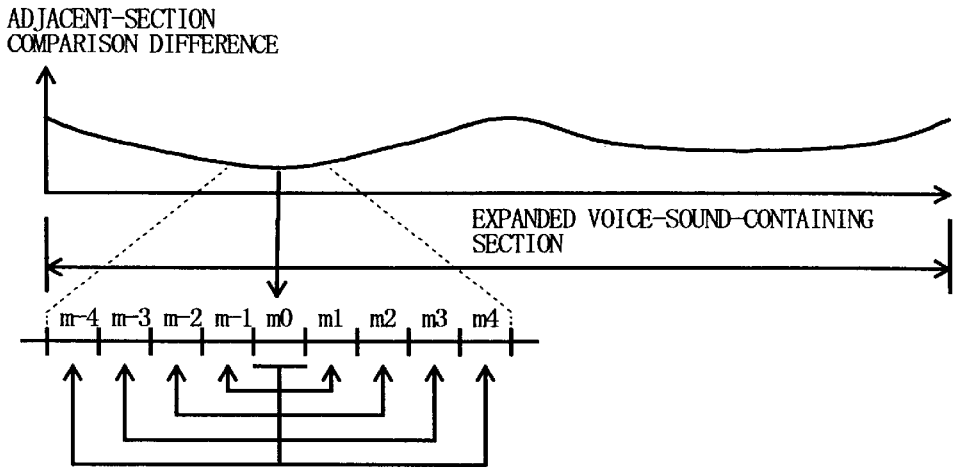
FIGS. 30A to 30D are conceptual diagrams explanatory of an exemplary manner in which a tone color section detection operation of FIG. 22 is carried out.
Figure 30B:
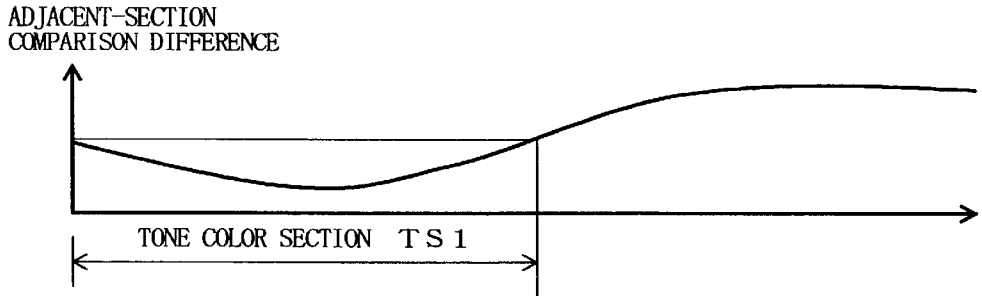

Namely, as shown in FIG. 30A, the signal section m0 corresponding to the bottom of the adjacent-section comparison difference curve is fixed as a basic signal section, and the waveform comparison is conducted between the basic signal section and a plurality of transitive sections m1, m-1, m2, m-2, m3, m-3, m4, m-4, . . . located to both sides of the basic signal section. The basic signal section is a signal section corresponding to a minimum adjacent-section comparison difference, i.e., a signal section determined as having highest similarity through the waveform comparison operation. Reference comparison difference curve of FIG. 30B represents the thus-determined comparison differences. Because the waveform comparison operation is carried out on the basis of the signal section m0, the reference comparison difference curve presents a tendency similar to the adjacent-section comparison difference line in and around the section m0, but presents greater difference rates in regions remote from the section m0. signal section smaller in value than the predetermined value (difference rate) of the reference comparison difference curve is determined as a tone color section TS1.

In determining the reference comparison difference curve, when the reference comparison difference has exceeded a predetermined value at a given point, the given point is not immediately determined as the end of the tone color section; instead, the end of the tone color section is determined only when the reference comparison difference has exceeded the predetermined value in succession more than a predetermined times.

Figure 30C:
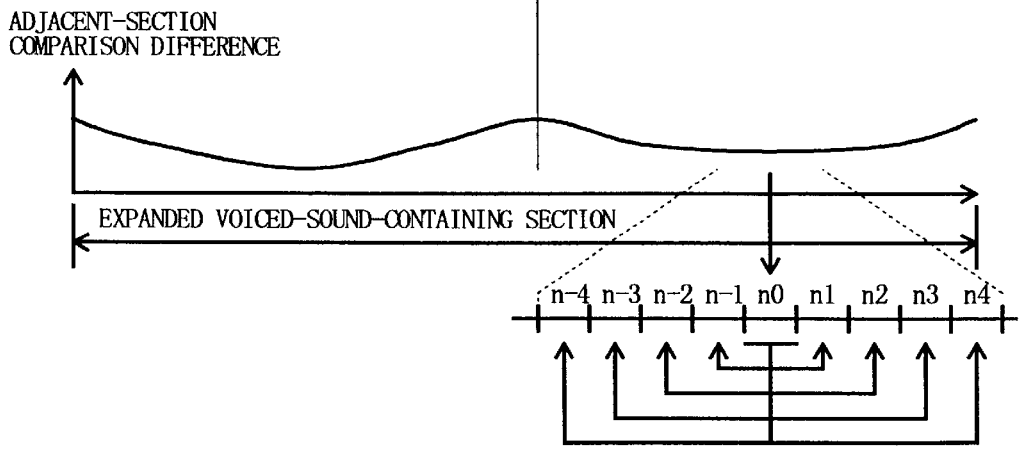
Figure 30D:
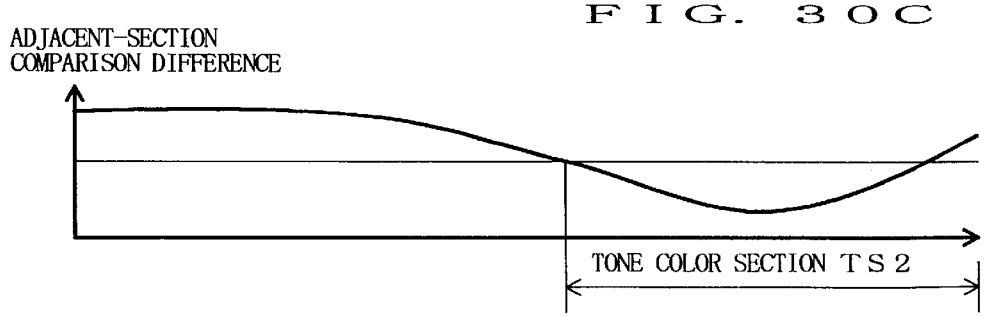

If, after the tone color section has thus been determined, any other part of the expanded voiced-sound-containing section than the tone color section (i.e., undetermined section) has a length than a predetermined length, a similar operation is carried out on the expanded voiced-sound-containing section other than the tone color section. Namely, when tone color section TS1 has been determined as shown in FIG. 30B, the above-mentioned operation is carried out on another part of the expanded voiced-sound-containing section than the tone color section TS1 (i.e., undetermined section) because the undetermined section is longer than the predetermined length. More specifically, as shown in FIG. 30C, the signal section n0 corresponding to the bottom of the adjacent-section comparison difference curve is fixed as a basic signal section, and the waveform comparison is conducted between the basic signal section and a plurality of transitive sections n1, n-1, n2, n-2, n3, n-3, n4, n-4, . . . located to both sides of the basic signal section. Reference comparison difference curve of FIG. 30D represents the thus-determined comparison differences. signal section smaller in value than the predetermined value (difference rate) of the reference comparison difference curve is determined as another tone color section TS2. Consequently, in the case of the expanded voiced-sound-containing section, two tone color sections TS1 and TS2 are detected.

Step 22D: Each of the tone color section obtained through the operation of step 22C is expanded in a similar manner to the steady section expansion operation of step 5C. Namely, if the two tone color sections TS1 and TS2 are separated by one signal section as a result of the operations of steps 221 to 22C, that signal section itself may be determined as a break between the tone color sections TS1 and TS2; however, if the tone color sections are separated by a plurality of signal sections, it is necessary to expand the tone color sections by linking these signal sections to the preceding or succeeding tone color sections. The expansion of the tone color sections is carried out in the manner shown in FIG. 15.

In such a case as well, the waveform comparison is, in effect, applied to a near-sine waveform having undergone the band-pass filtering, so that the significance of extracting same-vowel sections or same tone color would be lost because characteristics of each vowel are also filtered. To avoid this inconvenience, it is preferable that two waveforms be prepared separately for the peak point detection and for the waveform comparison operation. Namely, in this case, the peak point detection directly uses one waveform having undergone the time-varying band-pass filtering, while the waveform comparison operation uses the other waveform that has been subjected to band-pass filtering that leaves a frequency-domain waveform of a period several times greater than that of the frequency component used in the time-varying band-pass filtering operation.

It should be obvious that band-pass filtering may be carried out using the fundamental frequency as a minimum frequency and integer multiple of the fundamental frequency as a maximum frequency so that a resultant filtered waveform is used for the waveform comparison operations.

Each of the thus-expanded tone color sections is then subdivided in consideration of tone pitch variation and stability, so as to determine ultimate musical interval sections. Because, in the tone color detection operations up to step 22C, even a tone pitch change in the sound waveform of successive vowels, such as "a a", is detected as a single sound because signal sections are compared after expansion as noted above. Thus, it would sometimes be impossible to detect a pitch change in a waveform of a given sustain tone generated by a musical instrument. To avoid such an inconvenience, the present embodiment is arranged to examine tone pitch changes in each of the tone color sections, so as to determine, from the tone pitch changes, whether or not the tone color section needs to be subdivided; if so, the tone color section is divided into smaller musical interval sections, using a note distance variation curve as shown in FIG. 16.

Step 22E: Of the musical interval sections detected through the operation of step 22D, there may be ones so short that they can not exist as notes. Therefore, this step uniformly divides one measure into a plurality of grids each having a predetermined note length (e.g., length of eighth note) and assigns the musical interval sections to the grids so as to determine time values. The present embodiment normally assigns each of the musical interval section to one of the grids to which the head of the musical interval section is located nearest, but if two more interval sections are simultaneously located nearest to one of the grids, the embodiment assigns to that grid one of the sections having a longer sound length.

Figure 31:
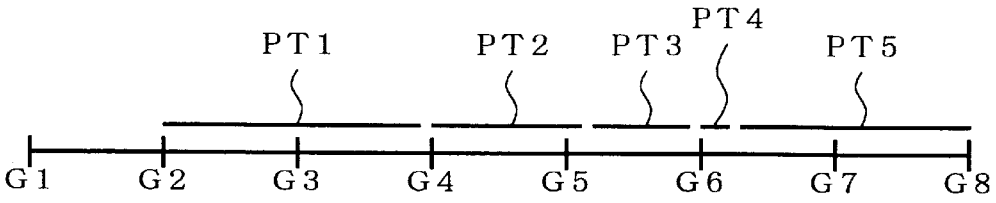
FIG. 31 is a conceptual diagram explanatory of an exemplary manner in which a time value determination operation of FIG. 22 is carried out.

FIG. 31 shows an example set of musical interval sections corresponding to a single measure and divided at every eighth-note length, which assumes that musical interval sections PT1 to PT5 have been ultimately determined through the operation of step 22D. Musical interval section PT1 is assigned to grid G2,.musical interval section PT2 is assigned to grid G4, and musical interval section PT3 is assigned to grid G5. However, musical interval sections PT4 and PT5 are simultaneously located nearest to grid G6. Thus, in this case, one of the two musical interval sections PT4 and PT5 having a longer sound length, i.e., musical interval section PT5 is assigned to grid G6.

Because musical interval section PT3 is assigned to grid G5, musical interval section PT2 has a sound length from grid G4 to grid G5; however, if such musical interval section PT3 is not present, the sound-length end point of musical interval section PT2 may be employed or musical interval section PT2 may be assigned to a particular one of the grids to which its end is located nearest. In this case, note-off (rest) may be allotted to a region where no musical interval section is present. Further, if musical interval section PT3 is not present, the sound-length end point of musical interval section PT2 may be set at grid G6 which is the start point of next musical interval section PT5, in which case no note-off (rest) is allotted.

After time values have been determined through the steady section detecting process of FIG. 22, optimum tone pitch trains are allotted to the individual time values through the pitch train determining process of step 16. This pitch train determining process is the same as in the first embodiment and hence will not be described here to avoid unnecessary duplication.

In summary, the sound signal analyzing device having been described so far affords the benefit that even when an input sound from a microphone or the like fluctuates slightly in pitch or level, it can effectively analyze each steady section of the input sound other than the fluctuating section, i.e., section corresponding to a note.

Figure 32:
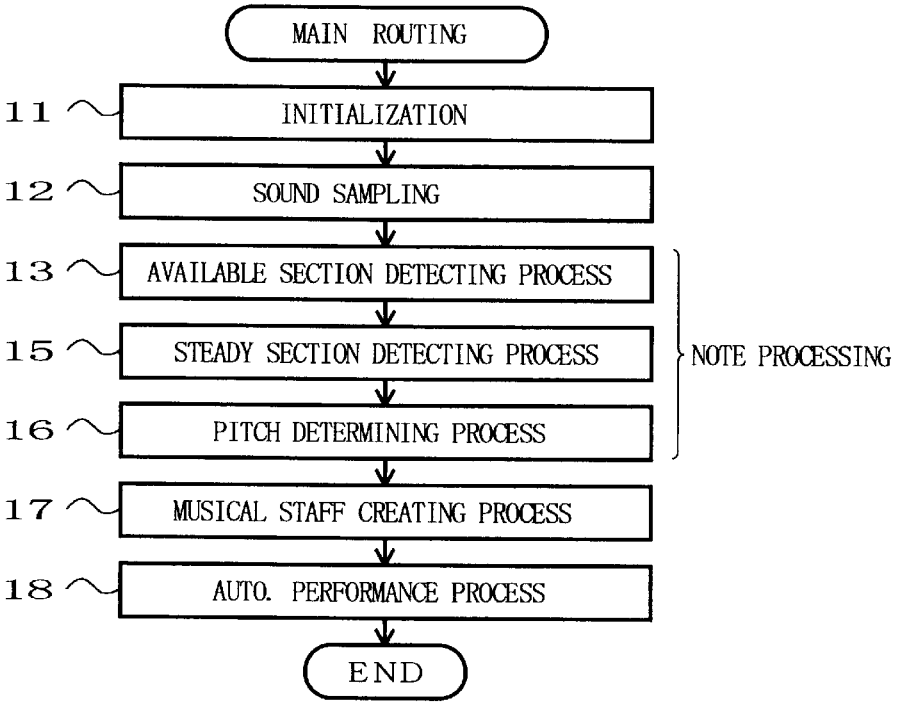
FIG. 32 is a flowchart of a main routine for a third embodiment of the present invention.

Next, a description will be made about a third embodiment of the musical instrument which has functions as the sound signal analyzing device and performance information generating device. Hardware setup as shown in FIG. 2 may be used for the third embodiment, similarly to the above-described first and second embodiments. FIG. 32 is a flowchart of a main routine for sound signal analysis and performance information generation in the third embodiment, which is different from that of FIG. 1 in that it does not include the stable section detecting process of FIG. 14. Namely, in the third embodiment, noting processing does not include the stable section detecting process, and only consists of the available section detecting process, steady section detecting process and pitch train determining process.

The main routine of FIG. 32 will be described below only in terms of steps different from those of FIG. 1. In the steady section detecting process of step 15, an operation is carried out to detect steady sections of a musical sound present in each of the available (musically significant) sections detected through the available section detecting process of step 13. Then, in the pitch train determining process of step 15, an operation is carried out to allot an optimum note to each of the steady sections identified through the operations of steps 13 and 14. The other steps are the same as in FIG. 1. The available section detecting process of step 13 may be carried out in the same manner as shown in FIG. 3, and thus the examples of average sound pressure level and analysis of available/un-available sections are also applicable to the present third embodiment.

FIG. 33 is a flowchart showing details of the steady section detecting process of step 15.

In analyzing a musical audio signal such as of human voice or musical instrument tone, it is important to know where its steady sections are. This is because for timbers (tone colors) other than those of rhythm sounds, a tone pitch is determined by periodic characteristics of the steady sections and time values are determined on the basis of the steady sections. In the present embodiment, the term "steady section" refers to a portion corresponding to a single note expressed on a staff, and the steady section detection means identifying a section, perceived by a human observer as a single sound, on the time axis on the basis of variations in three principal factors of sound, color, pitch and velocity. The following paragraphs describe the steady section detecting process in accordance with a step sequence of FIG. 33.

Step 141: An operation is carried out to detect a reference point in each cycle of all the available sections identified by the available section detecting process of step 13 of FIG. 32 (similar to FIG. 3). Generally, either the zero-cross point detecting method or the peak point detecting method is employed for detection of such a reference point. The reference point detection by the zero-cross point detecting method will be difficult unless overtones are removed as much as possible and will also require frequency band division operation. Although it is also desirable to remove overtones as much as possible in the peak point detecting method, the need for the overtone removal is not so great in this method as in the zero-cross point detecting method, so that it is only necessary to apply a band-pass filter having as its cut-off frequency a soundable frequency range of a human or musical instrument and no particular band division operation is required. Thus, the peak detecting method is more preferable in that it involves simpler procedures and yet yields acceptable results. Therefore, the embodiment will be described in relation to a case where the reference point is detected using the peak detecting method.

Prior to the peak point detection, the sound waveform signal is passed through a band-pass filter, having as its cut-off frequency the soundable frequency range of a human or musical instrument, to remove predetermined overtones therefrom. The soundable frequency range of humans is about 80–1000 Hz, and a frequency range as wide as this will be required when analysis of sound is to be made universally without limiting the users. However, when the users are limited, the detection accuracy can be enhanced by narrowing the soundable frequency range to some degree to thereby reduce dissimilarities or differences caused by the overtones. Similarly, with a guitar whose soundable frequency range is about 80–700 Hz, the detection accuracy can be enhanced by predetermining bounds of tone pitch. Even higher detection accuracy will be achieved by predetermining respective tone pitch bounds of various musical instruments.

Figure 38A:
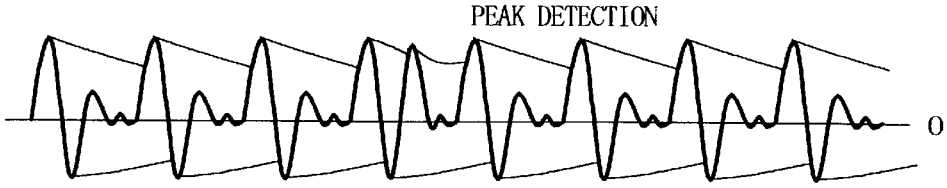
FIGS. 38A and 38B are conceptual diagrams showing an exemplary manner in which detection of peak points in a sound waveform within an available section is carried out as an example of a reference period position detection operation shown in FIG. 33.
Figure 38B:
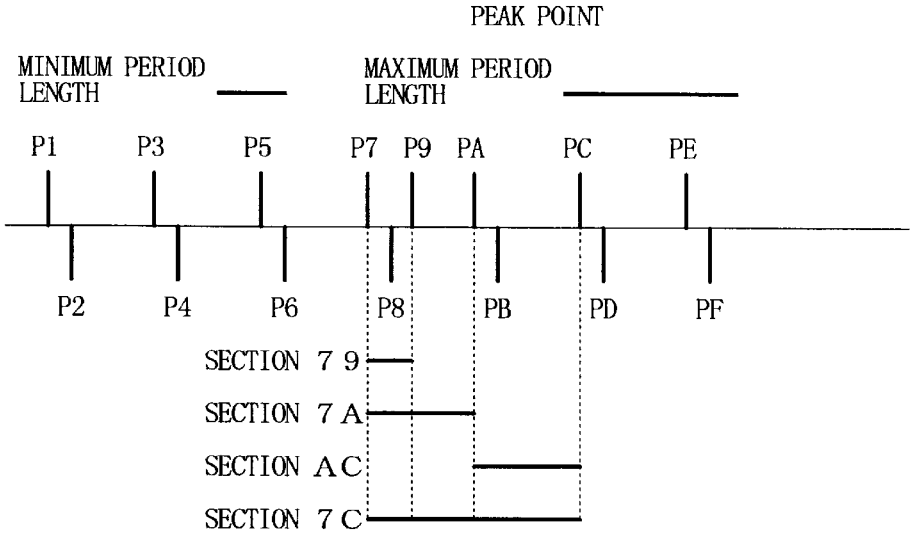

Using the peak detecting method in a conventionally known manner, detection is made of peak points of the sound waveform within each of the available sections having passed through the first-order band-pass filter. First, a peak level of the sound waveform is detected and retained in a predetermined time constant circuit. Then, using the retained level as a threshold voltage, a next peak level higher than the threshold voltage is detected and retained in the time constant circuit. By repeating these operations, peak points are detected as shown in FIG. 38B. FIG. 38A is a diagram showing threshold voltages used to detect the peak points.

From the sound waveform of FIG. 38A, peak points as shown in FIG. 38B are detected. In the illustrated example FIG. 38B, peak points P1, P2, P3 and P6 occur in predetermined regular cycles, while peak point P9 occurs at irregular or erroneous location due to slight disturbances in the sound waveform. Then, such an erroneous peak point is positionally corrected, so that steady sections will be detected at correct peak points.

At step 142 of FIG. 33, on the basis of the reference peak points detected at preceding step 141, a comparison is made to determine whether or not a basic signal section beginning at a given:reference peak point and a next section (transitive section) extending up to another reference peak point immediately after the end of the basic signal section match each other in waveform.

Referring to reference peak point P7 shown in FIG. 38B, a first basic signal section 79 is from reference peak point P7 to next reference peak point P9. However, because the first basic signal section 79 is shorter than a minimum period length, it is expanded into section 7A which extends from reference peak point P7 up to further next reference peak point PA. The expanded section 7A is longer than the minimum period length but shorter than a maximum period length, and therefore is set as a basic signal section forming a basis of the waveform comparison to be made. Succeeding transitive section AC is from reference peak point PA to reference peak point PC. A difference rate is calculated between the expanded basic signal section 7A and the transitive section AC. If the calculated difference rate is greater than a predetermined value, it is judged that the two sections do not match each other, so that the transitive section is expanded in length. Then, a difference rate is calculated between the basic signal section and the expanded transitive section. If the calculated difference rate is greater than the predetermined value, it is judged that no agreement between the two sections does not occur with the current basic signal section, so that the basic signal section is expanded into section 7C which extends from reference peak point P7 up to further next reference peak point PC. However, because the expanded section 7C is longer than the maximum period length, the comparison operation is halted, and it is determined that no agreement has been made between the sections.

In case the difference rate between the basic signal section 7A and the transitive section AC is smaller than the predetermined value (e.g., 10) as a result of the comparison, it is judged that the two sections match each other, so that the above-mentioned operation is then carried out on the section beginning at next reference peak point PA and next transitive section. The manner in which the difference rate is calculated will be later described in detail.

The working memory (RAM) includes data storage areas where are written each reference peak point, then-calculated difference rate and similarity flag data, respectively. For the example of FIG. 38B, when the basic signal section 7A and the transitive section AC have been judged as matching each other, reference peak point P7, then-calculated error rate and similarity flag data are written into the respective data storage areas. When section 2 and section 3 have been judged as not matching each other, only similarity flag data is written.

Figure 39:
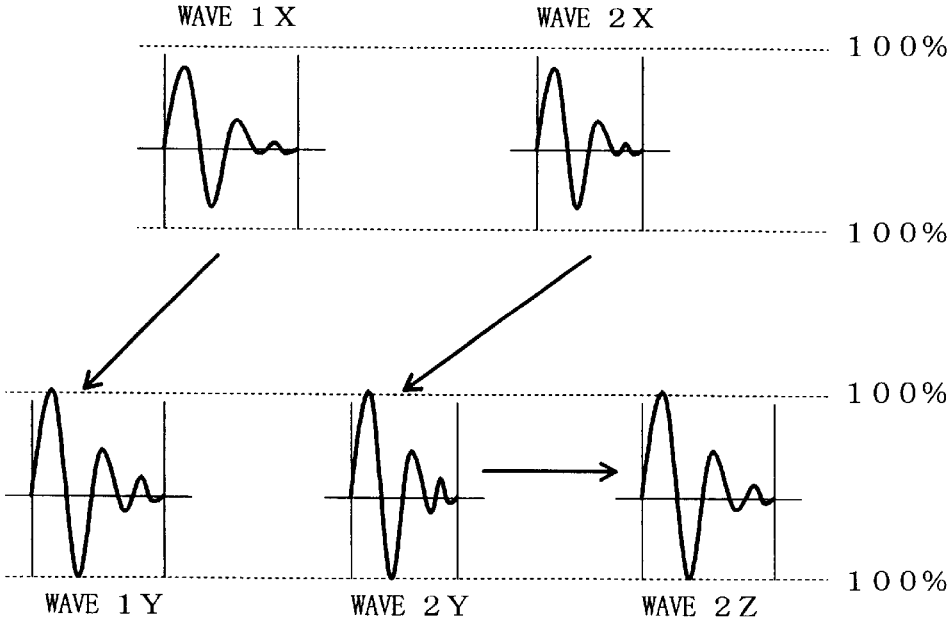
FIG. 39 is a diagram explanatory of an exemplary manner in which a difference rate is calculated between two waves during a waveform comparison operation of FIG. 33.

FIG. 39 is a diagram explanatory of the manner in which the difference rate is calculated during the waveform comparison operation. Let's assume two waveforms to be compared for dissimilarities are waveform 1X and waveform 2X as shown in FIG. 39. First, the amplitude values of two waveforms 1X and 2X are normalized in such a manner that their maximum amplitude values take a 100% value. As a result, waveform 1X becomes a normalized waveform 1Y and waveform 2X becomes a normalized waveform 2Y. Because the normalized waveform 2Y has a length in the time-axis (horizontal-axis) direction shorter than that of the normalized waveform 1Y, it is expanded horizontally to have the same time length as the latter. Namely, the time-axis length of the normalized waveform 2Y is expanded to provide an expanded waveform 2Z. After that, difference-rate calculation is carried out between the normalized waveform 1Y and the expanded waveform 2Z.

In FIG. 40, there are shown a detailed example of various values used to calculate a difference rate between the normalized waveform 1Y and the expanded waveform 2Z. With reference to this figure, the following paragraphs describe a case where the difference rate is calculated, between the two waveforms 1Y and 2Z, for the first cycle, i.e., 24 samples.

First, a difference is calculated between the two waveforms 1Y and 2Z at every corresponding sample points, and the respective absolute values of the thus-calculated differences are summed up. The total of the absolute values, which is 122 in the illustrated example FIG. 40 is then divided by the number of the samples, i.e., 24 to provide a difference rate, which, in this example, is 5. If a threshold value of 10 is used to determine whether or not the two waveforms are identical, the difference rate of 5 in the illustrated example FIG. 40 is smaller than the threshold value and hence the two waveforms are treated as matching in waveform. Note that each of the waveforms in FIG. 40 is normalized with 1,000 as its maximum level.

By performing the waveform comparison in the above-mentioned manner, reference peak point P9 is cancelled, so that peak points appearing at regular intervals are detected as shown in FIG. 41A.

At step 143 of FIG. 33, using the result of the waveform comparison at step 142, these sections having a difference rate smaller than the threshold value (e.g., 10) are linked together to provide quasi-same-waveform sections, from which maximum and minimum values are detected so as to determine a cut-off frequency range. Assume here that the minimum value is 235 points and the maximum value is 365 points in a plurality of the same-waveform sections obtained as a result of the waveform comparison. To give some margin to the same-waveform sections, the minimum value is decreased by 10% and the maximum value is increased by 10%, so that the section changes from about 212 points to about 402 points. Where the sampling frequency is 44.1 kHz, this is equal to an audio signal frequency range of 110 to 208 Hz, which is therefore set as the cut-off frequency range.

At next step 144, the operations of steps 141 and 142 are repeated using the cut-off frequency range newly set at step 143. Namely, in the above-mentioned case, the cycle reference point detection operation of step 141 and the waveform comparison operation of step 142 are repeated using the cut-off frequency range of 110 to 208 Hz. By so doing, low-frequency and harmonic components that would cause dissimilarities or differences can be effectively cut off to thereby provide an enhanced detection accuracy and hence more accurate same-waveform sections than the previously detected sections. As a result of the same-waveform detection operation of step 144, the sound waveform of FIG. 38A is divided into three sections X, Y and Z with continuity of sections X and Y broken by section Y as shown in FIG. 41B; in the illustrated example FIG. 41B, the continuity is broken at similar points on the plus and minus sides of the sound waveform.

Figure 42A:
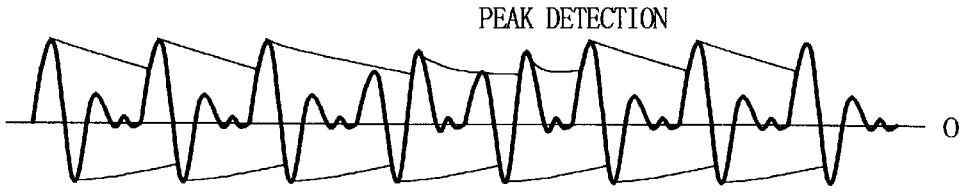
FIGS. 42A to 42C are conceptual diagrams showing an exemplary manner in which detection of peak points in another sound waveform within an available section is carried out as an example of the reference period position detection operation shown in FIG. 33.
Figure 42B:
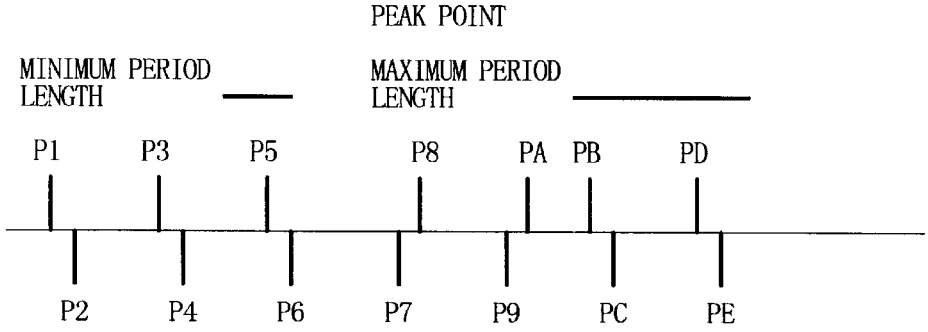
Figure 42C:
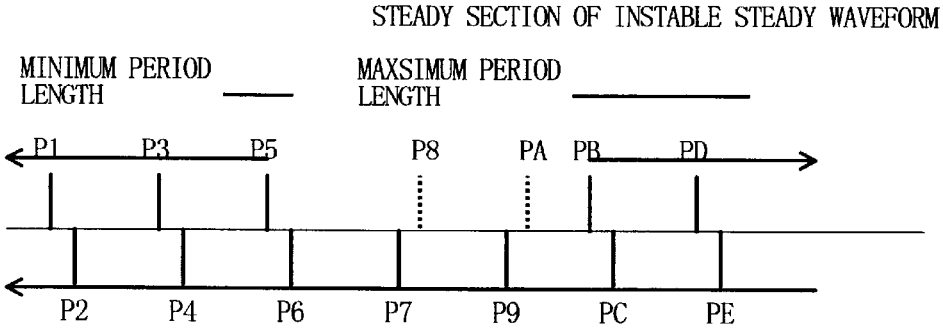

In the sound waveform shown in FIG. 42A, the fourth and fifth cycles have somewhat less fundamental frequency components than other cycles and plus-side peaks can not be properly detected in the two cycles, so that peak points of the sound waveform are detected as shown in FIG. 42B. Thus, when the operations of steps 141 to 144 are carried out on the sound waveform of FIG. 42A, peak regularity is lost only on the plus side between peak points P5 and PB. But, in general, the fundamental frequency component does appear distinctly on either the plus side or the minus side, and thus the sound waveform of FIG. 42A can be identified, on the minus side, as same-waveform sections in a proper manner. Therefore, if the difference rate calculated in the waveform comparison operation of step 42C is within a predetermined allowance, the steady section will be determined as having a range as denoted in FIG. 42C by an arrow on the minus side, and the regularity-broken region on the plus side will be identified as an error. However, because the fundamental frequency component in sound waveforms may be disturbed on both the plus and minus sides, the present embodiment is arranged to perform a steady-section superposition operation at step 146, as will be described later.

Figure 43A:
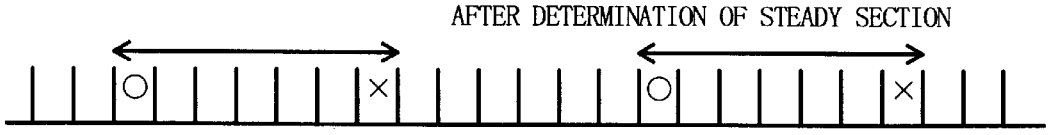
FIGS. 43A and 43B are diagrams explanatory of an exemplary manner in which a steady section expansion operation of FIG. 33 is carried out.
Figure 43B:
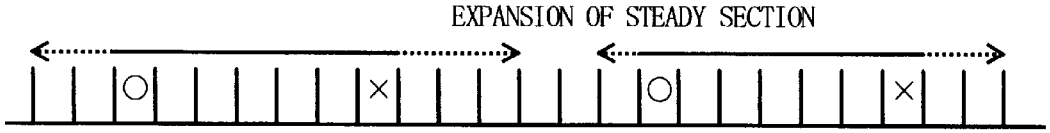

If the two sections denoted in FIG. 43A by oppositely-directed arrows are determined as same-waveform sections through the operations up to step 144, these sections are expanded at step 145 of FIG. 33. Namely, at step 145, the two signal sections are expanded after calculating a difference rate between the sections in a similar manner to the waveform comparison of step 142, using their respective start regions (denoted in mark ○) and end regions (denoted in mark X) as basic signal sections and sections located to opposite sides of each of the basic signal sections as transitive sections. At that time, the two signal sections can be expanded as shown in FIG. 43B by dotted lines by setting a threshold value of the difference rate higher than that used at step 142. However, the expansion operation is terminated once the sections have been expanded to overlap each other. The thus-expanded same-waveform signal sections become steady sections on both the plus and minus sides of the sound waveform.

Because the operations of steps 141 to 145 are carried out on both the plus and minus sides of the sound waveform, step 146 superposes the steady sections obtained independently on the two sides. Let's assume here that the steady sections on the plus and minus sides have been expanded to have ranges as denoted by double-head arrows through the operations up to step 145. By superposing the plus- and minus-side steady sections on each other, final steady sections are provided as denoted in FIG. 44B by hatched rectangular blocks. As shown, the five steady sections on each of the plus- and minus-side steady sections are formed into four final steady sections as a result of the steady-section superposition operations of step 146.

At step 147 of FIG. 33, an operation is carried out to subdivide each of the steady sections, identified through the operations up to step 146, sin accordance with variations in tone pitch and pressure. In the steady section detection operations up to step 146, even a pitch change in the sound waveform of successive vowels, such as "a a", is detected as a single sound because signal sections are compared after expansion as noted above. Thus, it would sometimes be impossible to detect a pitch change in a waveform of a given sustain tone generated by a musical instrument. To avoid such an inconvenience, the present embodiment is arranged to examine tone pitch changes in each of the steady sections, so as to determine, from the tone pitch changes, whether or not the steady section needs to be subdivided; if so, the steady section is divided into smaller steady sections.

For example, a distance between adjacent reference cycle points of a given steady section is calculated and the distance is divided by the sampling frequency to thereby evaluate a frequency at the reference cycle points. FIG. 45A shows frequency values of various waveforms forming the steady sections, as well as relative values, i.e., note distances that may be obtained by evaluating a difference or ratio between frequencies of the current and preceding sections and expressing the absolute value of the thus-evaluated difference in numerical values along a note-corresponding linear axis. Here, the note distance in this case is without a plus or minus sign and may be calculated from $$\log(f_1/f_0)/\log(\sqrt[12]{2})$$

where $f_1$ is a frequency to be compared, $f_0$ is a basic frequency of comparison, and $(\sqrt[12]{2})$ is the 12th root of 2.

If the calculated note distance is within a range of ±0.5, a determination is made that no sudden tone pitch change has occurred. But, if the calculated note distance is not within the range of ±0.5, a determination is made that a sudden tone pitch change has occurred, so that the steady section is subdivided using that pitch-changed region as a break of the section. Namely, in the illustrated example FIG. 45A, 10th to 12th note distances of the steady section are all greater than 0.5 and it is determined that a sudden tone pitch change has occurred in these regions, so that the steady section is divided into the first to ninth sections and into the 13rd to 24th sections. This is equivalent to detecting sections of notes when there has been a pitch change with no tone color involved.

Next, detection is made of a region where a sudden sound pressure level change has occurred, and the steady section is subdivided at that region, because the same is true with sound pressure. FIG. 45B shows average sound pressure level values of various waveforms constituting the steady section, as well as amplification ratios between the average sound pressure level of each signal section and the average sound pressure level of the preceding section. The amplification ratio may be obtained from log (average level of preceding section/average sound pressure level of the current section)

If the amplification ratio is within a range of ±0.01, a determination is made that no sudden sound pressure change has occurred. But, if the calculated note distance is not within the range of ±0.01, a determination is made that a sudden sound pressure change has occurred, so that the steady section is subdivided using that sudden-sound-pressure-change region as a break of the section. In the illustrated example FIG. 45B, the 16th and 17th amplification ratios of the steady section are all greater than 0.01 and it is determined that a sudden sound pressure change has occurred at these regions, so that the steady section is divided into three initial subdivided sections. Then, in view of the fact that humans can perceive a sound having a minimum length of 0.01 to 0.1 sec., a minimum section length is determined, and each of the sections shorter than the minimum section length is linked to the succeeding section. Thus, the second initial subdivided section (denoted by mark ○) is linked to the third initial subdivided section, so that two subdivided sections are ultimately provided as shown to the right of the initial subdivided sections.

FIG. 46 is a diagram explanatory of the concept of the steady section detecting process of FIG. 33, in which available sections are those detected by the available section detecting process at step 13 of FIG. 32 (similar to FIG. 3) and same-waveform sections are those obtained by the operations of steps 141 to 146. Further, same-pitch sections are those obtained by subdividing the same-waveform sections at the sudden-pitch-change region at step 147, and same-sound-pressure sections are obtained by subdividing the same-pitch sections at the sudden-sound-pressure-change region.

Whereas the present embodiment has been described as subdividing the steady sections (same-waveform sections) on the basis of the note distances and amplification ratios, either or both of the subdivided results may be employed. In the case where both of the subdivided results may be employed, adjustment based on the minimum section length may be made in the above-mentioned manner. Further, one of the subdivision operations based on the note distances and amplification ratios may be carried out with priority over the other subdivision operation in such a manner that the other subdivision is executed only when no subdivision takes place as a result of the one subdivision operation.

In the pitch train determining process at step 16 of FIG. 32, an optimum tone pitch train is determined for each of the steady sections detected at step 15. Any one of pitch train determining process I to pitch train determining process IV shown in FIGS. 34 to 37 may be used as a specific example of the pitch train determining process of step 16.

Generally, in ultimately converting human voices or musical sounds into note information, melody would greatly vary depending on which tone pitches particular frequencies are rounded to, to such an extent that desired detection sometimes becomes impossible. Thus, the present embodiment is arranged to determine a tone pitch train by first determining tone pitches primarily on the basis of relative sounds and then selecting optimum tone pitch transition using a musical key.

Pitch train determining process I as a first example of the pitch train determining process will be described below, although its flow is somewhat similar to that of FIG. 6.

Step 151: A representative frequency is determined in each of the steady sections identified through the available section detecting process of step 13 (FIG. 32) and the steady section detecting process of step 15 (FIG. 32). FIG. 46A illustrates an example set of the ultimately identified steady sections (e.g., 12 steady sections), to which bracketed section numbers [1] to [12] are allotted.

What is important in determining respective representative frequencies in the steady sections is to judge a frequency tendency from the period position in each of the individual steady section to thereby determine a single frequency unique to that steady section. A first preferred approach for this purpose may be to determine as its representative frequency an average frequency over the entire steady section, a second preferred approach may be to determine as its representative frequency a frequency in the approximate middle point of the steady section, and a third preferred approach may be to determine as its representative frequency an average frequency in stable-pitch regions of the steady section. According to the present embodiment, the representative frequency is calculated using the difference rate computed in the steady section detecting process. More specifically, using the same-waveform section detection prior to the steady section expansion of step 145 of FIG. 33, an average is calculated of the frequencies in stable steady section having a succession of difference rates less than a predetermined value (e.g., 10), so as to determine the calculated average as a representative frequency of that steady section.

Let's assume here that the same-waveform section detection operation of step 144 of FIG. 33 has detected steady sections by every judging adjacent signal sections to be same-waveform sections if the difference rate therebetween is less than 10, and also that the detected steady sections consist of waveform segments as shown in FIG. 47B prior to the steady section expansion operation. Namely, the detected steady sections consists of 12 waveform segments having difference rates less than 10. Period lengths and difference rates of the individual waveform segments are as shown in FIG. 47B, and an average period length in this steady section is 255.833. Because the period lengths are expressed in terms of the number of samples, a representative frequency of the steady section is evaluated by dividing the sampling frequency (44.1 kHz) by the average period length; in the illustrated example FIG. 47B, the representative frequency of the steady section is 172.38 Hz. In this case, the value of the representative frequency is treated as effective down to two decimal places. FIG. 47C shows the thus-calculated representative frequencies of the steady sections as shown in FIG. 47A.

Step 152 of FIG. 34, which is similar to step 62 of FIG. 6, determines, on the basis of the representative frequencies of the individual steady sections determined at step 151, a note distance between every adjacent steady sections, using the same mathematical expression as used at step 147 of FIG. 33. FIG. 47C also shows an example set of the thus-calculated note distances.

Steps 153, 154, 155 of FIG. 34 are similar to steps 63, 64, 65, and details of FIG. 47C showing an example of the pitch train determination at these steps are also similar to those of FIG. 19C. This step rounds the calculated note distances to whole numbers as to round the note distances to musical interval data, expressed in semitones (i.e., relative note values).

Next, a description will be made about pitch train determining process II in accordance with a step sequence flowcharted in FIG. 35. In this pitch train determining process II, steps 161 and 162 are similar to steps 151 and 152 of FIG. 34, and hence the following paragraphs describe operations at and after step 163.

Step 163: Using the calculated ne-to-note distances, an operation is carried out to sum up note assignment differences after the distances are rounded to respective notes on a plurality of scales. Namely, the present embodiment calculates degrees of conformity after the note distances are rounded to respective notes in three different scales, natural scale, harmonic scale and melodic scale. As shown in FIG. 48, the natural scale comprises assignable tones sequentially arranged in order of "whole tone", "semitone", "whole tone", "whole tone", "semitone", "whole tone" and "semitone". The harmonic scale comprises assignable notes sequentially arranged in order of "whole tone", "semitone", "whole tone", "whole tone", "semitone", "three-semitone (a whole tone +one semitone)" and "semitone". The melodic scale comprises notes sequentially arranged in order of "whole tone", "semitone", "whole tone", "whole tone", "whole tone", "whole tone" and "semitone" assignable when ascending, and notes sequentially arranged in the same order as in the natural scale. In FIG. 48, mark ○ denotes a tone usable as a component of the scale, while mark X denotes a tone unusable as a component note of the scale.

For each of the scales shown in FIG. 48, tones are sequentially assigned to each of the steady section numbers in such a manner that no tone denoted by the X mark is selected, assuming that the first tone has started with a pitch denoted by the ○ mark. Then, pitch differences between the tones of the steady section numbers and the assigned tones, i.e., note assignment differences are calculated and totalled.

More specifically, in such an example where the note distances are represented in tone pitch data as shown in FIG. 47C, steady section numbers [0] to [5] are set to the natural scale of FIG. 48. Because the tone of steady section number [0] is the first one, it is set to note position (0) of the natural scale of FIG. 48. The tone of next steady section number [1] is at the note distance of 1.7158 from the tone of steady section number [0], a semitone or two semitone should be selected as a note distance; however, because the note at a semitone note distance is non-selectable (denoted by the X mark) in the natural scale, steady section number [1] is set to a note at a two-semitone (i.e, one whole-tone) note distance, i.e, note position (2). Now that the note of the 1.7158 note distance has been set to note position (2), the note assignment difference for the note of section [1] is equal to a difference between the actually-set note distance "2" to note position (2) and the note distance 1.7158 for steady section number [1], which is 0.2842.

The tone of further next steady section number [2] is at the note distance of 2.1557 from the tone of steady section number [1], a whole or three semitone (a whole tone plus a semitone) is selected as a note distance. Because the tone of steady section number [1] has been set to note position (2) in the preceding operation, the tone of tone of steady section number [2] is set to note position (4) or (5) at a note distance equal to a whole tone or three semitone (a whole tone plus a semitone). Because the note at note position (4) is non-selectable (denoted by the X mark) in the natural scale, the tone of steady section number [2] is set to note position (5). Thus, the note at the 2.155 note distance is set to note position (5) corresponding to a note distance of 3, so that the note assignment difference for the tone of section number [2] becomes 0.8443. As a consequence, the total of the note assignment differences for section number [1] and section number [2] is 0.2842+0.84443=1.1285.

The above-mentioned operation is repeated form the remaining steady section numbers [3] to [5] so as to thereby calculate a total value of the note assignment differences, which in this case is 2.233. This is a total value of the note assignment differences when note position (0) of the natural scale is assumed to be a start tone. Thus, similar calculations of the note assignment difference total are carried out for other note positions (2), (3), (5), (7), (9) and (10) of the natural scale, as well as predetermined note positions of the harmonic and melodic scales.

FIG. 49A shows totalled values of the note assignment differences, for the individual scales, with the individual note positions as starting notes.

Step 164: A cumulative total is calculated of those of the note assignment differences which are greater than 0.5. Namely, whereas step 163 has evaluated a total value of all the note assignment differences, this step sums up only those note assignment differences that are greater in value than 0.5, for the following reasons. Although rounding steady note numbers [1] and [2] to positions of note distances (2) and (3), respectively, is ideal for minimized note assignment difference, there are some unassignable notes in the scales as noted earlier, and the assignment has to be modified to other tone pitches than those closest to the note distances. Thus, in such a case, the note assignment differences greater than 0.5 are totalled as note modification differences, as shown in FIG. 49B corresponding to FIG. 49A.

Step 165: This step finds the number of notes each having a note assignment difference greater than 0.5, i.e., the total numbers of the notes used in the calculation step 164. FIG. 49C shows the thus-found total numbers, similarly to FIG. 49B.

Step 166: Using the results of the operations at steps 163 to 165, i.e., the calculated results of FIGS. 49A to 49C, this step determines an optimum scale and its beginning note. To this end, there may be employed one of the scales and beginning notes for which the totalled values of the note assignment differences greater than 0.5 is the smallest or the total numbers of the notes having a note assignment difference greater than 0.5 is the smallest, or an optional combination of these. However, the ultimately determined scale and beginning note are not necessarily a single scale and beginning note due to related keys; in such a case, any of possible approaches may be selected because they all provide a same melody transition.

In the illustrated example of FIG. 49A, the smallest value of the totalled note assignment differences is 1.688, which occurs at a total of four note positions in the three scales: two note positions in the natural scale; one note position in the harmonic scale; and one note position in the melodic scale. Then, this step finds the totalled value of the note assignment differences greater than 0.5 at the four note positions, which is 0.891 at each of the four note positions. Therefore, any one of the four note positions may be chosen. In this embodiment, priority is given to one of the three scales shown uppermost in the figures and one of the note positions shown leftmost. Thus, ultimately, the natural scale is selected and the beginning note is set to the third note. The scales are described and shown in FIG. 49A to 49C as minor scales, and the beginning third note in the natural minor scale is equivalent to the first note (tonic) in the natural major scale.

Step 167: On the basis of the scale and beginning note determined at preceding step 166, a note assignment difference calculation operation similar to the above-described is carried out to determine a train of tone pitches. FIG. 49D shows such a train of tone pitches "0-2-4-5-2-4" allocated to the steady section numbers, which differs from the tone pitches "0-2-4-5-2-3" of FIG. 49C; that is, the tone pitch of steady section number [5] is "4" rather than "3".

Because pitch train determining process II of FIG. 35 is arranged to round tones using a scale in such a manner that instable tones are rounded to scale notes, it is very likely that the rounded tones result in a relatively stable melody and hence approaches user-desired tones. However, in the event that an acoustically-trained user inputs a melody while intentionally deviating input tones from the scale component notes, then the above-mentioned operation of rounding tones to the scale component notes is not very suitable. Although there may arise a situation where the quality of the melody is ultimately determined, such a determination can not be properly made by the current technology. Therefore, it may be sufficient that the input tones be rounded while taking a scale into account as in pitch train determining process II of FIG. 35 and only particular input tones other than the scale component notes be assigned.

Specifically, in the present embodiment, such particular input tones other than the scale component notes are rounded to the scale component notes as long as their note distances from the scale component notes are less than a predetermined value. This can be said to be an intermediate tone rounding operation between pitch train determining process I of FIG. 34 pitch train determining process II of FIG. 35.

After pitch train determining process II of FIG. 35 has determined the third note of the natural scale as the beginning note, i.e., after the operation of step 166, an operation is carried out to determine a note difference allowance. This operation may be either by presetting a constant value, such as 0.2, as a note difference allowance or by arithmetically calculating a note difference allowance. In the latter case, an average may be calculated of the note distances of the input tones having been rounded, through the operation of step 163 to be less than 0.5 so as to find a pitch deviating tendency of a person producing voices, and then a predetermined multiple of the thus-calculated average may be set as a note difference allowance.

The following paragraphs describe what sorts of pitch train are allocated to the individual steady sections shown in FIG. 47C, in relation to a case where the constant value of 0.2 is used as a note difference allowance. Now that the operation of step 166 in FIG. 35 determines the third note of the natural scale as the beginning note and the note distance for steady section number [1] is 1.7158, the closest tone pitch is four degree, i.e., note of note position (5). In this case, the note of note position (5) is selected because it can be safely rounded to the closest tone pitch.

Similar operation is then performed for steady section numbers "2", "3" and "4" to sequentially determine note positions (7), (8) and (5) as notes in the scale. For steady section number [5], however, note position (6) is set as the closest tone pitch now that steady section number [4] has been set to note position (5). Pitch of note position (6) is other than the component notes of the scale. Thus, a determination is made as to whether or not it is within the note difference allowance. Because in this case, the note distance is 1.1093 and the note difference is 0.1093 which is smaller than the note difference allowance of 0.2, the note of note position (6) is selected although it is other than the component notes of the scale.

In case the note distance for steady section number [5] is, for example, 1.2093, the note difference will be 0.2093 which is greater than the note difference allowance of 0.2, and hence the note of note position (7) higher than note position (6) is selected.

By thus setting a note difference allowance and allowing non-scale-component notes to be added to pitches, it is possible to determine a pitch train, conforming to a melody imaged and sung by a given person while using a scale. Next, a description will be made about pitch train determining process III in accordance with a step sequence flowcharted in FIG. 36. Whereas pitch train determining process I and pitch train determining process II have been described above as determining a pitch train on the basis of note distances between adjacent tones, this pitch train determining process III is arranged to detect a phrase and determine a pitch train in consideration of a difference between pitches of a first tone and each succeeding tone in the phrase, because in effect the pitch of each tone in a phrase can not be determined only on the basis of a note difference from that of a preceding tone and tones forming a flow or pitch train of the phrase affect the beginning tone of the phrase.

Step 171: A determination is made as to how long each of the steady sections, identified by the steady section detecting process of FIG. 33, is in terms of the number of grids of time value. For steady sections as shown at (A) in FIG. 50, time value references are created as shown at (B) in FIG. 50 using a head-to-head length of ever adjacent steady sections. Then, assuming that each time value grid is equivalent to several hundredths of a second, it is determined how many grids form the individual time value references.

Such grids for determining a time value train are shown at (C) in FIG. 50. The time value references shown at (B) are adjusted so as to positionally conform to the grids. Namely, if a boundary between the time value references is located between two adjacent grids, it is moved to positionally conform to a nearest one of the grids. In the event that the boundary between the time value references is located exactly at the midpoint between two adjacent grids, it is moved to positionally conform to a preceding one of the two grids. Time value sections shown at (D) in FIG. 50 are those time value references with their boundaries thus positionally adjusted. Same numbers as the steady section numbers are indicated immediately above the individual time value sections, and also respective numbers of the grids "4, 4, 5, 6, 3, 6, 11, 4, 7, 3, 5, 3, 10, . . . " are indicated immediately above the individual time value sections.

Step 172: Now that the lengths of the time value sections are each defined by the number of the grids as mentioned above, this step combines a plurality of the time value sections on the basis of the numbers of the grids, so as to create a single phrase. The phrase creating method is disclosed in Japanese Patent Application No. HEI 7-123105 filed earlier by the present assignee and hence will be described here only briefly.

Because each of the time value sections corresponds to a single note, an average is calculated of the lengths of the time value sections (average time-value-section length). By multiplying the average time-value-section length by a predetermined coefficient K greater than 1, such as "2", a first predetermined multiplied length is obtained. Then, detection is made of time value sections having a length greater than the thus-obtained first multiplied length, and partition data is attached to the end of each of the detected time value sections so that a phrase is formed by the detected time value section having the partition data attached thereto and other time value section preceding the same if any.

After that, for each of the thus-formed phrases, an average time-value-section length is calculated and then multiplied by a predetermined coefficient L greater than 1, such as "2", so as to obtain a second predetermined multiplied length. If the length of the last time value section in the phrase, i.e., the last time-value-section length, is smaller than the second predetermined multiplied length, the phrase partition data is deleted. In the event that the last time-value-section length is not smaller than the second predetermined multiplied length, the partition data deletion is not effected. The determination as to whether the partition data deletion should be effected or not is made for each of the phrases.

In the example shown at (D) in FIG. 50, the total number of the grids is 71 (4+4+5+6+3+6+11+4+7+3+5+3+10). The total number of grids is divided by the number of the time value sections (71÷13) to provide a value 5.46, which is then rounded off to nearest one so as to provide an average time-value-section length of "5". The average time-value-section length "5" is then multiplied by the predetermined coefficient "2" so as to provide "10" as the first predetermined multiplied length. In the illustrated example, time value section [6] and time value section [12] are greater in length than the first predetermined multiplied length "10", and thus partition data is added to the end of each of time value sections [6] and [12] so that two phrases are formed. As shown at (E) in FIG. 50, the first phrase consists of seven time value sections [0] to [6] and the second phrase consists of six time value sections [7] to [12].

Step 173 of FIG. 36 determines representative frequencies of the individual time value sections in each of the phrases determined at preceding step 172. Because the time value sections correspond to the steady sections in pitch train determining process I of FIG. 33, this step determines representative frequencies in the same manner as at step 151.

Step 174 determines a note distance between a first tone of the phrase, i.e., the representative frequency of the first or leading time value section, and the representative frequency of each of the succeeding time value sections in the phrase. Whereas pitch train determining process I and pitch train determining process II have been described above as determining a note distance between adjacent steady sections, this step determines a note distance between the time value sections on the basis of the representative frequency of first time value section [0] in the phrase. FIG. 51 shows by way of example a set of representative frequencies of time value sections [0] to [6] in the first phrase, and note distances between first or leading time value section [0] and succeeding time value sections [1] to [6].

On the basis of the note distances calculated at preceding step 174, step 175 of FIG. 36 carries out operations, similar to those of steps 153 to 155 in pitch train determining process I or steps 163 to 166 in pitch train determining process II, to determine a predetermined tone pitch train.

Next, a description will be made about pitch train determining process IV in accordance with a step sequence flowcharted in FIG. 37. Whereas pitch train determining process III has been described above as determining a pitch train on the basis of the calculated note distances between the first tone of the phrase, i.e., a tone of the first steady section of the phrase, and tones of the succeeding steady sections of the phrase, this pitch train determining process IV is arranged to determine a tone pitch train in consideration of relationship between a current tone and other tones sounded prior to the current tone in each detected phrase, because the.current tone may be affected not only by the first tone but also other tones having been sounded prior to the current tone in the phrase.

In pitch train determining process III, operations of steps 181 to 183 are similar to those of steps 171 to 173 of FIG. 36 and will not be described here to avoid unnecessary duplication.

Step 184 determines a note distance of each time value section from every other tone preceding the same. For the illustrated example of FIG. 50, note distances are first determined in the first phrase. For time value section [0], no note distance is determined because there is no preceding tone. For time value section [1], time value section [0] is a preceding tone, and 1.7158 is determined as its note distance from the preceding tone. For time value section [2], time value sections : [0] and [1] are preceding tones, and 3.8715 and 2.1557 are determined as its note distances from these two preceding tones, respectively. Then, note distances of the succeeding time value sections from preceding tones are calculated in a similar manner, and FIG. 52A shows the thus-calculated note distances.

Step 185 weights the time value sections on the basis of their time distances from the preceding tones. FIG. 52B shows time distances calculated for the first phrase shown in FIG. 50. For time value section [0], no time distance is calculated because there is no preceding tone. For time value section [1], time value section [0] is a preceding tone, and a value corresponding to 4 grids is determined as its time distance from the preceding tone. For time value section [2], time value sections [0] and [1] are preceding tones, and values corresponding to 8 and 4 grids are determined as its time note distances from these two preceding tones, respectively. Then, time distances of the succeeding time value sections from preceding tones are calculated in a similar manner, and FIG. 52B shows the thus-calculated time distances.

Then, weights for the time value sections are determined on the basis of the time distances. In this embodiment, the weight for each of the time value sections is calculated by dividing every time distance of the time value section by the section's total time distance and normalizing the sum of the division result in such a manner that it takes a value of 100. For example, time value section [2] shown in FIG. 52B has 8-grid and 4-grid time distances, each of which is divided by the total time distance of "12", so that the divided results "$8/12=2/3$" and "$4/12=1/3$" are obtained. Then, the reciprocals of the divided results are summed (3/2+3/1) and the resultant sum is normalized, by multiplying it by 200/9, to take the value of 100. As a result, a value of 33.3 is obtained as the weight of time value section [2] relative to time value section [0], and a value of 66.7 is obtained as the weight of time value section [2] relative to time value section [1]. In this way, the time value sections are weighted on the basis of the time distances. FIG. 52C shows an example set of the weights calculated on the basis of the time distances of FIG. 52B.

At step 186 of FIG. 37, an operation is carried out to round the tones of the individual time value sections to notes in a twelve-note scale or a predetermined scale on the basis of the weights calculated by the operation of preceding step 185. The rounding of the tones to the notes in the twelve-note scale may be performed in a similar manner to steps 163 to 166 of FIG. 35, with reference to the weights based on the time distances as the note distances. Specifically, in the example of FIG. 52C, the note distance "1.7158" is used for time value section [0] because time value section [0] is the only preceding tone, so that a note higher than time value section [0] by a whole tone is selected as a musical interval closest to the note distance "1.7158".

The tone of time value section [2] is affected by time value section [0] with the 33.3% weight and is also affected by time value section [1] with the 66.7% weight. Now that "2" has already been determined as the note distance from time value section [0], the note distance "2" is subtracted from the note distance "3.8715" between time value sections [0] and [2], to provide a value of "1.8715". On the other hand, the note distance between time value sections [2] and [1] is 2.1557. Thus, the note distance for time value section [2] may be calculated in consideration of the weight as follows:

$$(1.8715\times33.3+2.1577\times66.6)/100=2.06$$

Thus, the note distance for time value section [2] is set to "2.06". Then, the operation for rounding of the tones to the notes in the twelve-note scale (similar to the operations of steps 153 to 155 of FIG. 34) or in the predetermined scale (similar to the operations of steps 163 to 166 of FIG. 35) is carried out using the note distance is set to "2.06".

In summary, the sound signal analyzing device according to one aspect of the present invention affords the benefit that even when an input sound from a microphone or the like fluctuates slightly in pitch or level, it can effectively analyze each steady section of the input sound other than the fluctuating section, i.e., section corresponding to a note.

The sound signal analyzing device according to another aspect of the present invention affords the benefit that even when an input sound from a microphone or the like fluctuates slightly in pitch or level, it can readily analyze each signal section or available section where a musical sound is actually present.

Further, the performance information generating device according to still another aspect of the present invention affords the benefit that even when an input sound from a microphone or the like fluctuates slightly in pitch or level, it can reliably generate accurate note information corresponding to the pitch of the input sound.

What is claimed is:

1. A sound signal analyzing device comprising:

an input unit that inputs a sound signal to said sound signal analyzing device;

a waveform creating unit that detects a maximum value of every predetermined number of sample amplitude values of the sound signal inputted via said input unit and creates an auxiliary waveform by interpolating between the detected maximum values;

a first section detecting unit that, on the basis of the auxiliary waveform created by said waveform creating unit, detects an available section of the inputted sound signal where there appears to be a musical sound; and a second section detecting unit that, on the basis of the sample amplitude values within said first section, detects second sections of the inputted sound signal from said first section for subsequent analysis of the sound signal.

2. A sound signal analyzing device as recited in claim 1 wherein said second section detecting unit detects said second section by:

detecting maximum values of the sample amplitude values of the inputted sound signal by performing envelope detection on the sample amplitude values in opposite directions;

interpolating between the detected maximum values to obtain a maximum-value interpolation curve;

evaluating inclinations at individual sample points on the basis of the maximum-value interpolation curve and, for each individual sample point, adding the inclination at the individual sample point with the inclinations at a plurality of other sample points to obtain a total inclination for the individual sample point; and detecting, as a stable-level section, a signal section over some of the sample points where the total inclinations are smaller than a predetermined value and then expanding the stable-level section.

3. A sound signal analyzing device as recited in claim 1 which further comprises:

a provisional-periodic-reference-point detecting unit that detects a plurality of provisional periodic reference points of the sound signal forming said second section;

a pitch data train generating unit that detects pitches of the inputted sound signal at the provisional periodic reference points detected by said provisional-periodic-reference-point detecting unit and generates a pitch data train indicative of the detected pitches of the inputted sound signal;

a filtering unit that performs, on the inputted sound signal, a filtering operation where pass band is controlled to vary over time in accordance with frequencies corresponding to the detected pitches in the pitch data train;

a periodic-reference-point detecting unit that detects a plurality of periodic reference points of the sound signal outputted from said filtering unit;

a same-waveform-section detecting unit that determines degrees of similarity in waveform between every adjacent signal sections of the inputted sound signal corresponding to the periodic reference points detected by said periodic-reference-point detecting unit and links together those of the signal sections having a high degree of similarity to thereby detect same-waveform sections of the inputted sound signal; and a steady section determining unit that determines a steady section of the inputted sound signal on the basis of the same-waveform sections detected by said same-waveform-section detecting unit.

4. A sound signal analyzing device as recited in claim 1 which further comprises:

a provisional-periodic-reference-point detecting unit that detects a plurality of provisional periodic reference points of the inputted sound signal forming said second section;

a pitch data train generating unit that detects pitches of the inputted sound signal at the provisional periodic reference points detected by said provisional-periodic-reference-point detecting unit and generates a pitch data train indicative of the detected pitches of the inputted sound signal;

a filtering unit that performs, on the inputted sound signal, a filtering operation where pass band is controlled to vary over time in accordance with frequencies corresponding to the detected pitches in the pitch data train;

a periodic-reference-point detecting unit that detects a plurality of periodic reference points of the sound signal outputted from said filtering unit;

a voiced-sound-containing section detecting unit that determines degrees of similarity in waveform between every adjacent signal sections of the inputted sound signal corresponding to the periodic reference points detected by said periodic-reference-point detecting unit and detects a voiced-sound-containing section of the inputted sound signal on the basis of the degree of similarity; and a steady section determining unit that sequentially calculates degrees of similarity in waveform between a high-similarity basic signal section within the voiced-sound-containing section and other signal sections located to opposite sides of the basic signal section and determines a steady section of the inputted sound signal on the basis of the degrees of similarity.

5. A sound signal analyzing device as recited in claim 1 which further comprises a note analyzing unit that analyzes a representative frequency of the inputted sound signal in said second section detected by said second section detecting unit and thereby determines a note of the inputted sound signal.

6. A sound signal analyzing device comprising:

an input unit that inputs a sound signal to said sound signal analyzing device;

an arithmetic operating unit that calculates an average of every predetermined number of sample amplitude values of the sound signal inputted via said input unit and outputs respective said averages as a time-series of average level information;

a first section detecting unit that, on the basis of the average level information outputted from said arithmetic operating unit, detects a first section of the inputted sound signal where there appears to be a musical sound; and a second section detecting unit that, on the basis of the sample amplitude values within said first section, detects second sections of the inputted sound signal from said first section for subsequent analysis of the sound signal.

7. A sound signal analyzing device as recited in claim 6 which further comprises a note analyzing unit that analyzes a representative frequency of the inputted sound signal in said second section detected by said second section detecting unit and thereby determines a note of the inputted sound signal.

8. A sound signal analyzing device comprising:

an input unit that inputs a sound signal to said sound signal analyzing device;

a first pitch detecting unit that detects a pitch of the sound signal, inputted via said input unit, for every predetermined signal section and generates a pitch data train indicative of the detected pitches of the inputted sound signal;

a filtering unit that performs, on the inputted sound signal, a filtering operation where pass band is controlled to vary over time in accordance with frequencies corresponding to the detected pitches in the pitch data train; and a determining unit that determines degrees of similarity in waveform between every adjacent signal sections on the basis of successive sample amplitude values of the inputted sound signal having undergone the filtering operation;

a section detecting unit that detects, as same-waveform sections, those of the signal sections having waveforms determined by said determining unit as being similar within a range corresponding to a predetermined condition; and a second pitch detecting unit that detects a pitch of the sound signal within the same-waveform sections detected by said section detecting unit.

9. A sound signal analyzing device as recited in claim 8 wherein said first pitch detecting unit includes:

a provisional-periodic-reference-point detecting unit that detects a plurality of provisional periodic reference points of the sound signal inputted via said input unit; and a pitch data train generating unit that detects pitches of the inputted sound signal at the provisional periodic reference points detected by said provisional-periodic-reference-point detecting unit and generates a pitch data train indicative of the detected pitches of the inputted sound signal, said pitch data train generating unit interpolating between pitch data of the inputted sound signal determined at individual ones of the provisional periodic reference points, so as to detect the pitches and generate a data train of the detected pitches of the inputted sound signal.

10. A sound signal analyzing device as recited in claim 8 wherein said first pitch detecting unit includes:

a provisional-periodic-reference-point detecting unit that detects a plurality of provisional periodic reference points of the sound signal inputted via said input unit; and a pitch data train generating unit that detects pitches of the inputted sound signal at the provisional periodic reference points detected by said provisional-periodic-reference-point detecting unit and generates a pitch data train indicative of the detected pitches of the inputted sound signal, and wherein said provisional-periodic-reference-point detecting unit detects, as the provisional periodic reference points, peak points of the inputted sound signal by focusing on one of plus and minus amplitude sides of a waveform of the inputted sound signal where stronger peaks appear than on another of the plus and minus amplitude sides.

11. A sound signal analyzing device as recited in claim 8 wherein said first pitch detecting unit includes:

a periodic-reference-point detecting unit that detects a plurality of periodic reference points of the sound signal inputted via said input unit; and a pitch data train generating unit that detects pitches of the inputted sound signal at the periodic reference points detected by said periodic-reference-point detecting unit and generates a pitch data train indicative of the detected pitches of the inputted sound signal, and wherein said periodic-reference-point detecting unit detects, as the periodic reference points, peak points of the inputted sound signal by focusing on one of plus and minus amplitude sides of a waveform of the inputted sound signal where stronger peaks appear than on another of the plus and minus amplitude sides.

12. A sound signal analyzing device as recited in claim 8 wherein said first pitch detecting unit includes:

a provisional-periodic-reference-point detecting unit that detects a plurality of provisional periodic reference points of the sound signal inputted via said input unit; and a pitch data train generating unit that detects pitches of the inputted sound signal at the provisional periodic reference points detected by said provisional-periodic-reference-point detecting unit and generates a pitch data train indicative of the detected pitches of the inputted sound signal, and wherein said provisional-periodic-reference-point detecting unit divides a waveform of the inputted sound signal into signal sections at predetermined intervals corresponding to the cutoff frequency used in the filtering operation, by focusing on one of plus and minus amplitude sides of a waveform of the inputted sound signal, having undergone the filtering operation, where stronger peaks appear than on another of the plus and minus amplitude sides, and said provisional-periodic-reference-point detecting unit detects a greatest peak within each of the signal sections as the periodic reference point.

13. A sound signal analyzing device comprising;

an input unit that inputs a sound signal to said sound signal analyzing device;

a first filtering unit that performs, on the sound signal inputted via said input unit, a band-pass filtering operation using predetermined cut-off frequencies as maximum and minimum frequencies;

a first periodic-reference-point detecting unit that detects a plurality of provisional periodic reference points of the sound signal outputted from said first filtering unit;

a frequency range detecting unit that detects the maximum and minimum frequencies of the inputted sound signal on the basis of the provisional periodic reference points detected by said first periodic-reference-point detecting unit;

a second filtering unit that performs, on the sound signal inputted via said input unit, a band-pass filtering operation using as cut-off frequencies the maximum and minimum frequencies detected by said frequency range detecting unit;

a second periodic-reference-point detecting unit that detects a plurality of periodic reference points of the sound signal outputted from said second filtering unit; and a pitch detecting unit that detects a pitch of the sound signal for each of said periodic reference points detected by said second periodic-reference-point detecting unit.

14. A sound signal analyzing device as recited in claim 8 which further comprises a note analyzing unit that analyzes a representative frequency of the inputted sound signal in the section detected by said section detecting unit and thereby determines a note of the inputted sound signal.

15. A sound signal analyzing device comprising:

an input unit that inputs a sound signal to said sound signal analyzing device;

a first pitch detecting unit that detects a pitch of the sound signal, inputted via said input unit, for every predetermined signal section and generates a pitch data train indicative of the detected pitches of the inputted sound signal;

a filtering unit that performs, on the inputted sound signal, a filtering operation where pass band is controlled to vary over time in accordance with frequencies corresponding to the detected pitches in the pitch data train; and a second pitch detecting unit that detects pitches of the inputted sound signal on the basis of sample amplitude values of the sound signal outputted from said filtering unit.

16. A sound signal analyzing device comprising:

an input unit that inputs a sound signal to said sound signal analyzing device;

a filtering unit that performs, on the sound signal inputted via said input unit, a filtering operation using a predetermined frequency range;

a determining unit that determines degrees of similarity in waveform between every adjacent signal sections on the basis of successive sample amplitude values of the inputted sound signal having undergone the filtering operation;

a section detecting unit that detects, as same-waveform sections, those of the signal sections having waveforms determined by said determining unit as being similar within a range corresponding to a predetermined condition; and a pitch detecting unit that detects a pitch of the sound signal within the same-waveform sections detected by said same-waveform-section detecting unit.

17. A sound signal analyzing device comprising:

an input unit that inputs a sound signal to said sound signal analyzing device;

pitch detecting unit that detects a pitch of the sound signal, inputted via said input unit, for every predetermined signal section and generates a pitch data train indicative of the detected pitches of the inputted sound signal;

a filtering unit that performs, on the inputted sound signal, a filtering operation where pass band is controlled to vary over time in accordance with frequencies corresponding to the detected pitches in the pitch data train;

a periodic-reference-point detecting unit that detects a plurality of periodic reference points of the sound signal outputted from said filtering unit;

a voiced-sound-containing section detecting unit that determines degrees of similarity in waveform between every adjacent signal sections of the inputted sound signal corresponding to the periodic reference points detected by said periodic-reference-point detecting unit and detects a voiced-sound-containing section of the inputted sound signal on the basis of the degree of similarity; and a steady section determining unit that sequentially calculates degrees of similarity in waveform between a high-similarity basic signal section within the voiced-sound-containing section and other signal sections located to opposite sides of the basic signal section and determines a steady section of the inputted sound signal on the basis of the degrees of similarity.

18. A sound signal analyzing device as recited in claim 17 which further comprises a note analyzing unit that analyzes a representative frequency of the inputted sound signal in the steady section determined by said steady section determining unit and thereby determines a note of the inputted sound signal.

19. A sound signal analyzing device comprising:

an input unit that inputs a sound signal to said sound signal analyzing device;

a stable section analyzing unit that determines a stable section of the sound signal, inputted via said input unit, for subsequent analysis of the sound signal;

pitch detecting unit that detects a pitch of the inputted sound signal forming the stable section and generates a pitch data train indicative of the detected pitches of the inputted sound signal;

a filtering unit that performs, on the inputted sound signal, a filtering operation where pass band is controlled to vary over time in accordance with frequencies corresponding to the detected pitches in the pitch data train;

a periodic-reference-point detecting unit that detects a plurality of periodic reference points of the sound signal outputted from said filtering unit;

a voiced-sound-containing section detecting unit that determines degrees of similarity in waveform between every adjacent signal sections of the inputted sound signal corresponding to the periodic reference points detected by said periodic-reference-point detecting unit and detects a voiced-sound-containing section of the inputted sound signal on the basis of the degree of similarity; and a steady section determining unit that sequentially calculates degrees of similarity in waveform between a high-similarity basic signal section within the voiced-sound-containing section and other signal sections located to opposite sides of the basic signal section and determines a steady section of the inputted sound signal on the basis of the degrees of similarity.

20. A sound signal analyzing device comprising:

an input unit that inputs a sound signal to said sound signal analyzing device;

a filtering unit that performs, on the sound signal inputted via said input unit, a filtering operation using a predetermined bass band;

a peak point detecting unit that detects peak points in the inputted sound signal having undergone the filtering operation by said filtering unit;

a same-waveform-section detecting unit that, of signal sections obtained by dividing a waveform of the inputted sound signal at optional pairs of the peak points detected by said peak point detecting unit, selects as many pairs of adjacent signal sections as possible that meet a limit defined by the pass band of said filtering unit, said same-waveform-section detecting unit determining a degree of similarity in waveform between two signal sections in each of the selected pairs and detecting one of the selected pairs having a highest similarity as same-waveform sections; and a steady section determining unit that determines a steady section of the inputted sound signal on the basis of the same-waveform sections detected by said same-waveform section detecting unit.

21. A sound signal analyzing device as recited in claim 20 which further comprises a note analyzing unit that analyzes a representative frequency of the inputted sound signal in the steady section determined by said steady section determining unit and thereby determines a note of the inputted sound signal.

22. A sound signal analyzing device comprising:

an input unit that inputs a sound signal to said sound signal analyzing device;

a peak point detecting unit that detects peak points in the sound signal inputted via said input unit;

a first same-waveform-section detecting unit that, of signal sections obtained by dividing a waveform of the inputted sound signal at optional pairs of the peak points detected by said peak point detecting unit, determines degrees of similarity in waveform between every two said signal sections and links together those of the signal sections having a high similarity so as to detect a first same-waveform section group;

a second same-waveform-section detecting unit that, using leading and last signal sections in said first same-waveform section group as a basis of comparison, calculates degrees of similarity in waveform between said first same-waveform section group and other signal sections adjoining said leading and last signal sections and expands said first same-waveform section group to incorporate one or more of the other signal sections depending on the calculated degrees of similarity, said second same-waveform-section detecting unit detecting the expanded first same-waveform section group as a second same-waveform section group; and a steady section determining unit that determines a steady section of the inputted sound signal on the basis of said second same-waveform section group detected by said second same-waveform-section detecting unit.

23. A sound signal analyzing device as recited in claim 22 wherein if there is any gap signal section that does not belong to either of adjacent said second same-waveform sections, degrees of similarity in waveform are evaluated between said last signal section of a preceding one of said adjacent second same-waveform sections and the gap signal section and between said leading signal section of a succeeding one of said adjacent second same-waveform sections and the gap signal section, and the gap signal section is incorporated into one of said adjacent second same-waveform sections to which the gap signal section has a higher degrees of similarity in waveform.

24. A sound signal analyzing device as recited in claim 22 which further comprises a note analyzing unit that analyzes a representative frequency of the inputted sound signal in the steady section determined by said steady section determining unit and thereby determines a note of the inputted sound signal.

25. A sound signal analyzing device comprising:

an input unit that inputs a sound signal to said sound signal analyzing device;

pitch detecting unit that detects a pitch of the sound signal, inputted via said input unit, for every predetermined signal section and generates a pitch data train indicative of the detected pitches of the inputted sound signal;

a first filtering unit that performs, on the inputted sound signal, a filtering operation where pass band is controlled to vary over time in accordance with frequencies corresponding to the detected pitches in the pitch data train;

a periodic-reference-point detecting unit that detects a plurality of periodic reference points of the sound signal outputted from said first filtering unit;

a second filtering unit that performs, on the inputted sound signal, a filtering operation where pass band or bands is controlled to vary over time in accordance with frequencies corresponding to the detected pitches in the pitch data train and integer multiples of the frequencies;

a same-waveform-section detecting unit that determines degrees of similarity in waveform between every adjacent signal sections obtained by dividing the sound signal waveform outputted from said second filtering unit and links together those of the signal sections having a high similarity so as to detect same-waveform sections of the inputted sound signal; and a steady section determining unit that determines a steady section of the inputted sound signal on the basis of the same-waveform sections detected by said same-waveform-section detecting unit.

26. A sound signal analyzing device as recited in claim 25 which further comprises a note analyzing unit that analyzes a representative frequency of the inputted sound signal in the steady section determined by said steady section determining unit and thereby determines a note of the inputted sound signal.

27. A sound signal analyzing device comprising:

a supplying unit that supplies successive sample amplitude values of a sound signal;

a first filtering unit that performs, on the successive sample amplitude values supplied by said supplying unit, a first filtering operation in accordance with a predetermined frequency characteristic;

a control data creating unit that create control frequency data for a second filtering operation on the basis of the successive sample amplitude values having undergone said first filtering operation;

a second filtering unit that performs, on the supplied successive sample amplitude values, a second filtering operation in accordance with a frequency characteristic based on the control frequency data created by said control data creating unit; and a pitch detecting unit that detect a pitch of the sound signal on the basis of the successive sample amplitude values having undergone said second filtering operation.

28. A sound signal analyzing device comprising:

an input unit that inputs a sound signal to said sound signal analyzing device;

pitch detecting unit that detects a pitch of the sound signal, inputted via said input unit, for every predetermined signal section and generates a pitch data train indicative of the detected pitches of the inputted sound signal;

a converting unit that converts differences between every adjacent ones of the pitches in the pitch data train into respective relative values based on musical interval representation in cents;

a dynamic reference calculating unit that calculates dynamic reference values on the basis of dynamic averages of the relative values obtained by said converting unit; and a steady section determining unit that detects a stable-pitch steady section by comparing the relative values and the dynamic reference values calculated by said dynamic reference calculating unit.

29. A sound signal analyzing device as recited in claim 28 wherein said dynamic reference calculating unit calculates the dynamic reference values using any one of a value obtained by multiplying the dynamic averages of the relative values by a predetermined value, a value obtained by adding the predetermined value to the dynamic averages of the relative values and a value obtained by adding the predetermined value to said value obtained by multiplying the dynamic averages of the relative values by the predetermined value.

30. A sound signal analyzing device as recited in claim 28 which further comprises a note analyzing unit that analyzes a representative frequency of the inputted sound signal in the steady section determined by said steady section determining unit and thereby determines a note of the inputted sound signal.

31. A sound signal analyzing device comprising:

an input unit that inputs to said sound signal analyzing device a sound signal comprising a time series of one or more notes;

a section detecting unit that detects, from the sound signal inputted via said input unit, signal sections appearing to correspond to a single note; and a unit that arranges the signal sections, detected by said section determining unit, on grids divided at time intervals corresponding to a predetermined note length in order of a time series thereof, said unit allotting each of the signal sections to one of the grids nearest to a start point thereof, and wherein if a plurality of the signal sections are simultaneously allotted to a particular one of the grids, one of the signal sections having a greatest time length is selected as valid.

32. A sound signal analyzing device comprising:

an input unit that inputs a sound signal to said sound signal analyzing device;

pitch detecting unit that detects a pitch of the sound signal, inputted via said input unit, for every predetermined signal section and generates a pitch data train indicative of the detected pitches of the inputted sound signal;

a converting unit that converts differences between every adjacent ones of the pitches in the pitch data train into respective relative values based on musical interval representation in cents;

a dynamic reference calculating unit that calculates dynamic reference values on the basis of dynamic averages of the relative values obtained by said converting unit;

a steady section determining unit that detects a stable-pitch steady section by comparing the relative values and the dynamic reference values calculated by said dynamic reference calculating unit;

a static reference calculating unit that calculates a static reference on the basis of a static average of the relative values within the steady section detected by said steady section determining unit;

a pitch-determining-section detecting unit that compares the static reference and the relative values within the steady section so as to detect a pitch determining section for calculating a representative frequency of the steady section; and a frequency calculating unit that calculates the representative frequency of the steady section on the basis of a pitch data train within the pitch determining section detected by said pitch-determining-section detecting unit.

33. A sound signal analyzing device as recited in claim 32 which further comprises a note analyzing unit that analyzes a representative frequency of the inputted sound signal in the steady section determined by said steady section determining unit and thereby determines a note of the inputted sound signal.

34. A performance information generating device comprising:

an input unit that inputs an optional sound signal to said performance information generating device;

a section analyzing unit that analyzes a signal section, of the sound signal inputted via said input unit, corresponding to a single note;

a frequency range determining unit that determines a representative frequency of each said signal section analyzed by said section analyzing unit;

a converting unit that converts a difference, in the representative frequency between a predetermined one of the analyzed signal section and every other said analyzed signal section, into a relative value based on musical interval representation in cents; and a note assigning unit that assigns respective notes of a predetermined scale to the analyzed signal sections on the basis of the corresponding musical interval data.

35. A sound signal analyzing device comprising:

an input unit that inputs a sound signal to said sound signal analyzing device;

an arithmetic operating unit that calculates an average of every predetermined number of sample amplitude values of the sound signal inputted via said input unit and outputs respective said averages as a time-series of average level information;

a section determining unit that determines each signal section of the inputted sound signal in which the average level calculated by said arithmetic operating unit is greater than a first predetermined value as an available section where there appears to be a musical sound, and determines each other signal section of the inputted sound signal where the average level calculated by said arithmetic operating unit is smaller than said first predetermined value as an unavailable section where there appears to be no musical sound;

an available section adding unit that if any particular one of the unavailable sections located between the available sections is of a time length smaller than a first predetermined length, changes the particular unavailable section into an additional available section and combines the additional available section and said available sections adjoining opposite sides of the additional available section, said available section adding unit determining a combination of the additional available section and adjoining available sections as a new available section;

a first unavailable section adding unit that if any particular one of the available sections located between the unavailable sections is of a time length smaller than a second predetermined length after determination by said available section adding unit, changes the particular available section into an additional unavailable section and combines the additional unavailable section and said unavailable sections adjoining opposite sides of the additional unavailable section, said first unavailable section adding unit determining a combination of the additional unavailable section and adjoining unavailable sections as a new unavailable section; and a second unavailable section adding unit that calculates an average of the average levels in each of the available sections after determination by said first unavailable section adding unit and that if the calculated average of any particular one of the available sections is smaller than a second predetermined value, changes the particular available section into an additional unavailable section.

36. A sound signal analyzing device comprising:

an input unit that inputs a sound signal to said sound signal analyzing device;

an arithmetic operating unit that calculates an average of every predetermined number of sample amplitude values of the sound signal inputted via said input unit and outputs respective said averages as a time-series of average level information;

a section determining unit that determines each signal section of the inputted sound signal where the average level calculated by said arithmetic operating unit is greater than a first predetermined value as an available section, determines each signal section of the inputted sound signal which is located between the available sections and where the average level calculated by said arithmetic operating unit is smaller than said first predetermined value as an unavailable section, and also determines each other signal section than the available and unavailable sections as an undetermined section;

an available section adding unit that if any particular one of the unavailable sections located between the available sections is of a time length smaller than a first predetermined length, changes the particular unavailable section into an additional available section and combines the additional available section and said available sections adjoining opposite sides of the additional available section, said available section adding unit determining a combination of the additional available section and adjoining available sections as a new available section;

a first unavailable section adding unit that if any particular one of the available sections located between the unavailable sections is of a time length smaller than a second predetermined length after determination by said available section adding unit, changes the particular available section into an additional unavailable section and combines the additional unavailable section and said unavailable sections adjoining opposite sides of the additional unavailable section so that said first unavailable section adding unit determines a combination of the additional unavailable section and adjoining unavailable sections as a new unavailable section, and that if any particular one of the available sections adjoining the undetermined section is of a time length smaller than said second predetermined length after determination by said available section adding unit, combines the particular available section and the unavailable and undetermined sections adjoining the particular available section so that said first unavailable section adding unit determines a combination of the particular available section and the unavailable and undetermined sections adjoining the particular available section as a new undetermined section; and a second unavailable section adding unit that calculates an average of the average levels in each of the available and undetermined sections after determination by said first unavailable section adding unit and that if the calculated average of any particular one of the available and undetermined sections is smaller than a second predetermined value, changes the particular available or undetermined section into an additional unavailable section, but, if the calculated average of any particular one of the available and undetermined sections is greater than said second predetermined value, changes the undetermined section into an additional available section.

37. A sound signal analyzing device comprising:

an input unit that inputs a sound signal to said sound signal analyzing device;

a periodic-reference-point detecting unit that detects a plurality of periodic reference points of the sound signal inputted via said input unit;

a same-waveform-section detecting unit that determines degrees of similarity in waveform between every adjacent signal sections of the inputted sound signal corresponding to the periodic reference points detected by said periodic-reference-point detecting unit and links together the signal sections having a high similarity so as to detect same-waveform sections; and a steady section determining unit that determines a steady section of the inputted sound signal on the basis of the same-waveform sections detected by said same-waveform section detecting unit.

38. A sound signal analyzing device as recited in claim 37 which further comprises a note analyzing unit that analyzes a representative frequency of the inputted sound signal in the steady section determined by said steady section determining unit and thereby determines a note of the inputted sound signal.

39. A sound signal analyzing device comprising:

an input unit that inputs a sound signal to said sound signal analyzing device;

a first periodic-reference-point detecting unit that detects a plurality of provisional periodic reference points of the sound signal inputted via said input unit;

a frequency range detecting unit that detects maximum, and minimum frequencies of the inputted sound signal on the basis of the provisional periodic reference points detected by said first periodic-reference-point detecting unit;

a filtering unit that performs, on the inputted sound signal, a band-pass filtering operation using as a cut-off frequency the maximum and minimum frequencies detected by said frequency range detecting unit;

a second periodic-reference-point detecting unit that detects a plurality of periodic reference points of the sound signal outputted from said filtering unit;

a same-waveform-section detecting unit that determines degrees of similarity in waveform between every adjacent one of signal sections of the inputted sound signal corresponding to the periodic reference points detected by said second periodic-reference-point detecting unit and links together the signal sections having a high similarity so as to detect same-waveform sections; and a steady section determining unit that determines a steady section of the inputted sound signal on the basis of the same-waveform sections detected by said same-waveform-section detecting unit.

40. A sound signal analyzing device comprising:

an input unit that inputs a sound signal to said sound signal analyzing device;

an available section analyzing unit that determines an available section of the sound signal, inputted via said input unit, where there appears to be a musical sound;

a periodic-reference-point detecting unit that detects a plurality of periodic reference points on plus and minus amplitude sides of the inputted sound signal forming the available section;

a same-waveform-section detecting unit that for each of the plus and minus amplitude sides of the inputted sound signal, determines degrees of similarity in waveform between every adjacent signal sections of the inputted sound signal corresponding to the periodic reference points detected by said periodic-reference-point detecting unit and links together the signal sections having a high similarity so as to detect same-waveform sections;

a tone-color-section determining unit that determines, as same-tone-color sections, signal sections obtained by superposing the plus and minus amplitude sides of the same-waveform sections detected by said same-waveform-section detecting unit; and a steady section determining unit that determines a steady section of the inputted sound signal on the basis of the same-tone-color sections determined by said tone-color-section determining unit.

41. A sound signal analyzing device comprising:

an input unit that inputs a sound signal to said sound signal analyzing device;

an available section analyzing unit that determines an available section of the sound signal, inputted via said input unit, where there appears to be a musical sound;

a first periodic-reference-point detecting unit that detects a plurality of provisional periodic reference points of the inputted sound signal forming the available section; a frequency range detecting unit that detects maximum and minimum frequencies of the inputted sound signal on the basis of the provisional periodic reference points detected by said first periodic-reference-point detecting unit;

a filtering unit that performs, on the inputted sound signal, a band-pass filtering operation using as a cut-off frequency the maximum and minimum frequencies detected by said frequency range detecting unit;

a second periodic-reference-point detecting unit that detects a plurality of periodic reference points of the sound signal outputted from said filtering unit;

a same-waveform-section detecting unit that, for each of plus and minus amplitude sides of the inputted sound signal, determines degrees of similarity in waveform between every adjacent one of signal sections of the inputted sound signal corresponding to the periodic reference points detected by said second periodic-reference-point detecting unit and links together the signal sections having a high similarity so as to detect same-waveform sections; and a steady section determining unit that determines a steady section of the inputted sound signal on the basis of the same-waveform sections detected by said same-waveform-section detecting unit.

42. A performance information generating device comprising:

an input unit that inputs an optional sound signal to said performance information generating device;

a steady section analyzing unit that analyzes a steady section, of the sound signal inputted via said input unit, corresponding to a single note;

a frequency range determining unit that determines a representative frequency of each said steady section analyzed by said steady section analyzing unit;

a converting unit that converts differences in the representative frequency between every adjacent ones of said steady sections into relative values based on musical interval representation in cents;

a musical interval data creating unit that creates musical interval data indicative of a musical interval between the adjacent steady sections on the basis of the corresponding relative value; and a note assigning unit that assigns respective notes of a predetermined scale to the steady sections on the basis of the corresponding musical interval data.

43. A performance information generating device comprising:

an input unit that inputs an optional sound signal to said performance information generating device;

a steady section analyzing unit that analyzes a steady section, of the sound signal inputted via said input unit, corresponding to a single note;

a frequency range determining unit that determines a representative frequency of each said steady section analyzed by said steady section analyzing unit;

a phrase detecting unit that combines a plurality of the steady sections analyzed by said steady section analyzing unit to detect a single phrase;

a converting unit that converts a difference in the representative frequency between each of the steady sections within the phrase detected by said phrase detecting unit and every other steady section preceding said steady sections within the phrase, into a relative value based on musical interval representation in cents;

a weighing unit that, for each of the steady sections within the phrase detected by said phrase detecting unit, calculates a weight based on a time distance relative to every other said steady section preceding said steady section;

a musical interval data calculating unit that, for each of the steady sections, calculates musical interval data indicative of a musical interval from another said steady section on the basis of the corresponding relative value obtained by said converting unit and the corresponding weight calculated by said weighing unit; and a note assigning unit that assigns respective notes of a predetermined scale to the steady sections on the basis of the corresponding musical interval data.

44. A performance information generating device comprising:

an input unit that inputs an optional sound signal to said performance information generating device;

a steady section analyzing unit that analyzes a steady section, of the sound signal inputted via said input unit, corresponding to a single note;

a frequency range determining unit that determines a representative frequency of each said steady section analyzed by said steady section analyzing unit;

a phrase detecting unit that combines a plurality of the steady sections analyzed by said steady section analyzing unit to detect a single phrase;

a converting unit that converts a difference in the representative frequency between a leading one of the steady sections within the phrase detected by said phrase detecting unit and every other said steady section succeeding said leading steady section, into a relative value based on musical interval representation in cents;

a musical interval data calculating unit that, for each of the steady sections, calculates musical interval data dicative of a musical interval from said leading steady section on the basis of the corresponding relative value obtained by said converting unit; and a note assigning unit that assigns respective of a predetermined scale to the steady sections on the basis of the corresponding musical interval data.

45. A performance information generating device comprising:

an input unit that inputs an optional sound signal to said performance information generating device;

a steady section analyzing unit that analyzes a steady section, of the sound signal inputted via said input unit, corresponding to a single note; and a note assigning unit that analyzes a representative frequency of the sound signal for each said steady section analyzed by said steady section analyzing unit and assigns respective notes of a predetermined scale to the steady sections on the basis of analyzed results, said note assigning unit first assigning a predetermined note of the predetermined scale to a leading one of the steady sections and then sequentially assigning a note of the predetermined scale to every other said steady section.

46. A performance information generating device comprising:

an input unit that inputs an optional sound signal to said performance information generating device;

a steady section analyzing unit that analyzes a steady section, of the sound signal inputted via said input unit, corresponding to a single note; and a note assigning unit that analyzes a representative frequency of the sound signal for each said steady section analyzed by said steady section analyzing unit and assigns respective notes of a predetermined scale to the steady sections on the basis of analyzed results, wherein said note assigning unit first analyzes a leading one of the steady sections to detect an average frequency of the leading steady section and assigns a predetermined note, based on the detected average frequency, of the predetermined scale to the leading steady section and then sequentially assigning a note of the predetermined scale to every other said steady section.

47. A performance information generating device comprising:

an input unit that inputs an optional sound signal to said performance information generating device;

a steady section analyzing unit that analyzes a steady section, of the sound signal inputted via said input unit, corresponding to a single note; and a note assigning unit that analyzes a representative frequency of the sound signal for each said steady section analyzed by said steady section analyzing unit and assigns respective notes of a predetermined scale to the steady sections on the basis of analyzed results, wherein said note assigning unit first provisionally assigns respective notes of a plurality of scales to the steady sections while deviating note positions from each other so as to calculate cumulative total note assignment differences at the individual note positions of the scales and then determines an optimum scale on the basis of the calculated cumulative total note assignment differences so as to sequentially assign respective notes of the determined optimum scale to the steady sections.

48. A performance information generating device comprising:

an input unit that inputs an optional sound signal to said performance information generating device;

a steady section analyzing unit that analyzes a steady section, of the sound signal inputted via said input unit, corresponding to a single note; and a note assigning unit that analyzes a representative frequency of the sound signal for each said steady section analyzed by said steady section analyzing unit and selects a predetermined scale on the basis of analyzed results so as to assigns respective notes of the predetermined scale to the steady sections, wherein in assigning the respective notes of the predetermined scale, said note assigning unit being capable of assigning a note, other than the notes of the predetermined scale, depending on a predetermined note difference allowance.

* * * * *